US008353585B2

(12) United States Patent
Harada

(10) Patent No.: US 8,353,585 B2
(45) Date of Patent: Jan. 15, 2013

(54) WASTE LIQUID COLLECTOR

(75) Inventor: Shuhei Harada, Chino (JP)

(73) Assignee: Seiko Epson Corporation, Tokyo (JP)

( * ) Notice: Subject to any disclaimer, the term of this patent is extended or adjusted under 35 U.S.C. 154(b) by 220 days.

(21) Appl. No.: 12/394,290

(22) Filed: Feb. 27, 2009

(65) Prior Publication Data

US 2009/0219339 A1 Sep. 3, 2009

(30) Foreign Application Priority Data

Feb. 29, 2008 (JP) ..... 2008-049541
Feb. 29, 2008 (JP) ..... 2008-049542
Feb. 29, 2008 (JP) ..... 2008-049543
Apr. 30, 2008 (JP) ..... 2008-119189
Apr. 30, 2008 (JP) ..... 2008-119190
Apr. 30, 2008 (JP) ..... 2008-119191

(51) Int. Cl.
*B41J 2/185* (2006.01)
*B41J 2/18* (2006.01)

(52) U.S. Cl. ..... 347/90; 347/36; 347/84; 347/85; 347/89; 347/91

(58) Field of Classification Search ..... 347/36, 347/90, 91
See application file for complete search history.

(56) References Cited

U.S. PATENT DOCUMENTS 4,901,094 A 2/1990 Iwagami
5,023,629 A 6/1991 Kiyohara
5,221,935 A * 6/1993 Uzita ..... 347/36
5,506,611 A * 4/1996 Ujita et al. ..... 347/86
5,912,687 A 6/1999 Cowger
RE36,279 E * 8/1999 Ujita ..... 347/86
6,042,216 A * 3/2000 Garcia et al. ..... 347/29
6,170,937 B1 1/2001 Childers et al.
6,203,138 B1 3/2001 Hirabayashi
6,220,314 B1 * 4/2001 Sato ..... 141/351
6,227,642 B1 5/2001 Hanabusa
6,281,911 B1 * 8/2001 Nakazawa et al. ..... 347/36
6,832,860 B2 12/2004 Yoon
6,999,702 B2 2/2006 Fordahl
7,226,154 B2 6/2007 Seino (Continued)

FOREIGN PATENT DOCUMENTS

CN 1272432 A 11/2000

(Continued)

OTHER PUBLICATIONS

U.S. Appl. No. 12/394,172, Jan. 25, 2011, Office Action.

(Continued)

*Primary Examiner* — Ryan Lepisto
(74) *Attorney, Agent, or Firm* — Workman Nydegger

(57) ABSTRACT

A waste liquid collector is detachably mounted on a device including a discharge unit discharging a waste liquid and stores the waste liquid discharged from the discharge unit when the waste liquid collector is mounted on the device. The waste liquid collector includes: an opening through which the discharge unit is inserted or extracted at the time of mounting or detaching the waste liquid collector on or from the device; a collector-side connection terminal which comes in contact with a device-side connection terminal included in the device when the discharge unit of the device is inserted into the opening; and a positioning unit which positions the collector-side connection terminal to come in contact with the device-side connection terminal when the waste liquid collector is mounted on the device.

9 Claims, 21 Drawing Sheets

U.S. PATENT DOCUMENTS

| | | | | |
|---|---|---|---|---|
| 7,490,929 | B2 | 2/2009 | Seino | |
| 7,571,981 | B2 | 8/2009 | Yamada | |
| 7,661,790 | B2 | 2/2010 | Harada et al. | |
| 7,681,982 | B2 | 3/2010 | Suzuki | |
| 7,950,789 | B2 | 5/2011 | Matsumoto | |
| 2005/0018009 | A1* | 1/2005 | Otsubo | 347/36 |
| 2005/0041061 | A1* | 2/2005 | Ishizawa et al. | 347/36 |
| 2005/0078145 | A1 | 4/2005 | Inoue et al. | |
| 2005/0195241 | A1* | 9/2005 | Kawai et al. | 347/36 |
| 2005/0200650 | A1 | 9/2005 | Inokuchi | |
| 2006/0017770 | A1* | 1/2006 | Harada et al. | 347/36 |
| 2007/0008372 | A1* | 1/2007 | Katada | 347/36 |
| 2007/0030304 | A1* | 2/2007 | Yamada | 347/36 |
| 2007/0058011 | A1 | 3/2007 | Wencel | |
| 2008/0049058 | A1 | 2/2008 | Yakura et al. | |
| 2009/0218270 | A1 | 9/2009 | Harada et al. | |
| 2009/0219337 | A1 | 9/2009 | Harada et al. | |
| 2009/0219338 | A1 | 9/2009 | Harada et al. | |

FOREIGN PATENT DOCUMENTS

| | | | |
|---|---|---|---|
| EP | 0412459 | | 2/1991 |
| EP | 0928694 | | 7/1999 |
| EP | 1013446 | | 6/2000 |
| EP | 1431037 | | 6/2004 |
| JP | 01-174460 | | 7/1989 |
| JP | 02-182643 | A | 7/1990 |
| JP | 05-069557 | | 3/1993 |
| JP | 05-162334 | | 6/1993 |
| JP | 06-064185 | | 3/1994 |
| JP | 06-198907 | | 7/1994 |
| JP | 09-109411 | | 4/1997 |
| JP | 11-078053 | A | 3/1999 |
| JP | 11-129488 | | 5/1999 |
| JP | 2000-085145 | | 3/2000 |
| JP | 2007-127453 | | 5/2000 |
| JP | 2000-238292 | | 9/2000 |
| JP | 2001-310486 | | 11/2001 |
| JP | 2001-353882 | | 12/2001 |
| JP | 2002-029065 | | 1/2002 |
| JP | 2002-301831 | | 10/2002 |
| JP | 2004-345249 | | 12/2004 |
| JP | 2005-061245 | | 3/2005 |
| JP | 2006-029161 | | 2/2006 |
| JP | 2006-035697 | | 2/2006 |
| JP | 2006-044243 | | 2/2006 |
| JP | 2006-123563 | | 5/2006 |
| JP | 2006-142630 | | 6/2006 |
| JP | 2006-218846 | | 8/2006 |
| JP | 2006-256140 | A | 9/2006 |
| JP | 2007-038590 | | 2/2007 |
| JP | 2007-040215 | | 2/2007 |
| JP | 2007-050548 | | 3/2007 |
| JP | 2007-130998 | | 5/2007 |
| JP | 2007-223227 | | 9/2007 |
| JP | 2008-036984 | | 2/2008 |

OTHER PUBLICATIONS

U.S. Appl. No. 12/394,172, Jun. 24, 2011, Office Action.
U.S. Appl. No. 12/394,263, Jun. 14, 2011, Office Action.
U.S. Appl. No. 12/394,263, Nov. 22, 2011, Office Action.
U.S. Appl. No. 12/394,233, Jun. 14, 2011, Office Action.
U.S. Appl. No. 12/394,233, Nov. 25, 2011, Office Action.
European Search Report mailed on Jan. 21, 2011, for European Patent Application No. 09714143.6.
U.S. Appl. No. 12/394,172, Mailed Jan. 25, 2011, Office Action.
U.S. Appl. No. 12/394,172, Mailed Jun. 24, 2011, Office Action.
U.S. Appl. No. 12/394,263, Mailed Jun. 14, 2011, Office Action.
U.S. Appl. No. 12/394,263, Mailed Nov. 22, 2011, Office Action.
U.S. Appl. No. 12/394,233, Mailed Jun. 14, 2011, Office Action.
U.S. Appl. No. 12/394,233, Mailed Nov. 25, 2011, Office Action.

* cited by examiner

WASTE LIQUID COLLECTOR

CROSS REFERENCE TO RELATED APPLICATIONS

The entire disclosure of Japanese Patent Application Nos. 2008-119189, filed Apr. 30, 2008, 2008-119190, filed Apr. 30, 2008, 2008-119191, filed Apr. 30, 2008, 2008-049542, filed Feb. 29, 2008, 2008-049543, filed Feb. 29, 2008, 2008-049541, filed Feb. 29, 2008 are expressly incorporated by reference herein.

BACKGROUND

1. Technical Field

The present invention relates to a waste liquid collector which is detachably mounted on a device which includes a discharge unit discharging a waste liquid and is capable of storing the waste liquid discharged from the discharge unit when being mounted on the device.

2. Related Art

In the past, as a liquid ejecting device which ejects a liquid to a target from nozzle openings formed in a liquid ejecting head, an ink jet printer (hereinafter, simply referred to as "a printer"), for example, was well known. In this printer, a so-called cleaning process of forcedly sucking thickened ink within a print head (liquid ejecting head) as waste ink (waste liquid) is performed in order to prevent the nozzle openings from clogging due to the thickened ink (liquid) and discharge bubbles and dust mixed in the ink within the print head.

The waste ink forcedly sucked from the print head by the cleaning process is discharged to a waste ink tank (waste liquid collector) disposed at a predetermined location inside the printer through a flexible tube functioning as a liquid passage and is absorbed by a waste ink absorbing member (waste liquid absorbing member) received in the waste ink tank. Here, an absorption capability of the waste ink absorbing member is limited. Therefore, when the absorption capability reaches the limit, an absorption efficiency of the waste ink may decrease. In order to solve this problem, recently, a waste ink tank which can be detachably mounted on the printer has been suggested, as disclosed in JP-A-2007-130998, for example.

That is, the waste ink tank which has a box-like shape having a bottom portion and an open top portion so that an ink solvent of the waste ink absorbed by the waste ink absorbing member volatilizes is detachably mounted inside the printer disclosed in JP-A-2007-130998. The waste ink forcedly sucked from the print head is discharged from a downstream end (hereinafter, also referred to as "a discharge unit") of the tube extending and facing downward from a sucking pump to the inside of the waste ink tank. Then, the waste ink discharged to the waste ink tank is absorbed by the waste ink absorbing member. When the absorption capability of the waste ink absorbing member reaches the limit, the waste ink tank is detached from the printer and replaced with a new waste ink tank.

As the waste ink tank which is detachably mounted, there is known a waste ink tank in which an opening through which a discharge unit discharging waste ink in a printer is inserted or extracted is formed on a side wall and which is mounted on or detached from the printer by moving the discharge unit into the opening in insertion and extraction directions. In general, in the waste ink tank which is detachably mounted, a connection terminal (collector-side connection terminal) of a circuit board is provided on a part of the external side surface. When the waste ink tank is mounted on the printer, the collector-side connection terminal comes in contact with a connection terminal (device-side connection terminal) of the printer. In addition, when contact surfaces of the connection terminals appropriately come in contact with each other, various kinds of information (information on a use start date of the waste ink tank, the number of times of cleaning, an integration value of a discharge amount of waste ink, and the like) on the waste ink are exchanged between the circuit board of the waste ink tank and a control unit of the printer.

However, in some cases, the waste ink tank is moved toward the mount location of the printer while being rotated about the axis of the discharge unit inserted into the opening, when the waste ink tank is mounted on the printer. In this case, the contact surfaces of both the connection terminals may be deviated from each other in a rotation direction of the waste ink tank, thereby causing a contact failure. Moreover, when the contact surfaces of both the connection terminals may be deviated from each other in the rotation direction of the waste ink tank during the rotation and the contact surfaces come in contact with other, the contact surfaces of both the connection terminals may be damaged. Accordingly, even though the contact surfaces of both the connection terminals again come in contact with each other later, the contact failure may be caused.

SUMMARY

An advantage of some aspects of the invention is that it provides a waste liquid collector which can be detachably mounted on the device discharging a waste liquid and is capable of ensuring appropriate connection between a collector-side connection terminal and a device-side connection terminal when the waste liquid collector is mounted on the device.

According to an aspect of the invention, there is provided a waste liquid collector which is detachably mounted on a device including a discharge unit discharging a waste liquid and stores the waste liquid discharged from the discharge unit when the waste liquid collector is mounted on the device. The waste liquid collector includes: an opening through which the discharge unit is inserted or extracted at the time of mounting or detaching the waste liquid collector on or from the device; a collector-side connection terminal which comes in contact with a device-side connection terminal included in the device when the discharge unit of the device is inserted into the opening; and a positioning unit which positions the collector-side connection terminal to come in contact with the device-side connection terminal when the waste liquid collector is mounted on the device.

With such a configuration, the waste liquid collector can be mounted on or detached from the device by moving the discharge unit of the device to be inserted or extracted into or from the opening. When the waste liquid collector is mounted on the device while the discharge unit of the device is inserted into the opening, the waste liquid collector is positioned so that the collector-side connection terminal comes in contact with the device-side connection terminal by the positioning unit. That is, the waste liquid collector is mounted on the device on the basis of a positioning function of the positioning unit so that the collector-side connection terminal appropriately comes in contact with the device-side connection terminal. Accordingly, the waste liquid collector can be detached from the device discharging the waste liquid for exchange. In addition, it is possible to ensure the appropriate connection between the collector-side connection terminal and the device-side connection terminal at the time of mounting the waste liquid collector on the device.

In the waste liquid collector according to this aspect of the invention, the collector-side connection terminal is located between the opening and the positioning unit in insertion and extraction directions in which the discharge unit is inserted into and extracted from the opening.

With such a configuration, when the waste liquid collector is mounted on the device, the movement in the radial direction from the center of the opening is regulated first by inserting the discharge unit of the device into the opening, and the collector-side connection terminal is located to come in contact with the device-side connection terminal. In this state, the waste liquid collector is mounted on the device on the basis of the positioning function of the positioning unit so that the collector-side connection terminal appropriately comes in contact with the device-side connection terminal. Accordingly, the waste liquid collector can be detached from the device discharging the waste liquid for exchange. In addition, it is possible to ensure the appropriate connection between the collector-side connection terminal and the device-side connection terminal at the time of the mount on the device.

In the waste liquid collector according to this aspect of the invention, the positioning unit may include a contact portion which comes in contact with a counter member included in the device.

With such a configuration, when the waste liquid collector is mounted on the device and the contact portion of the positioning unit comes in contact with the counter member of the device, the collector-side connection terminal comes in contact with the device-side connection terminal. Accordingly, it is possible to easily and appropriately mount the waste liquid collector, simply by bringing the contact portion of the positioning unit into contact with the counter member of the device.

In the waste liquid collector according to this aspect of the invention, the contact portion may be provided in the insertion and extraction directions in which the discharge unit is inserted into and extracted from the opening.

With such a configuration, when the waste liquid collector is moved in the mount direction while the discharge unit of the device is inserted into the opening, the contact between the contact portion of the positioning unit and the counter member of the device is maintained and the contact between the device-side connection terminal and the collector-side connection terminal is also maintained. Accordingly, when the waste liquid collector is mounted on the device, the contact between the device-side connection terminal and the collector-side connection terminal can be appropriately ensured.

In the waste liquid collector according to this aspect of the invention, the contact portion may come in contact with the counter member of the device so that the collector-side connection terminal regulates movement at least in a direction getting away from the device-side connection terminal in a rotation direction about an axis of the discharge unit inserted into the opening.

With such a configuration, when the waste liquid collector is mounted on the device, it is possible to prevent the rotation of the waste liquid collector in a direction in which a failure in the contact between the device-side connection terminal and the collector-side connection terminal is caused at the time of inserting the discharge unit into the opening.

According to another aspect of the invention, a liquid ejecting device including a liquid ejecting head which ejects a liquid; a discharge unit which discharges the liquid ejected as a waste liquid from the liquid ejecting head; the waste liquid collector having the above-described configuration which is detachably mounted on a mount location corresponding to the discharge unit and stores the liquid discharged as the waste liquid from the discharge unit when the waste liquid collector is mounted on the mount location; a counter member which comes in contact with a positioning unit when the waste liquid collector is mounted on the mount location; and a device-side connection terminal which comes in contact with a collector-side connection terminal.

With such a configuration, in the liquid ejecting device in which the waste liquid collector can be mounted and detached, the same operation advantages as those of the waste liquid collector described above can be obtained.

The waste liquid collector according to this aspect of the invention is detachably mounted on the device including the discharge unit discharging the waste liquid and stores the waste liquid discharged from the discharge unit when the waste liquid collector is mounted on the device. The waste liquid collector includes an opening through which the discharge unit is inserted or extracted at the time of mounting or detachment the waste liquid collector on or from the device and a collector-side connection terminal which comes in contact with a device-side connection terminal included in the device when the discharge unit of the device is inserted into the opening. In the collector-side connection terminal, the contact surface coming in contact with the device-side connection terminal may not be perpendicular to a straight line extending from the center of the opening in a radial direction.

With such a configuration, the waste liquid collector can be mounted on or detached from the device, by moving the discharge unit of the device to or from the device to be inserted or detached into or from the opening. In the case where the waste liquid collector is mounted on the device while the discharge unit of the device is inserted into the opening, the collector-side connection terminal is displaced in a direction in which the contact surface comes close to or gets away from the device-side connection terminal. That is, both the connection terminals do not come in contact with each other and thus are deviated from each other in the rotation direction. In addition, when the collector-side connection terminal comes in contact with the device-side connection terminal during the rotation of the waste liquid container, the contact surface appropriately comes in contact with the device-side connection terminal. Accordingly, the waste liquid collector can be mounted on and detached from the device discharging the waste liquid for exchange and the contact between the device-side connection terminal and the collector-side connection terminal can be appropriately ensured, when the waste liquid collector is mounted on the device.

In the waste liquid collector according to this aspect of the invention, the opening and the collector-side connection terminal may be provided in a container member which has a box-like shape having a bottom portion and stores the waste liquid discharged from the discharge unit and the collector-side connection terminal may be located below the opening in the container member.

With such a configuration, the collector-side connection terminal is provided in the lower portion in which rigidity is relatively high in the container member which has the box-like shape having the bottom portion. Accordingly, even when stress is applied to the container member, a problem with displacement of the collector-side connection terminal can be reduced. Accordingly, it is possible to satisfactorily maintain the appropriate connection between the collector-side connection terminal and the device-side connection terminal. On the other hand, since the opening through which the discharge unit is inserted is located above the location where the collector-side connection terminal is provided, the waste liquid can be stored up to the height of the location. Accordingly, it is possible to improve storage efficiency of the waste liquid in the container member.

In the waste liquid collector according to this aspect of the invention, the collector-side connection terminal may be provided so that the contact surface coming in contact with the device-side connection terminal is not perpendicular to a straight line extending obliquely and downward in a radial direction of a lower side from the center of the opening.

With such a configuration, in the waste liquid collector, the collector-side connection terminal is not located immediately below the opening. Therefore, even when the waste liquid stored therein leaks from the opening to the inside at the time of mounting the waste liquid collector on the device, the collector-side connection terminal can be prevented from being smeared due to the waste liquid leaking from the opening.

In the waste liquid collector according to this aspect of the invention, the contact surface of the collector-side connection terminal coming in contact with the device-side connection terminal may have a planar shape extending in the insertion and extraction directions in which the discharge unit is inserted into and extracted from the opening.

With such a configuration, when the waste liquid collector is rotated in the state where the discharge unit is inserted into the opening at the time of mounting the waste liquid collector on the printer and the contact surface of the collector-side connection terminal comes in contact with the device-side connection terminal, the further rotation is regulated by the device-side connection terminal. In addition, when the waste liquid collector is moved toward the inside in the mount direction while maintaining the contact between the collector-side connection terminal and the device-side connection terminal, the discharge unit is inserted into the opening and the contact surface of the collector-side connection terminal can appropriately come in contact with the device-side connection terminal. Accordingly, it is possible to simply and appropriately mount the waste liquid collector on the device.

According to still another aspect of the invention, a liquid ejecting device including a liquid ejecting head which ejects a liquid; a discharge unit which discharges the liquid ejected as a waste liquid from the liquid ejecting head; the waste liquid collector having the above-described configuration which is detachably mounted on a mount location corresponding to the discharge unit and stores the liquid discharged as the waste liquid from the discharge unit when the waste liquid collector is mounted on the mount location; and a device-side connection terminal which comes in contact with a collector-side connection terminal, when the waste liquid collector is mounted on the mount location.

In the liquid ejecting device which mounts and detaches the waste liquid collector, the same advantages as those obtained in the waste liquid collector can be obtained.

The waste liquid collector according to this aspect of the invention can be mounted on and detached from the device having the discharge unit discharging the waste liquid. The waste liquid collector which can store the waste liquid discharged from the discharge unit when the waste liquid collector is mounted on the device includes the opening through which the discharge unit is inserted and extracted when the waste liquid collector is mounted on and detached from the device; the collector-side connection terminal which comes in contact with the device-side connection terminal included in the device; and the positioning unit which positions the collector-side connection terminal to come in contact with the device-side connection terminal when the waste liquid collector is mounted on the device.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of the invention will be described.

First Embodiment

Hereinafter, an ink jet printer which is an example of a liquid ejecting device including a waste liquid collecting system in which a waste liquid collector according to the invention is detachably mounted will be described with reference to FIGS. 1 to 11 according to a first embodiment. "Front and rear directions", "upper and lower directions", and "right and left direction" in the following description refer to "front and rear directions", "upper and lower directions", and "right and left direction" indicated by arrows in FIGS. 1 to 3, unless particularly mentioned.

Figure 1:
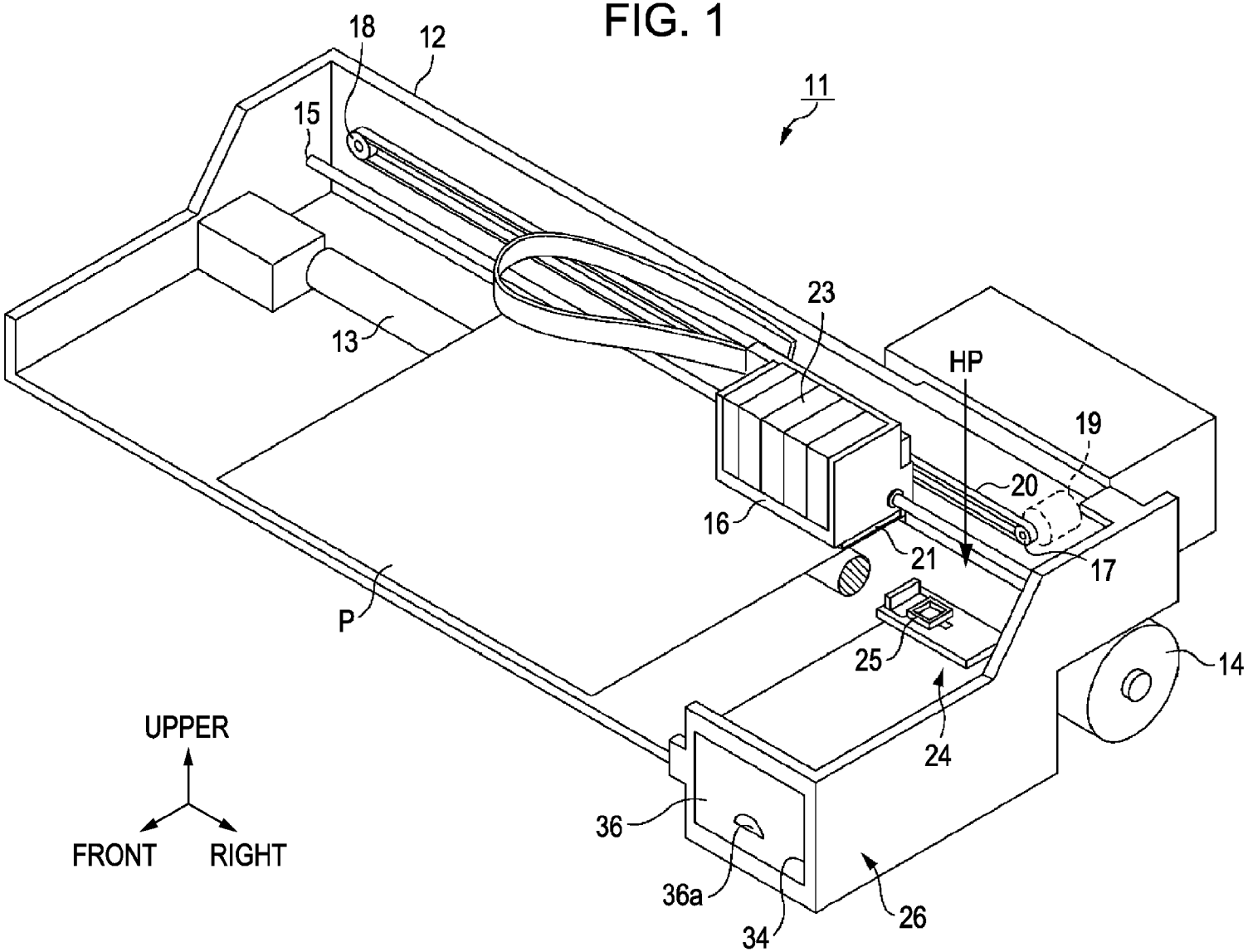
FIG. 1 is a perspective view illustrating an ink jet printer according to embodiments.

As shown in FIG. 1, an ink jet printer (hereinafter, referred to as "a printer) 11 as a liquid ejecting device according to this embodiment includes a frame 12 having a rectangular shape in plan view. A platen 13 extends in the right and left direction inside the frame 12. A sheet-feeding mechanism which is disposed above the platen 13 and includes a sheet-feeding motor 14 feeds a print sheet P from the rear side to the front side. In addition, a guide shaft 15 extending in parallel in a longitudinal direction (the right and left directions) of the platen 13 is disposed above the platen 13 inside the frame 12.

A carriage 16 is supported by the guide shaft 15 so as to reciprocate along a shaft direction (the right and left directions) of the guide shaft 15. A driving pulley 17 and a driven pulley 18 are rotatably supported at locations corresponding to both ends of the guide shaft 15 in the rear surface of the inside of the frame 12, respectively. A carriage motor 19 which serves as a driving source when the carriage 16 reciprocates is connected to the driving pulley 17. A timing belt 20 fixing and supporting the carriage 16 is suspended between the pair of pulleys 17 and 18. Accordingly, the carriage 16 is configured to move in the right and left directions through the timing belt 20 by drive of the carriage motor 19 while being guided by the guide shaft 15.

As shown in FIG. 1, a print head as a liquid ejecting head 21 is disposed on the lower surface of the carriage 16. On the other hand, plural ink cartridges 23 (in this embodiment, five ink cartridges) for supplying ink as a liquid to the print head 21 are detachably mounted on the carriage 16. The ink cartridges 23 individually correspond to plural nozzle opening rows (not shown) formed on a nozzle formation surface 21*a* (see FIG. 2) which is the lower surface of the print head 21. In addition, the ink cartridges 23 individually supply ink to the corresponding nozzle rows through ink passages (not shown) formed inside the print head 21.

A home position HP which is a maintenance location where the carriage 16 is positioned when the printer 11 is turned off or the print head 21 is subjected to maintenance is provided in one end (the right end in FIG. 1) of the inside of the frame 12, that is, in a non-print area which the print sheet P does not reach. In addition, a maintenance unit 24 for performing various maintenance operations is disposed below the home position HP so that the print head 21 keeps performing satisfactory ejection of ink onto the print sheet P.

The maintenance unit 24 includes a cap 25 having a substantially rectangular box-like shape corresponding to the lower surface (the nozzle formation surface) of the print head 21 and an elevation mechanism (not shown) moving up and down the cap 25. In addition, when the cap 25 is moved up by drive of the elevation mechanism (not shown) in the state where the carriage 16 moves to the home position HP, the cap 25 is configured so as to come in contact with the nozzle formation surface 21*a* which is the lower surface of the print head 21 in the state where the cap 25 surrounds the nozzle rows.

Figure 2:
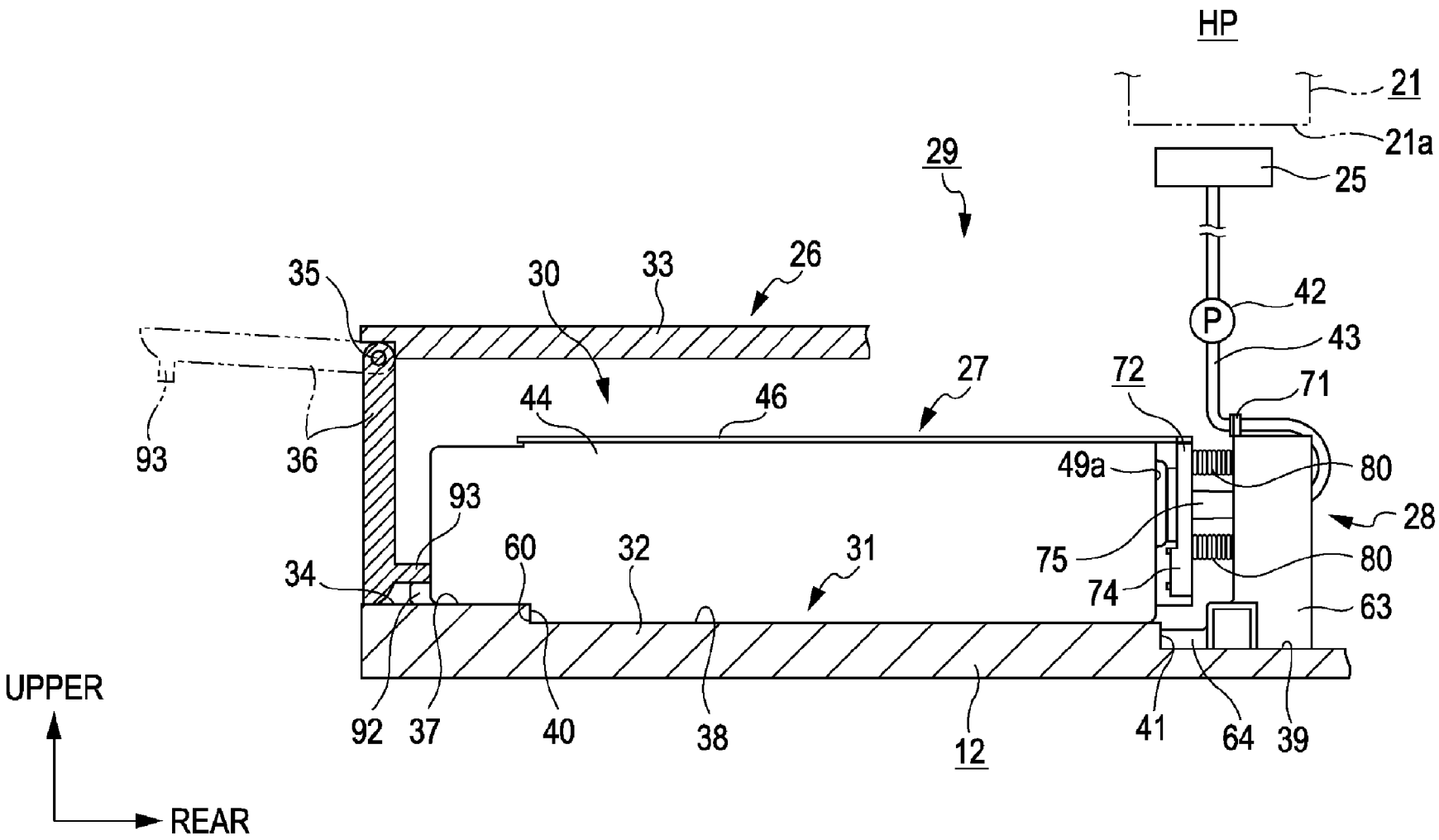
FIG. 2 is a partially-omitted sectional view illustrating a housing in a printer.
Figure 10:
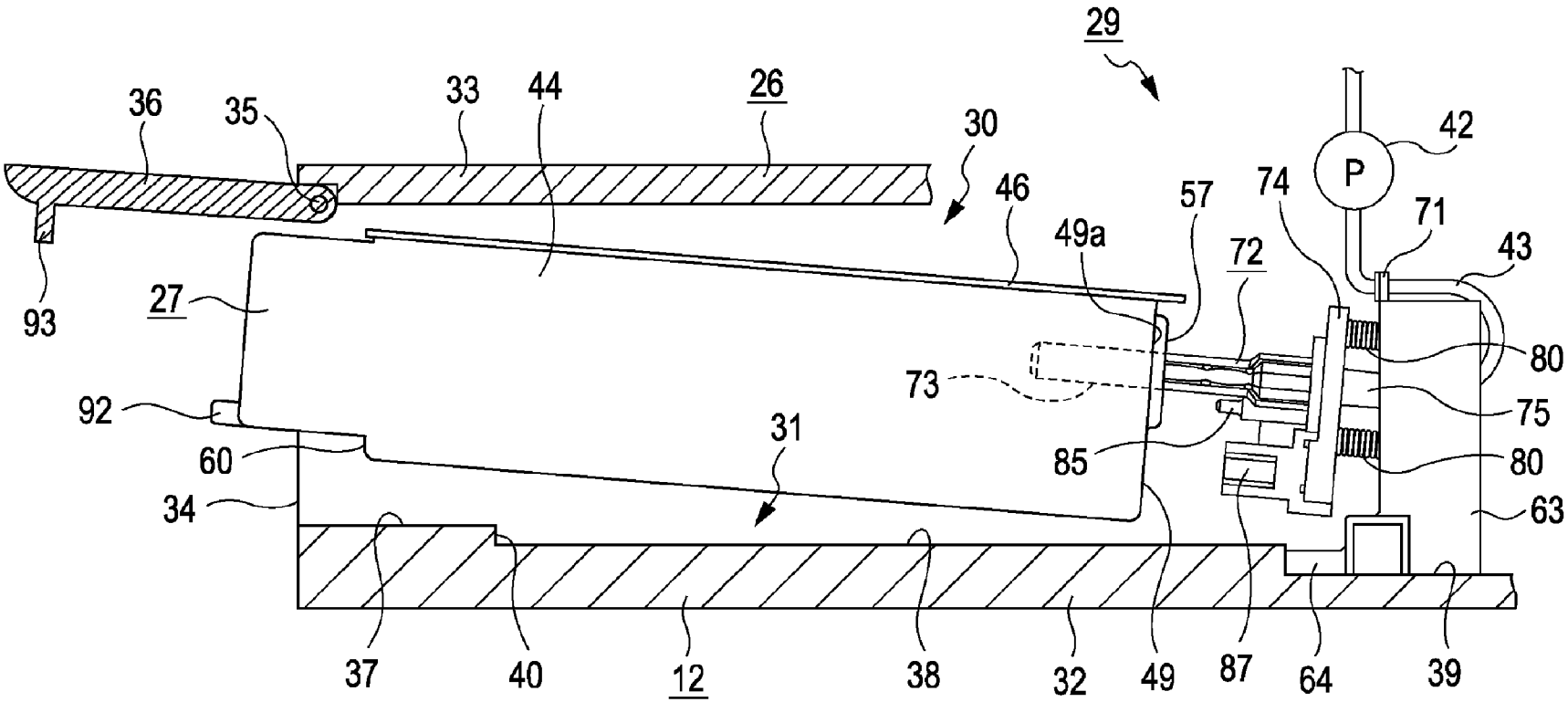
FIG. 10 is a partially-omitted sectional view illustrating the inside of a receiving chamber when the waste ink tank is mounted.

As shown in FIGS. 1 and 2, a housing 26 having a rectangular parallelepiped shape and being formed in the front and rear directions is formed in one end (the right end in FIG. 1) of the inside of the frame 12 and below the home position HP. A receiving chamber 30 receiving a waste liquid collecting system 29 including a waste ink tank 27 as a waste liquid collector and a tube supporting mechanism 28 as a liquid passage forming unit is formed inside the housing 26. In addition, a mount location 31 of the waste ink tank 27 is configured below the receiving chamber 30. As shown in FIGS. 2 and 10, the height (which is a distance between a bottom wall 32 and a top wall 33) of the inside of the receiving chamber 30 is set sufficiently higher than the height of the waste ink tank 27 so that the waste ink tank 27 is tilted in its posture inside the receiving chamber 30.

A rectangular mounting/detaching port 34 for passing the waste ink tank 27 at the time of mounting or detaching the waste ink tank 27 to or from the mount location 31 inside the receiving chamber 30 is formed on the front surface of the housing 26. An opening door 36 is provided in the mounting/detaching port 34 so that the upper end portion thereof is rotatably supported on a pair of right and left shafts 35 formed in both ends of the upper edge of the mounting/detaching port 34. By holding a hand 36*a* formed on the front surface of the opening door 36 to open or close the opening door 36 about the shafts 35, the opening door 36 is opened and closed between a closing location indicated by a solid line and an opening location indicated a two-dot chain line in FIG. 2.

As shown in FIG. 2, inside the receiving chamber 30 of the housing 26, a front step surface 37, an intermediate step surface 38, and a rear step surface 39 are formed in a stepped shape from a front side to a rear side in the front and rear directions on the upper surface of the bottom wall 32. The front step surface 37 is formed so as to have the same height as that of the lower edge of the mounting/detaching port 34. A locking step 40 as a locking portion which makes the intermediate step surface 38 lower than the front step surface 37 is formed between the rear end of the front step surface 37 and the front end of the intermediate step surface 38 so as to extend in the right and left directions.

The intermediate step surface 38 is formed so as to have a length in the front and rear directions slightly shorter than the length of the waste ink tank 27 in the front and rear directions. The almost entire area of the intermediate step surface 38 and the rear half area of the front step surface 37 form the mount location 31 of the waste ink tank 27. The rear step surface 39 is formed so as to be slightly lower than the intermediate step surface 38 with a stepped portion 41 interposed therebetween. The tube supporting mechanism 28 supporting the flexible tube 43, which discharges ink forcedly sucked as waste ink (waste liquid) from the inside of the cap 25 to the waste ink tank 27 with drive of a sucking pump 42, is disposed on the rear step surface 39.

Next, the waste liquid collecting system 29 having the waste ink tank 27 and the tube supporting mechanism 28 and being provided in the printer 11 will be described.

First, the waste ink tank 27 will be described.

Figure 3:
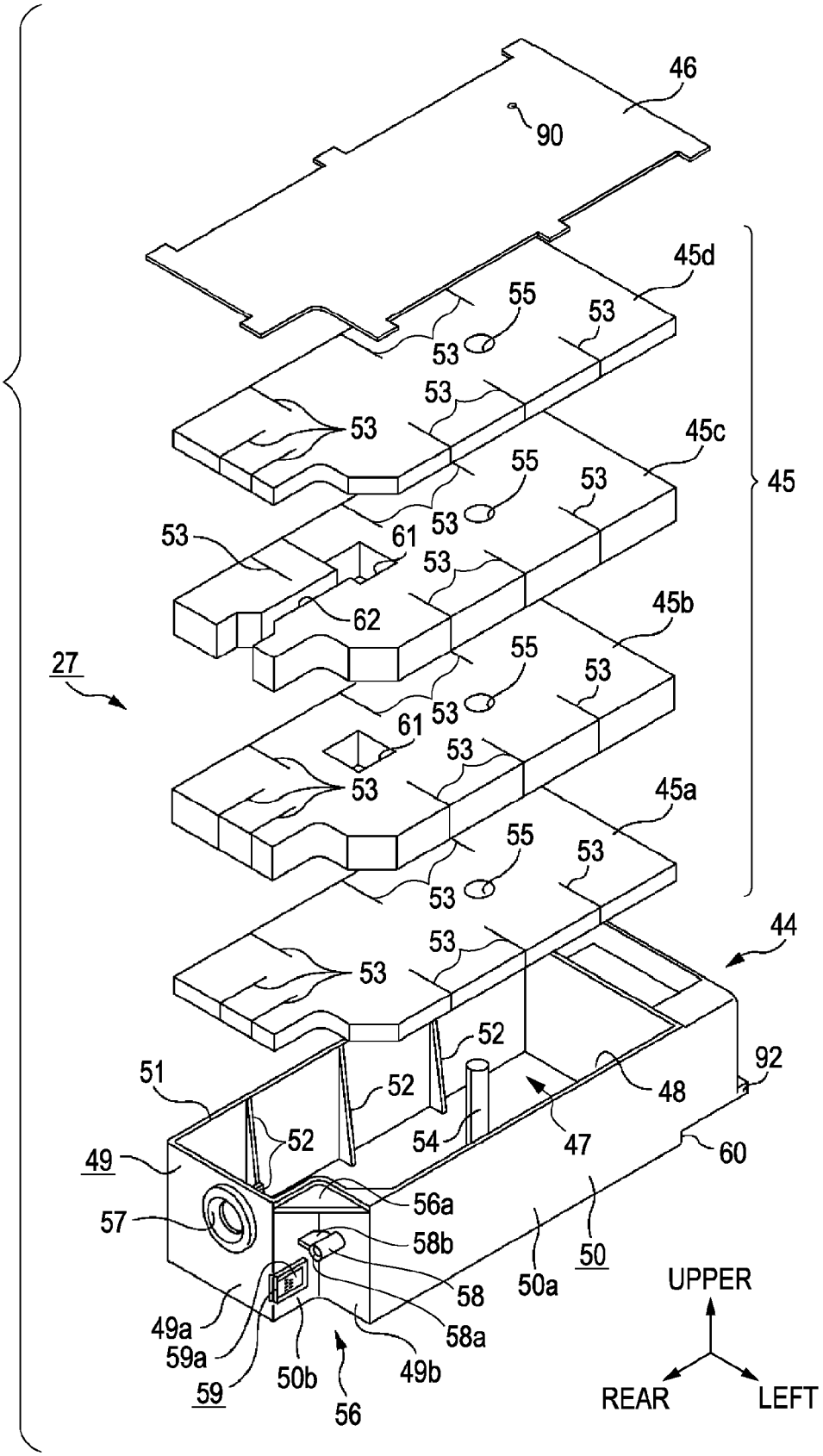
FIG. 3 is an exploded perspective view illustrating a waste ink tank according to a first embodiment.
Figure 4:
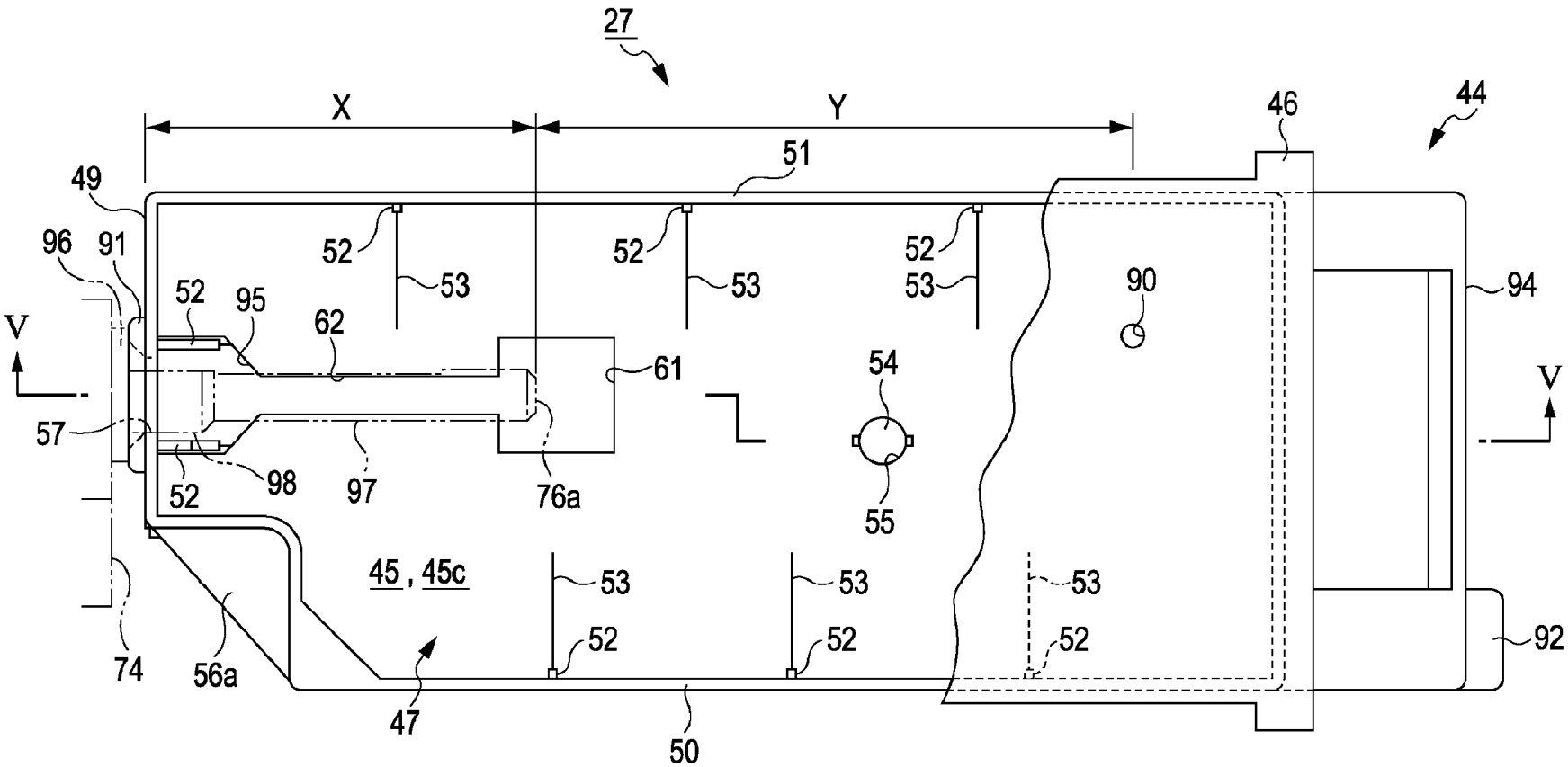
FIG. 4 is a partially-exploded plan view illustrating the waste ink tank according to the first embodiment.

As shown in FIG. 3, the waste ink tank 27 includes a container member 44 which is made of synthetic resin and has a box-like shape having an open top portion and a bottom portion, plural ink absorbing members (waste ink absorbing member) 45*a* to 45*d* (four ink absorbing members in this embodiment) formed of a non-woven fabric or a felt having an external shape corresponding to the open shape of the container member 44, and a film member 46 as a sealing member which has an external shape corresponding to the open shape of the container member 44. An inside space of the container member 44 serves as a receiving space 47. The ink absorbing members 45*a* to 45*d* are received in a laminated manner in the receiving space 47. An upper opening 48 of the container member 44 is sealed by attaching the film member 46 to the container member 44 to cover the upper opening 48 of the container member 44 in which the ink absorbing members 45*a* to 45*d* are received. As shown in FIGS. 3 and 4, an air communicating hole 90 is formed at one location on a front side of the intermediate portion of the film member 46.

Ribs 52 having a thin plate shape are formed in the upper and lower directions at plural locations of inner wall surfaces of a rear wall 49, a left wall 50, and a right wall 51 of the container member 44 (two locations on the rear wall 49 and three locations on each of the left wall 50 and the right wall 51). In FIG. 3, just one rib 52 on the rear wall 49 and just three ribs 52 on the right wall 51 are illustrated. In addition, cut-in portions 53 are formed in the outer peripheries of the ink absorbing members 45*a* to 45*d* so as to correspond to the locations of the ribs 52.

A columnar post 54 is positioned at the almost central location of the inner bottom surface of the container member 44. Round holes 55 as fitting holes for fitting with the post 54 are perforated at the almost central locations of the ink absorbing members 45 so as to correspond to the post 54. The ribs 52 are inserted into the corresponding cut-in portions 53 and the post 54 is inserted into the holes 55 so that the ink absorbing members 45*a* to 45*d* are received in the laminated manner in the reception space 47 of the container member 44. In particular, the ink absorbing members 45*a* to 45*d* are regulated so as not to move toward the inner wall surfaces of the side walls inside the container member 44 by locking the ink absorbing members 45*a* to 45*d* with the post 54 fitting with the holes 55 formed at the almost central locations.

As shown in FIG. 3, a concave portion 56 is formed in the rear left corner of the container member 44. In consequence, the rear wall 49 is divided into a main rear wall 49*a* located on the relatively rear side and a sub rear wall 49*b* located on the relatively front side. In addition, the left wall 50 is divided into a main left wall 50*a* located on the relatively left side and a sub left wall 50*b* located on the relatively right side. In the upper of the concave portion 56, a reinforcing rib 56*a* having a substantially triangular plate shape in plan view is formed between the sub rear wall 49*b* and the sub left wall 50*b*.

A connection port 57 as an opening having a round shape is formed through the main rear wall 49*a*. A cylinder portion 58 having a cylindrical shape which is horizontally long in the cross-section is formed on the sub rear wall 49*b* so as to protrude toward the rear side. A long hole 58*a* of the cylinder portion 58 serves as a positioning unit. The cylinder portion 58 is connected to the sub left wall 50*b* through the reinforcing rib 58*b*. The connection port 57 is formed so that the diameter of the inner circumferential surface becomes gradually smaller in a deeper portion. In addition, the connection port 57 has a function of guiding a member toward the inner center of the connection port 57, when a member inserted into the connection port 57 from the outside comes in contact with the inner circumferential surface of the connection port 57 in the front and rear directions. A sealing portion 91 having a ring shape surrounding the connection port 57 bulges from the main rear wall 49*a* in the circumference of the connection port 57. In addition, the end surface of the sealing portion 91 forms a flat and smooth surface shape parallel to the main rear wall 49*a*.

A connection terminal (collector-side connection terminal) 59 of a circuit board (not shown) storing various kinds of information on the capacity or the like of the waste ink tank 27 is attached to the outside surface of the sub left wall 50*b*. When the waste ink tank 27 is mounted on the mount location 31 of the printer 11, as shown in FIG. 2, a plane-shaped contact surface 59*a* of the connection terminal 59 comes in contact with the connection surface of a connection terminal (device-side connection terminal) 87 (see FIG. 7 to FIGS. 9A and 9B) provided in the tube support mechanism 28 on the side of the printer 11, as indicated by two-dot chain line in FIG. 6A. When both the connection terminals 59 and 87 are appropriately connected to each other, various information (for example, information on a use start date of the waste ink tank 27, the number of times of cleaning, an integration value of a discharge amount of waste ink, and the like) on the waste ink are exchanged between the circuit board on the side of the waste ink tank 27 and a control unit (not shown) of the printer 11.

Figure 5:
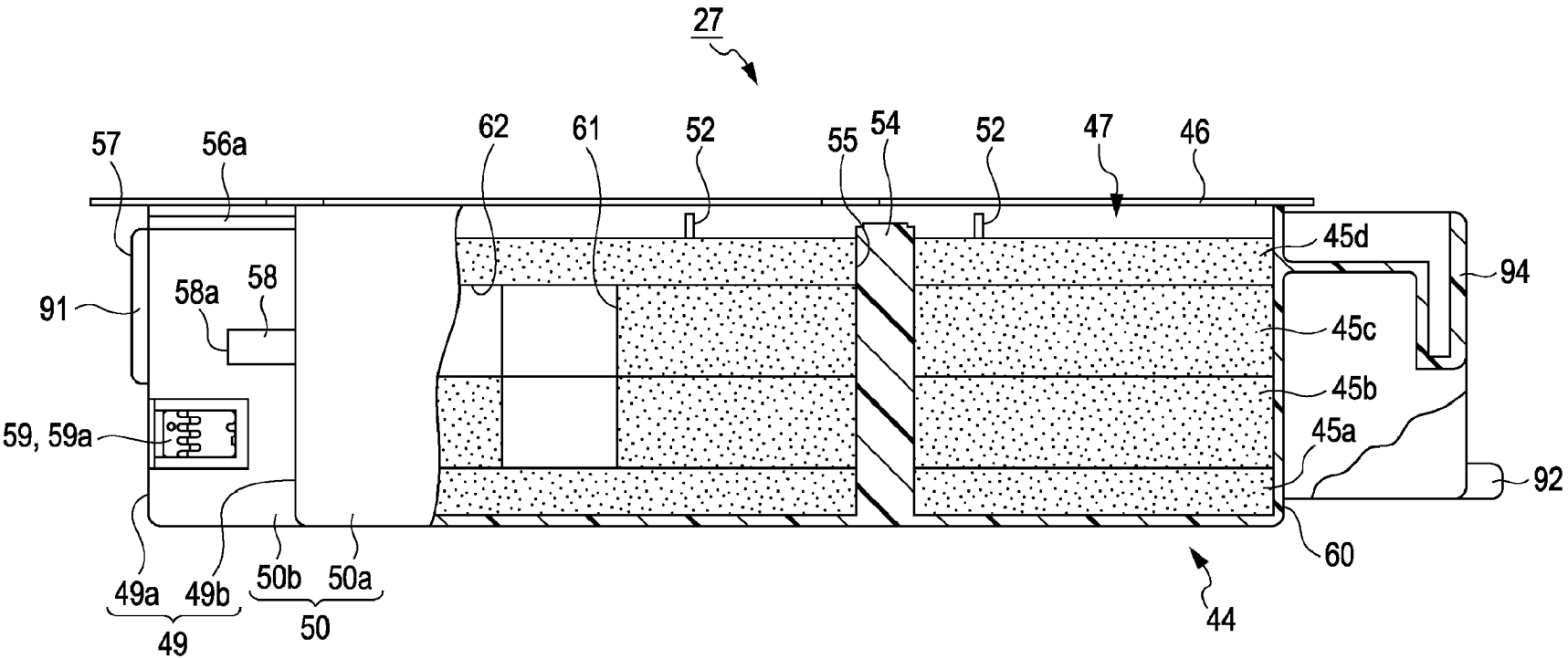
FIG. 5 is a partially-exploded front view illustrating the waste ink tank according to the first embodiment.
Figure 6A:
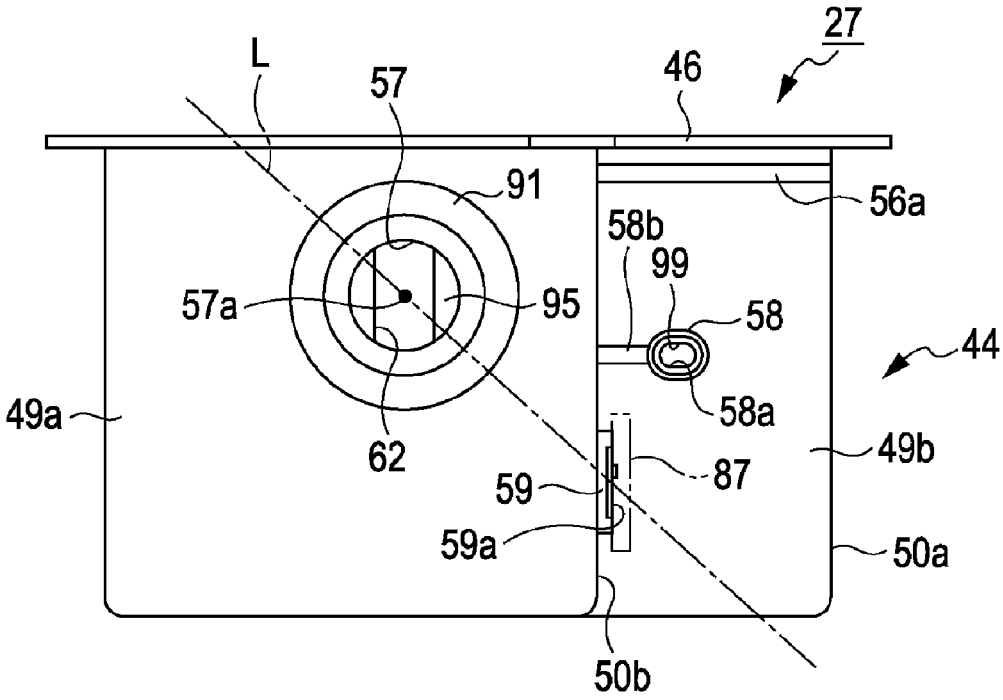
FIG. 6A is a rear side view illustrating the waste ink tank according to the first embodiment and FIG. 6B is a rear side view illustrating a waste ink tank according to a comparative example.
Figure 6B:
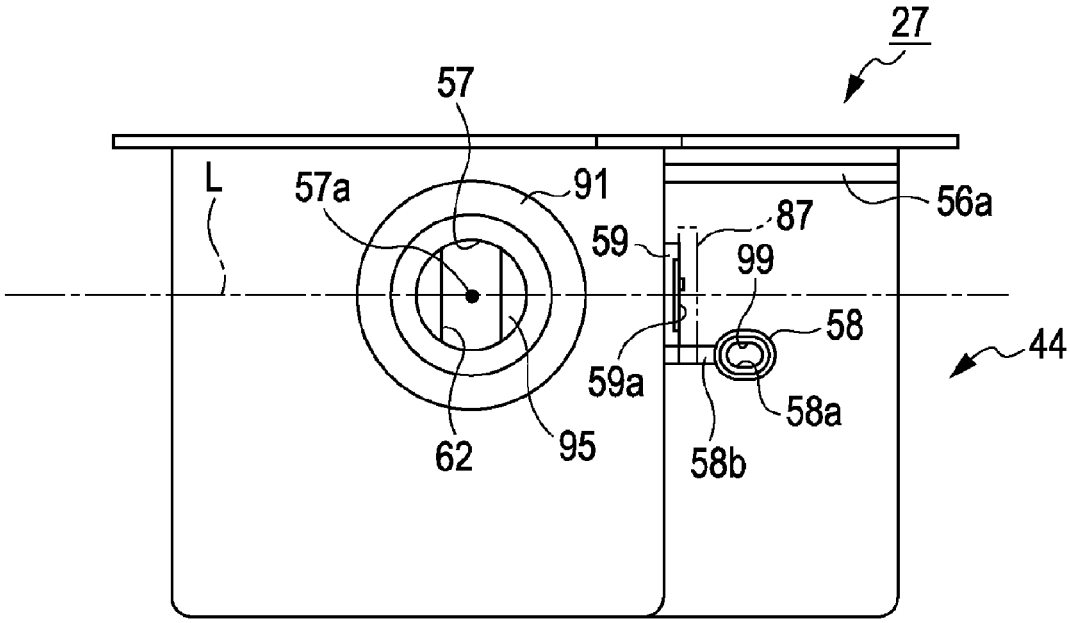

In the waste ink tank 27, as shown in FIGS. 3, 5, and 6A, the connection terminal 59 is not formed on the main rear wall 49*a* on which the connection port 57 is formed, but formed at a location lower than the locations of the connection port 57 and the cylinder portion 58 (the long hole 58*a*) on the sub left wall 50*b* formed perpendicularly to the main rear wall 49*a*. That is, in the container member 44 having the box-like shape which has the bottom portion, the connection terminal 59 is not formed at an upper side location in which deformation is easily caused when a stress is applied and which is closer to the upper opening 48, but formed at a lower side location in which rigidity is relatively high and deformation is difficult due to closeness to the bottom portion and at a location which is not formed immediately below the connection port 57.

As shown in FIG. 6A, the connection terminal 59 is provided at the lower location of the sub left wall 50*b* so that the contact surface 59*a* is not perpendicular to a straight line L extending in a radial direction oriented from the center 57*a* of the connection port 57 to the oblique downward side when the main rear wall 49*a* is viewed from the front side. That is, the connection terminal 59 is provided so that the contact surface 59*a* extends along the vertical plane and in the front and rear directions. In the waste ink tank 27, as shown in FIG. 5, the connection terminal 59 is provided at a location between the connection port 57 and the cylinder portion 58 (the long hole 58*a*) in the front and rear directions.

A locked step 60 as an engagement portion which makes concave and convex engagement in the front and rear directions with the locking step 40 formed on the bottom wall 32 of the housing 26 is formed at a location closer to the rear end than the front end of the outside bottom surface of the container member 44 so as to extend in the right and left directions. In the container member 44, as shown in FIGS. 2 to FIG. 5, a convex portion 92 having a rectangular parallelepiped shape protrudes from a left end location of the lower front end toward the front side. On the other hand, a protrusion 93 as a displacement regulating unit is formed as a member corresponding to the convex portion 92 on the side of the rear surface of the opening door 36 which is provided in the mounting/detaching port 34 of the receiving chamber 30 in the printer 11 so as to be opened or closed. In addition, when the waste ink tank 27 is mounted on the mount location 31 inside the receiving chamber 30 and the opening door 36 is closed, the protrusion 93 becomes a location regulation state where the protrusion 93 is located above the convex portion 92 of the waste ink tank 27 with a slight clearance interposed therebetween. On the other hand, when the opening door 36 is opened, the protrusion 93 becomes a location non-regulation state where the protrusion 93 is spaced from the regulation location.

In the upper front end of the container member 44, as shown in FIG. 5, a gripping portion 94 gripped when a user mounts or detaches the waste ink tank 27 is formed in a cross-sectional L shape in which the front end is curved downward. That is, the gripping portion 94 is formed like cutting the lower portion of the front surface of the container member 44 from a midway point in the upper and lower directions in an inward direction (the rear side in this case) of the container member 44, thereby having a shape which can be easily gripped by the fingers of the user. In addition, the convex portion 92 described above is formed on the left side of both sides of the cut concave portion.

As shown in FIG. 3, the ink absorbing members 45*a* to 45*d* are formed so that a lowermost first ink absorbing member 45*a* has the same thickness of that of an uppermost fourth ink absorbing member 45*d* and a second ink absorbing member 45*b* on a second layer from the downward side has the same thickness as that of a third ink absorbing member 45*c* on a third layer from the downward side. In each of the second ink absorbing member 45*b* and the third ink absorbing member 45*c*, a through-hole 61 having a square shape is formed at a location closer to the rear side than the center portion. In the third ink absorbing member 45*c*, a cut-in groove 62 serving as a connection portion and a guide unit having a predetermined width and is cut in the front and rear directions from the rear end edge to the through-hole 61. In each of the fourth ink absorbing member 45*d* and the second ink absorbing member 45*b*, no cut-in groove is formed at a location corresponding to the cut-in groove 62 of the third ink absorbing member 45*c*. In addition, when the fourth ink absorbing member 45*d* and the second ink absorbing member 45*b* are received in the reception space 47 of the container member 44 in a lamination state where the third ink absorbing member 45*c* is interposed therebetween from both the upper and lower sides, the cut-in groove 62 of the third ink absorbing member 45*c* is blocked from both the upper and lower sides.

As shown in FIG. 4, the groove width of the rear end portion of the cut-in groove 62 is configured as a broader groove corresponding to an arrangement distance between the pair of ribs 52 which are formed on the inner wall surface of the rear wall 49 of the container member 44 so as to interpose the connection port 57 from the both right and left sides. However, the groove width of the front end portion close to the through-hole 61 is narrower than the groove width of the rear end portion. A tapered portion 95 which is broader toward the rear end portion is formed at a connection location between the front end groove having the narrower width and the rear end groove having the broader width.

Next, the tube supporting mechanism 28 will be described.

Figure 7:
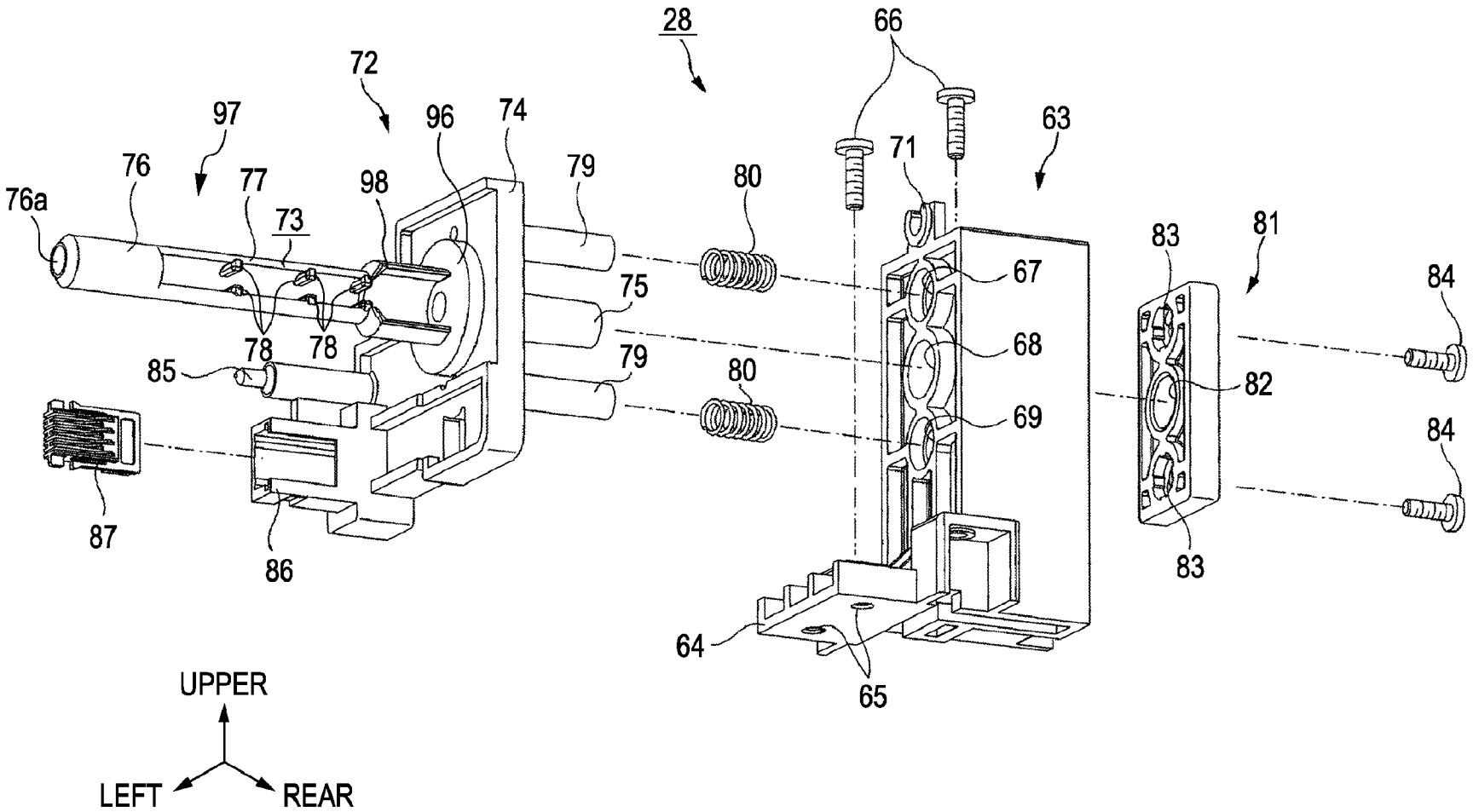
FIG. 7 is an exploded perspective view illustrating a tube supporting mechanism.
Figure 8A:
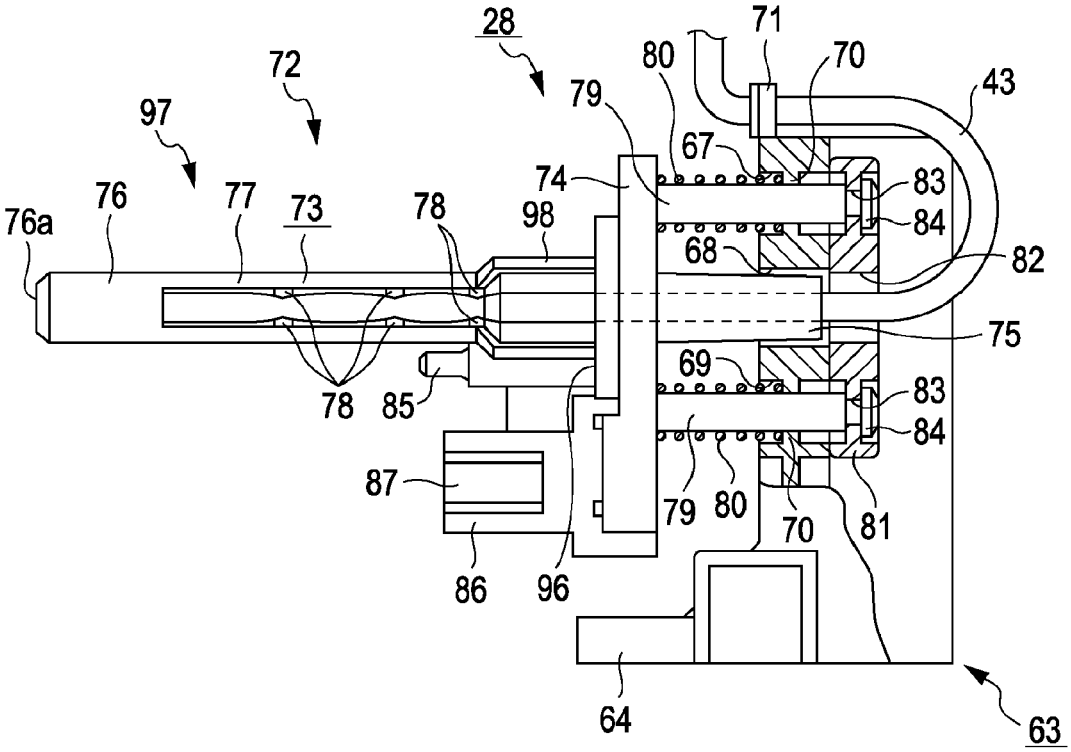
FIG. 8A is a partially-exploded front view illustrating the tube supporting mechanism in a normal state and FIG. 8B is a partially-exploded front view illustrating the tube supporting mechanism when a support member is retreated.
Figure 8B:
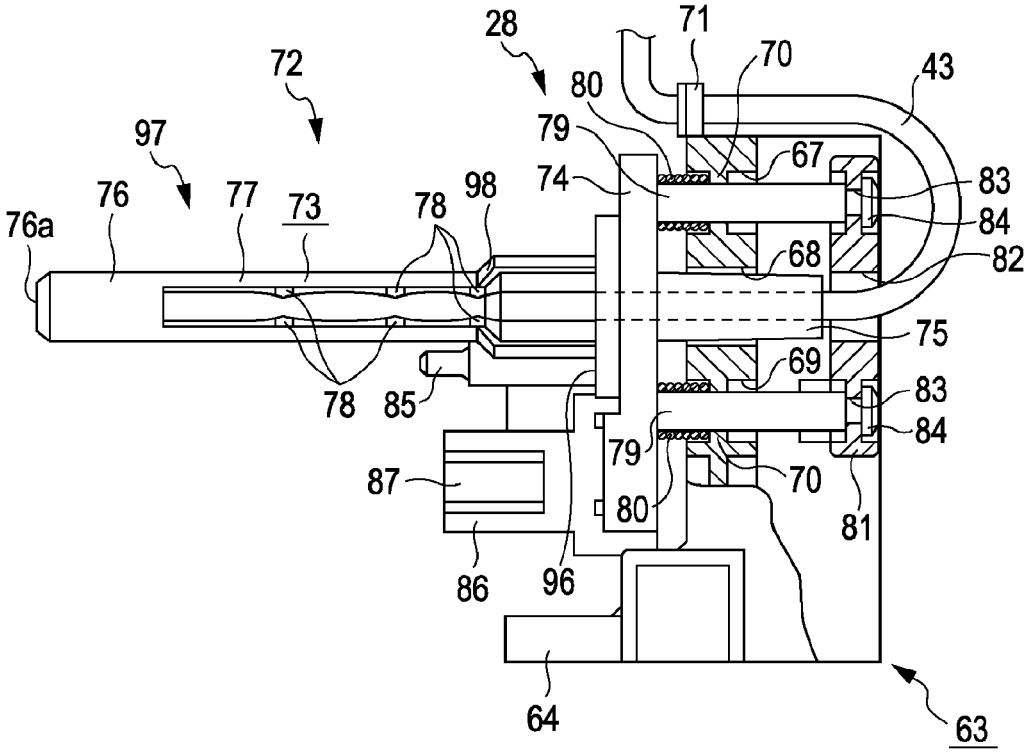

As shown in FIG. 7 and FIGS. 8A and 8B, the tube supporting mechanism 28 includes a base body 63 in which a front end distance between both the right and left walls having a rectangular shape is the same and which having a substantial ⊃-shape in plan view connected to a front wall having a rectangular shape. A horizontal plate 64 having a rectangular plate shape extends frontward from the lower front end of the base body 63. Right and left screw holes 65 are formed in the horizontal plate 64. The base body 63 is fixed to the rear step surface 39 in the bottom wall 32 of the housing 26 by screw-connecting setscrews 66 to the screw holes 65 of the horizontal plate 64, respectively.

As shown in FIG. 7, plural through-holes 67, 68, and 69 (three through-holes in this embodiment) are formed in the front wall of the base body 63 so as to extend in the upper and lower directions. Among the through-holes 67 to 69, the central through-hole 68 has the height to be arranged coaxially with the connection port 57 of the waste ink tank 27 mounted on the mount location 31 of the receiving chamber 30, when the base body 63 is fixed onto the rear step surface 39 of the bottom wall 32 of the housing 26. An inward flanges 70 (see FIGS. 8A and 8B) is formed at an intermediate location in an axial direction of the inner circumferential surface of each of the upper through-hole 67 and the lower through-hole 69. In addition, in the base body 63, a substantially U-shaped tube fixing portion 71 through which the flexible tube 43 is inserted to be supported is formed in the intermediate portion of the upper end of the front wall.

As shown in FIG. 7 and FIGS. 8A and 8B, a support member 72 for supporting the flexible tube 43 in a straight shape is assembled with the front surface of the base body 63. The support member 72 is a resin molded product having rigidity, including a cylindrical body 73 as a main body which can be inserted into and extracted from the connection port 57 of the waste ink tank 27, and having a predetermined length in the front and rear directions. A brim portion 74 having a rectangular plate shape is integrally formed at a location on the slight rear side (base end side) from the intermediate location in an axial direction of the cylindrical body 73. In the support member 72, a base end cylindrical portion (second support member) 75 protruding more rearward than the brim portion 74 of the cylindrical body 73 has an outer diameter smaller than the hole diameter of the intermediate through-hole 68 of the base body 63 and an inner diameter into which the flexible tube 43 can be inserted.

On the other hand, in the support member 72, a circular mounted portion 96 having a diameter slightly larger than the outer diameter of the sealing portion 91 of the waste ink tank 27 bulges from the front surface of the brim portion 74 so as to be arranged coaxially with the cylindrical body 73. A cylinder-shaped portion of the support member 72 protruding more frontward than the circular mounted portion 96 of the brim portion 74 of the cylindrical body 73 is formed as a discharge unit 97 which is inserted to support the downstream end side of the flexible tube 43 inside the connection port 57 in order to discharge the waste ink into the waste ink tank 27, when the waste ink tank 27 is mounted on the mount location 31.

In the discharge unit 97, the base end joined to the circular mounted portion 96 is formed as a fitting cylindrical portion 98 of which an inner diameter and an outer diameter are the same in an inside deep portion of the connection port 57 of the waste ink tank 27. In a portion having a predetermined length and serving as the second support member formed more frontward (on front end side) than the fitting cylindrical portion 98, the outer diameter of the portion is slightly smaller than the width in the right and left directions of the cut-in groove 62 of the third ink absorbing member 45*c* received inside the waste ink tank 27 and the length of the portion is substantially equal to a distance from the rear end edge of the third ink absorbing member 45*c* to a substantial center of the through-hole 61. In the discharge unit 97 of the cylindrical body 73, a portion having a predetermined length on the front end side than the fitting cylindrical portion 98 is formed as a non-cylindrical portion 77 in which the circumferential wall of the relatively long cylindrical shape formed from a front end cylindrical portion 76 to the rear-side fitting cylindrical portion 98 is cut by the about half, excluding the front end cylindrical portion 76 which is relatively short and has a cylindrical shape in order to inward fit with the front end serving as a downstream end of the flexible tube 43. In addition, on the inside surface of the non-cylindrical portion 77, a pair of insertion claws (fixing portions) 78 protrude at each of plural locations (three locations in this embodiment) in an axial direction of the cylindrical body 73 so that a distance with the pair of insertion claws 78 facing each other is slightly smaller than the outer diameter of the flexible tube 43.

In the support member 72, when the base end cylindrical portion 75 in the cylindrical body 73 is loosely inserted into the intermediate through-hole 68 of the base body 63, the portion having the predetermined length on the front end side including the front end (downstream end) in the flexible tube 43 inserted from the base end side opening of the base end cylindrical portion 75 is supported by the front end cylindrical portion 76 and the non-cylindrical portion 77. That is, the front end cylindrical portion 76 in the cylindrical body 73 supports the front end of the flexible tube 43 in the fitting state in that the inner diameter of the front end cylindrical portion 76 is the same as the outer diameter of the flexible tube 43. In addition, the non-cylindrical portion 77 fixes the flexible tube 43 by inserting the flexible tube 43 from the side so that the fixing claws 78 fix the plural locations (three locations in this embodiment) of the portion from the front end to the base end of the flexible tube 43. Accordingly, the portion having the predetermined length on the front end side in the flexible tube 43 is supported by the cylindrical body 73 of the support member 72 so as to extend in a direction in which the front end of the flexible tube 43 is oriented.

When the discharge unit 97 of the cylindrical body 73 in the support member 72 supporting the flexible tube 43 is inserted into the container member 44 from the connection port 57 of the waste ink tank 27, as indicated by two-dot chain line in FIG. 4, the waste ink is discharged into the through-holes 61 formed in the second ink absorbing member 45*b* and the third ink absorbing member 45*c* from a front end opening 76*a* of the front end cylindrical portion 76 of the cylindrical body 73. Accordingly, in this embodiment, the front end opening 76*a* of the front end cylindrical portion 76 in the discharge unit 97 of the support member 72 supporting the flexible tube 43 forms a discharge port for discharging the waste ink.

In this embodiment, as shown in FIG. 4, when the discharge unit 97 of the cylindrical body 73 is inserted into the container member 44 from the connection port 57 of the waste ink tank 27, a distance Y between the front end opening 76*a* and an air communication hole 90 is configured to be longer than a distance X between the front end opening 76*a* as the discharge port of the discharge unit 97 and the connection port 57 in the mounted state. In addition, after the waste ink discharged from the front end opening 76*a* is absorbed by the ink absorbing members 45*a* to 45*d* and the waste ink soaks and spreads in the ink absorbing members 45*a* to 45*d*, an ink solvent gasifies. Then, the ink solvent evaporates from the air communication hole 90 of the film member 46 to the outside.

A pin 85 as a counter member which can be inserted into or extracted from the long hole 58*a* of the cylinder portion 58 of the waste ink tank 27 protrudes toward the front side in the left edge of the front surface of the brim portion 74 of the support member 72. Likewise, a vertical plate portion 86 having a rectangular plate shape protrudes in the left edge of the front surface of the brim portion 74 toward the front side from a location below the pin 85. A connection terminal 87 (device-side connection terminal) corresponding to the connection terminal 59 formed on the sub left wall 50*b* of the waste ink tank 27 is mounted on one surface (right surface) of the vertical plate portion 86. The connection terminal 87 is connected to the control unit (not shown) of the printer 11 with a harness (not shown) interposed therebetween.

On the other hand, a pair of upper and lower cylinders 79 formed so as to be respectively inserted into the upper through-hole 67 and the lower through-hole 69 of the base body 63 bulge in parallel toward the rear side from two upper and lower locations of the base end cylindrical portion 75 in the rear surface of the brim portion 74 of the support member 72. In addition, the upper and lower cylinders 79 are respectively inserted into the upper through-hole 67 and the lower through-hole 69 of the base body 63 in a state where the cylinders 79 are put into coil springs 80 serving as an urging unit against each circumferential surface. In this case, the front ends of the coil springs 80 come in contact with the rear surface of the brim portion 74 of the support member 72. In addition, the rear ends of the coil springs 80 come in contact with the flanges 70 respectively formed at the midway locations of the inner circumferential surfaces of the upper through-hole 67 and the lower through-hole 69, respectively. A screw holes (not shown) is formed on the front end surface of each of the cylinders 79.

As shown in FIG. 7 and FIGS. 8A and 8B, an assemble plate 81 for assembling the support member 72 to the base body 63 is disposed on the rear surface of the base body 63. The assembly plate 81 has a rectangular plate shape coming in contact with the rear surface of the front wall when the assembly plate 81 is disposed between both the right and left walls of the base body 63 having the substantial ⊃-shape in plan view. A through-hole 82 corresponding to the intermediate through-hole 68 of the base body 63 is formed in the substantial center of the assembly plate 81. Screw insertion holes 83 are formed at two locations which correspond to the upper though-hole 67 and the lower through-hole 69 of the base body 63 in upper and lower portions of the through-hole 82 in the assembly plate 81. In addition, the assembly plate 81 is screw-fixed by setscrews 84 inserted through the screw insertion holes 83 into the cylinders 79 of the support member 72 of which the front ends protrude from the upper through-hole 67 and the lower through-hole 69 of the base body 63 toward the rear side.

Next, operations of the waste ink collecting system 29 having the above-described configuration and the printer 11 will be described below.

First, a method of forming a liquid passage when the liquid passage is formed by supporting the flexible tube 43 discharging the waste ink into the waste ink tank 27 by the tube support mechanism 28 in the waste ink collecting system 29 will be described.

Here, when the liquid passage for discharging ink (liquid) ejected as waste ink (waste liquid) from the print head 21 into the waste ink tank 27 is formed, the base body 63 in the tube support mechanism 28 is first fixed onto the rear step surface 39 inside the receiving chamber 30 by the setscrews 66. Then, after the front end (downstream end) of the flexible tube 43, of which the base end (upstream end) is connected to the cap 25, is inserted into the through-hole 82 of the assembly plate 81 from the rear side, the front end of the flexible tube 43 is also inserted into the intermediate through-hole 68 of the base body 63 from the rear side and the front end of the flexible tube 43 is extracted toward to the front side from the intermediate through-hole 68 to some extent.

Subsequently, the front end of the flexible tube 43 extracted toward the front side from the intermediate through-hole 68 of the base body 63 is inserted into the cylindrical body 73 of the support member 72 which is not assembled to the base body 63. That is, the front end of the flexible tube 43 is inserted into the base end cylindrical portion 75 of the cylindrical body 73. Likewise, the front end of the inserted flexible tube 43 is extracted from the non-cylindrical portion 77 of the front end cylindrical portion 76 of the cylindrical body 73 to the outside for the moment.

Then, a portion having a predetermined length on the front end side of the flexible tube 43 is loosened to some extent so as to easily grip the portion having the predetermined length in the outside of the non-cylindrical portion 77. In this state, the front end of the flexible tube 43 is inserted into the front end cylindrical portion 76 of the cylindrical body 73 from the rear side (base end side). At this time, the front end of the flexible tube 43 is locationally matched with the front end of the front end cylindrical portion 76 of the cylindrical body 73 in the front and rear directions. Then, the flexible tube 43 is fitted and supported by the front end cylindrical portion 76 in a stable state.

Subsequently, the base end side of the flexible tube 43 is pulled from the base end cylindrical portion 75 of the cylindrical body 73 in an extraction direction and the loosened portion of the flexible tube 43 formed outside the side of the non-cylindrical portion 77 is removed. The portion having the predetermined length on the front end side of the flexible tube 43 of which the loosened state is removed is pressed sequentially from the front end side against the inner surface of the non-cylindrical portion 77 to be pushed between the insertion claws 78 facing each other. Then, the flexible tube 43 is fixed by the insertion claws 78 to become a stably supported state so that the portion having the predetermined length on the front end side is expanded in a substantial straight shape along the non-cylindrical portion 77.

In this way, the flexible tube 43 is supported by the support member 72. Subsequently, the support member 72 which has supported the flexible tube 43 in the above-described manner is assembled to the base body 63. That is, the base end cylindrical portion 75 of the cylindrical body 73 is loosely inserted into the intermediate through-hole 68 of the base body 63 inserted into the base end side of the flexible tube 43. In addition, the cylinders 79 protruding from the brim portion 74 of the support member 72 toward the rear side are inserted into the upper through-hole 67 and the lower-through-hole 69 of the base body 63, respectively. At this time, the coil spring 80 is inserted in advance into each of the cylinders 79.

Then, the coil springs 80 through which the cylinders 79 are respectively inserted are respectively interposed between the rear surface of the brim portion 74 and the flanges 70 of the upper through-hole 67 and the lower through-hole 69 to be slightly contracted. In addition, the front ends of the cylinders 79 protrude from the through-holes 67 and 69 toward the rear side, respectively. The assembly plate 81 is brought into contact with the front ends of the cylinders 79 of which the heads respectively protrude from the through-holes 67 and 69, while locationally matched to the screw insertion holes 83. Then, the assembly plate 81 is screw-fixed by the setscrews 84. Subsequently, the midway portion on the base end side of the flexible tube 43 extracted from the through-hole 82 of the assembly plate 81 toward the rear side is fixed by the tube fixing portion 71 formed in the upper portion of the base body 63.

In this way, the flexible tube 43 is supported by the tube support mechanism 28. As shown in FIGS. 2 and 8A, the tube support mechanism 28 is installed below the cap 25 in the home position HP, while supporting the flexible tube 43 in a state where the flexible tube 43 is oriented toward the front side in which the mount location 31 of the waste ink tank 27 is positioned. In this installation state, in order for the coil springs 80 through which the cylinders 79 of the support member 72 are inserted to maintain the slightly contracted state and press the brim portion 74 toward the front side by the contracted press force, the support member 72 is movably maintained in the front and rear directions in a state where the cylindrical body 73 is oriented toward the front side.

The support member 72 of the tube support mechanism 28 is in an urged state toward the front side by an urging force of the coil springs 80, since the coil springs 80 respectively inserted through the cylinders 79 are respectively inserted are in the slightly contracted state. Accordingly, when a press force is further applied to the brim portion 74 of the support member 72 from the front side to the rear side, the brim portion 74 receives the press force and is retreated toward the rear side. Therefore, as shown in FIG. 8B, the support member 72 is retreated toward the rear side in the state where the support member 72 supports the assembly plate 81 and the flexible tube 43, while further contracting the coil springs 80.

In the support member 72 of the tube support mechanism 28, the base end cylindrical portion 75 of cylindrical body 73 and the cylinders 79 protruding from the brim portion 74 toward the rear side are loosely inserted into the through-holes 67, 68, and 69 of the base body 63, respectively, so that a clearance is present in a diametric direction. Accordingly, when an external force is applied to the cylindrical body 73 (particularly, the front end cylindrical portion 76) of the support member 72 from a direction intersecting the axial direction of the cylindrical body 73, the support member 72 receiving the external force is pivoted on a point on the base end side (specifically, a point coming in contact with the flange 70 in the cylinder 79).

Figure 9A:
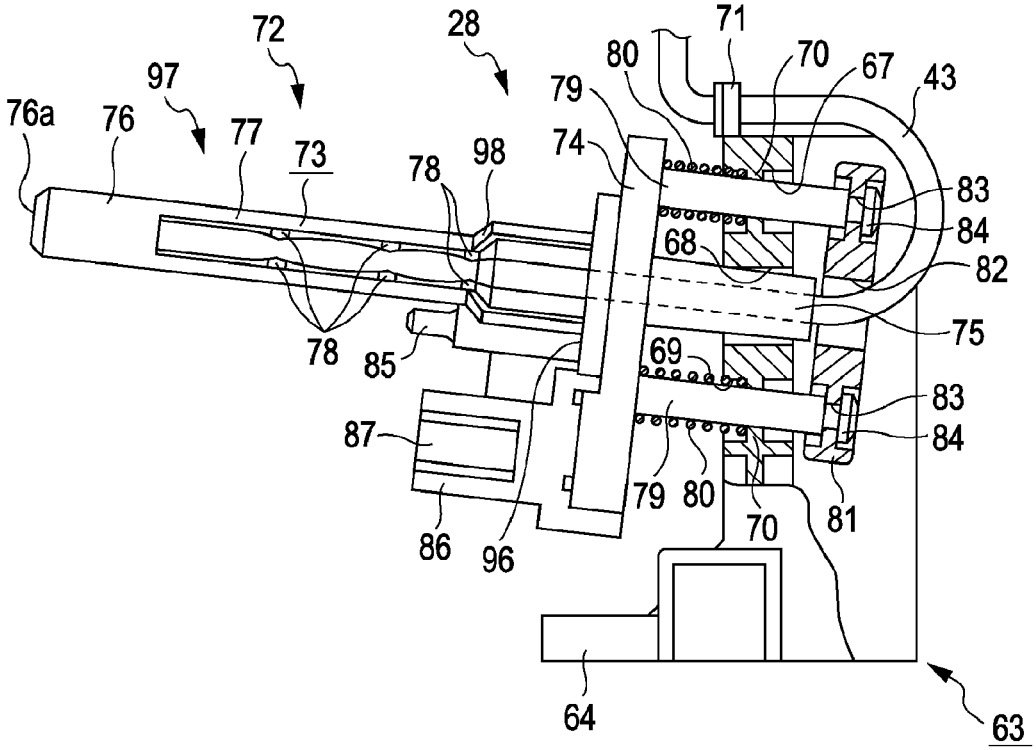
FIG. 9A is a partially-exploded front view illustrating the tube supporting mechanism pivoted upward and FIG. 9B is a partially-exploded front view illustrating the support member pivoted downward.
Figure 9B:
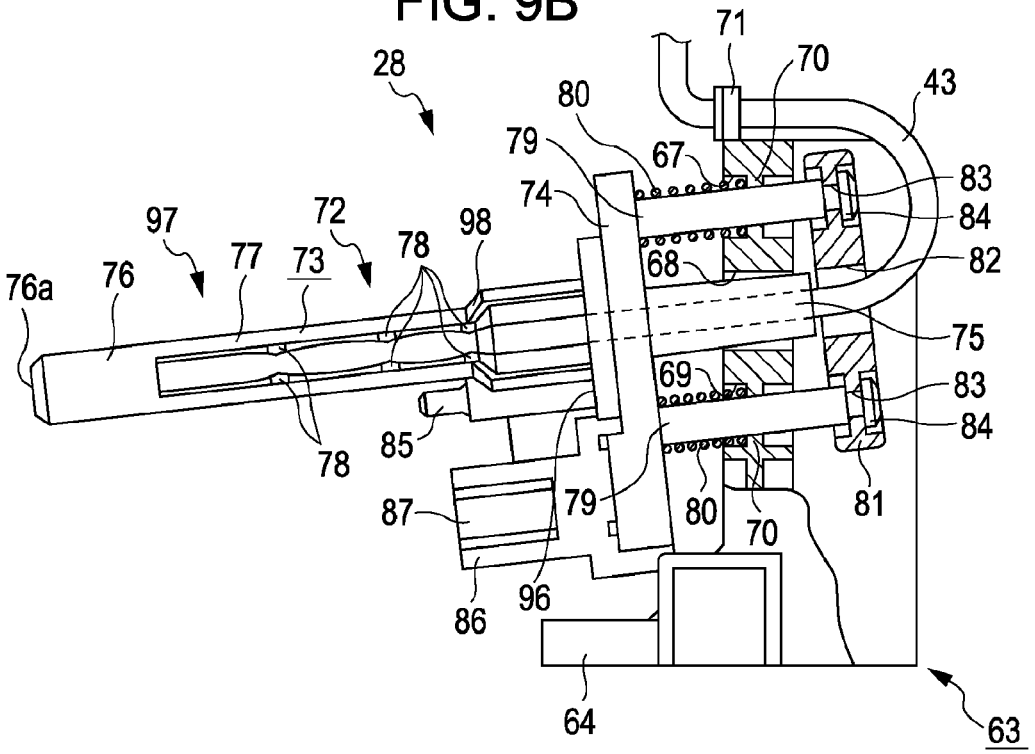

That is, when the external force oriented from the downward side to the upward side is applied to the front end cylindrical portion 76 of the cylindrical body 73, the support member 72 is pivoted so that the front end cylindrical portion 76 of the cylindrical body 73 is moved upward, as shown in FIG. 9A. On the other hand, when the external force oriented from the upward side to the downward side is applied to the front end cylindrical portion 76 of the cylindrical body 73, the support member 72 is pivoted so that the front end cylindrical portion 76 of the cylindrical body 73 is moved downward, as shown in FIG. 9B. Even though not shown, when the external force is applied to the front end cylindrical portion 76 of the cylindrical body 73 from the right and left directions, the support member 72 is pivoted so that the front end cylindrical portion 76 of the cylindrical body 73 is moved in the right and left directions. In this way, the support member 72 supporting the flexible tube 43 in the tube support mechanism 28 has a configuration in which the front end is pivotable on the point on the base end side.

Next, a method of mounting or detaching the waste ink tank 27 on or from the mount location 31 formed inside the receiving chamber 30 of the housing 26 of the printer 11 will be described.

When the waste ink tank 27 is mounted on the mount location 31 inside the receiving chamber 30, the opening door 36 on the front side of the housing 26 is first opened. Subsequently, the waste ink tank 27 is inserted into the opened mounting/detaching port 34 from the rear end side on which the connection port 57 is formed, and then the waste ink tank 27 is moved toward the rear side which is the mount direction in which the waste ink tank 27 is mounted on the mount location 31. As shown in FIG. 10, in the waste ink tank 27, the front end cylindrical portion 76 of the cylindrical body 73 of the support member 72 in the tube support mechanism 28 is inserted into the connection port 57 of the main rear wall 49*a* in a previous step in which the entire waste ink tank 27 is inserted inside the receiving chamber 30.

Here, when the waste ink tank 27 is moved up to the inside deep portion of the receiving chamber 30 through the mounting/detaching port 34, the gripping portion 94 in the front end of the waste ink tank 27 is gripped by the user of the printer 11 and the waste ink tank 27 is moved in the mount direction manually by the user. Accordingly, when the gripping portion 94 in the front end of the waste ink tank 27 is gripped by the user, the container member 44 rarely maintains a horizontal state in its posture in the previous step in which the entire waste ink tank 27 is inserted inside the receiving chamber 30. Instead, as shown in FIG. 10, the container member 44 is normally slanted in its posture so that the rear end of the waste ink tank 27 is lower than the front end. Accordingly, in a case where the cylindrical body 73 of the support member 72 of the tube support mechanism 28 is fixed in a horizontally oriented state, it is difficult to insert the front end cylindrical portion 76 of the cylindrical body 73 up to the inside deep portion of the connection port 57 of the waste ink tank 27 moved in the mount direction in the slanted state.

However, the tube support mechanism 28 according to this embodiment has the configuration in which the front end of the support member 72 is pivotable on the point on the base end side. With such a configuration, when the front end cylindrical portion 76 of the cylindrical body 73 is inserted into the connection port 57 of the waste ink tank 27 moved in the state where the waste ink tank 27 is slanted in its posture, the front end of the support member 72 of the tube support mechanism 28 is pivoted so as to correspond to the slant. Accordingly, the front end cylindrical portion 76 of the cylindrical body 73 in the support member 72 is inserted up to the inside deep portion of the connection port 57 of the waste ink tank 27 without any problem.

The support member 72 of the tube support mechanism 28 may be locationally deviated from the center 57*a* of the connection port 57, when the front end cylindrical portion 76 of the cylindrical body 73 is inserted into the connection port 57 of the waste ink tank 27. In this embodiment, however, the inner circumferential surface of the connection port 57 in the waste ink tank 27 is configured as the tapered surface which the diameter is smaller as getting deeper to the inside portion of the connection port 57. Therefore, the cylindrical body 73 of the support member 72 is slidably guided toward the center 57*a* of the connection port 57, when the cylindrical body 73 is inserted into the connection port 57. In consequence, in the cylindrical body 73 of the support member 72, the front end cylindrical portion 76 is smoothly inserted into the cut-in groove 62 of the third absorbing member 45*c* disposed so as to correspond to the location of the connection port 57 in the waste ink tank 27.

In the cut-in groove 62, the tapered portion 95 of which the width is narrower toward the front end is formed on the rear end which is the connection port 57 and the groove width of a portion in the front end of the tapered portion 95 is slightly larger than the outer diameter of the discharge unit 97. The thickness of the third ink absorbing member 45*c* provided with the cut-in groove 62 is slightly larger than the outer diameter of the discharge unit 97. Accordingly, in the discharge unit 97, when the front end cylindrical portion 76 is inserted into the cut-in groove 62, the front end cylindrical portion 76 is slidably guided by the right and left inner groove surfaces of the cut-in groove 62 including the tapered portion 95 in the third ink absorbing member 45*c* and by the lower surface of the fourth ink absorbing member 45*d* and the upper surface of the second ink absorbing member 45*b* blocking the cut-in groove 62 from both the upper and lower sides so that the insertion direction becomes a direction (predetermined direction) oriented toward the through-hole 61.

When the waste ink tank 27 is further moved toward the inside deep portion of the receiving chamber 30 in the state shown in FIG. 10, the rear wall 49 (specifically, the end surface of the sealing portion 91) of the waste ink tank 27 comes in contact with the brim portion 74 (specifically, the circular mounted portion 96) of the support member 72. In addition, the front end cylindrical portion 76 of the cylindrical body 73 of the support member 72 reaches the location of the through-hole 61 formed in the third ink absorbing member 45*c*. In this case, when the sealing portion 91 of the rear wall 49 of the waste ink tank 27 comes in contact with the circular mounted portion 96 of the brim portion 74 of the support member 72, the connection portion 57 is closed and sealed by the circular mounted portion 96. Accordingly, the circular mounted portion 96 serves as a closing unit which closes the connection port 57 as the opening, when the sealing portion 91 comes in contact with the circular mounted portion 96. In addition, since the sealing portion 91 has the ring shape surrounding the connection port 57, a sealing function thereof is easily ensured by bringing the end surface formed as the flat and smooth surface into contact with the facing surface of the flat and smooth surface as in the circular mounted portion 96.

Likewise, when the sealing portion 91 of the rear wall 49 of the waste ink tank 27 comes in contact with the circular mounted portion 96 of the brim portion 74 of the support member 72, the pin 85 protruding from the brim portion 74 of the support member 72 is inserted into the hole 58*a* of the cylinder portion 58 formed on the sub rear wall 49*b* of the waste ink tank 27, and thus the waste ink tank 27 mounted on the mount location 31 is positioned in the upper and lower directions, the right and left directions, and a rotation direction. In this case, the pin 85 and the long hole (positioning unit) 58*a* serve as a maintaining unit which maintains the positioning state so that the movement of the waste ink tank 27 is regulated in the upper and lower directions, the right and left directions, and the rotation direction in the mount location 31.

In particular, When the waste ink tank 27 is mounted on the printer 11, the waste ink tank 27 may be moved toward the mount location 31 of the printer 11 with rotation about the axis of the discharge unit 97 of the cylindrical body 73 inserted into the connection port 57 to be mounted in some cases. Therefore, the connection terminal 59 of the waste ink tank 27 may be locationally deviated from the connection terminal 87 of the printer 11 in the rotation direction in the connection state. In addition, as in a comparative example in FIG. 6B, when the contact surface 59*a* of the connection terminal 59 of the waste ink tank 27 is formed perpendicularly to a straight line L extending in a radial direction from the center 57*a* of the connection port 57, the contact surfaces of the connection terminals 59 and 87 may be deviated from each other in the rotation direction at the time of rotating the waste ink tank 27, thereby impairing the contact surfaces and causing connection failure.

In order to solve this problem, as shown in FIG. 6A, the contact surface 59*a* of the connection terminal 59 of the waste ink tank 27 according to this embodiment is formed perpendicularly to the straight line L extending toward the radial direction from the center 57*a* of the connection port 57. Therefore, the contact surfaces of both the connection terminals 59 and 87 are not deviated from each other in the rotation direction in the connection, when the waste ink tank 27 is rotated. That is, in FIG. 6A, when the waste ink tank 27 is rotated clockwise, the connection terminal 59 of the waste ink tank 27 is moved so that the contact surface 59*a* becomes away from the connection terminal 87 of the printer 11. On the contrary, in FIG. 6A, when the waste ink tank 27 is rotated counterclockwise, the connection terminal 59 of the waste ink tank 27 is moved in a direction in which the contact surface 59*a* is pressed against the connection terminal 87 of the printer 11.

In this case, the long hole 58*a* as the positioning unit serves as a contact portion for regulating the rotation of the waste ink tank 27 by bringing an inner circumferential surface 99 into contact with the pin 85. That is, the long hole 58*a* regulates the counterclockwise rotation by which the connection terminal 59 of the waste ink tank 27 is spaced from the connection terminal 87 of the printer 11, by bringing the upper inner surface of the inner circumferential surface 99 into contact with the pin 85. On the other hand, the long hole 58*a* regulates the clockwise rotation of the waste ink tank 27, by bringing the lower inner surface of the inner circumferential surface 99 into contact with the pin 85.

With such a configuration, even when the waste ink tank 27 is moved and mounted on the mount location 31 of the printer 11 with the rotation about the axis of the discharge unit 97 of the cylindrical body 73 inserted into the connection port 57, the contact surface 59*a* of the connection terminal 59 is not deviated from the connection terminal 87 of the printer 11 in the rotation direction in the connection. When the pin 85 is inserted into the long hole 58*a*, the upper and lower inner surfaces of the inner circumferential surface 99 of the long hole 58*a* come into contact with the pin 85, and thus the rotation stops. Therefore, the location is determined at the rotation location at which the contact surfaces of both the connection terminals 59 and 87 appropriately come in contact with each other.

Figure 11:
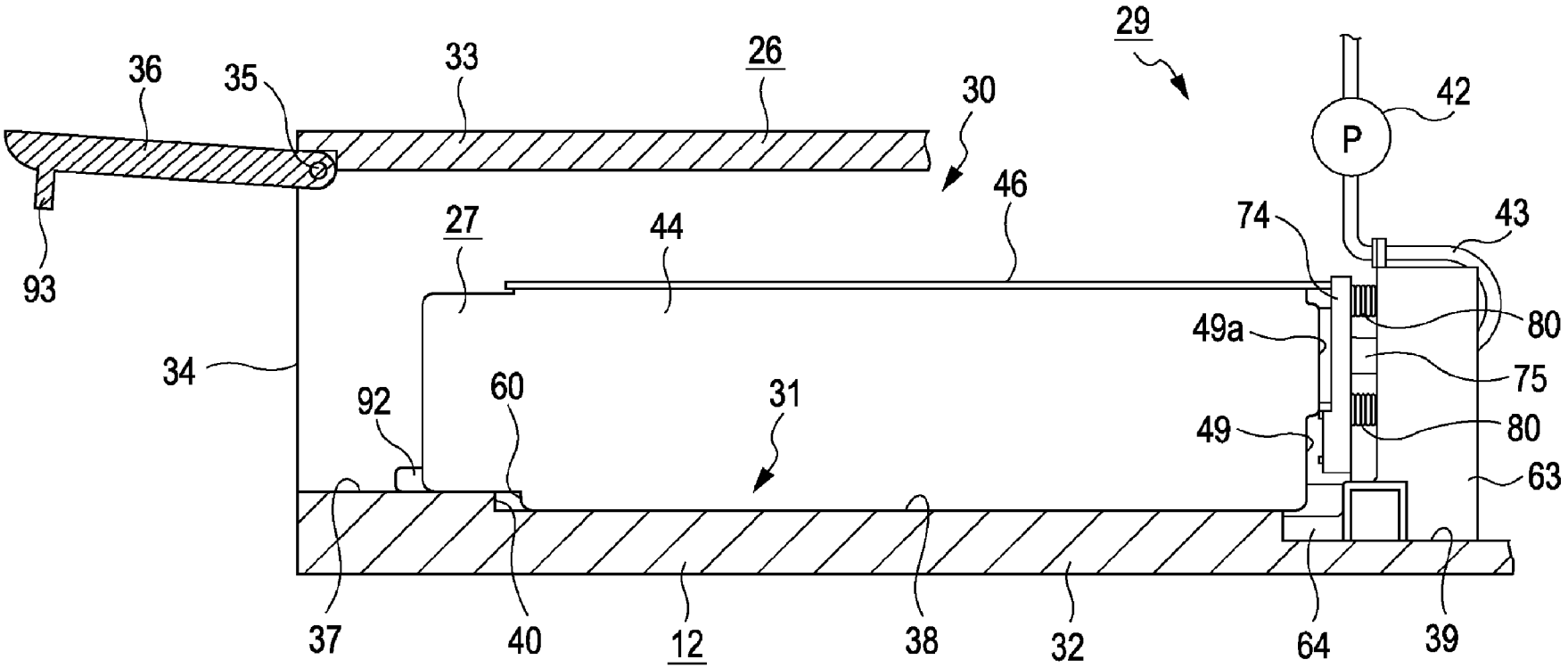
FIG. 11 is a partially-omitted sectional view illustrating the inside of the receiving chamber when the waste ink tank is mounted likewise.

When the waste ink tank 27 is further pushed toward the rear side to press the brim portion 74 of the support member 72 in this state, the support member 72 is retreated while further contracting the coil springs 80. When the support member 72 is retreated up to a location where the brim portion 74 is closest to the front wall of the base body 63, as shown in FIG. 11, the waste ink tank 27 is horizontally maintained in its posture and the bottom surface of the container member 44 of the waste ink tank 27 is brought into contact with the intermediate step surface 38 forming a part of the mount location 31 in the receiving chamber 30. At this time, the locked step 60 formed on the bottom surface of the container member 44 of the waste ink tank 27 is located in an inside deeper portion of the receiving chamber 30 than the locking step 40 formed in the mount location 31 inside the receiving chamber 30. In other words, the waste ink tank 27 is outside the mount location 31 inside the receiving chamber 30 in the mount direction at this time. That is, the locked step 60 of the waste ink tank 27 does not engage with the locking step 40 of the printer 11 at the time of moving the waste ink tank 27 the mount direction.

When a force (for example, a force of the fingers of a user) applied to move the waste ink tank 27 in the mount direction is released in the state shown in FIG. 11, the waste ink tank 27 is pressed in the front direction (that is, the detachment direction of the waste ink tank 27) by the brim portion 74. That is because the brim portion 74 of the support member 72 is advanced by the urging force of the contracted coil springs 80. That is, the brim portion 74 of the support member 72 serves as a pressing unit using the urging force of the coil springs 80 as a pressing force and the rear wall 49 of the container member 44 serves as a pressed unit. The brim portion 74 presses the waste ink tank 27. In addition, the waste ink tank 27 receiving this pressing force is slidably moved on the intermediate step 38 of the mount location 31 toward the front side. As shown in FIG. 2, the locked step 60 of the container member 44 locks with the locking step 40 of the mount location 31. That is, The locking step 40 which cannot lock with the locked step 60 at the time of moving the waste ink tank 27 to the locked step 60 of the container member 44 in the mount direction reverse to the detachment direction serves as a locking unit which performs the locking to regulate the movement of the waste ink tank 27 in the detachment direction from the detachment direction at the time of slidably moving the waste ink tank 27 in the detachment direction.

Accordingly, the waste ink tank 27 receives the urging force of the coil springs 80 from the rear side through the brim portion 74 of the support member 72 and the locking step 40 of the mount location 31 locks with the locked step 60 of the bottom surface of the container member 44 from the front side. Accordingly, as shown in FIG. 2, the waste ink tank 27 is positioned at the mount location 31 inside the receiving chamber 30 so as not to be moved in the front and rear direction. With such a configuration, the coil springs 80 as the urging unit and the locking step 40 as the locking unit serve as a maintaining unit which maintains the waste ink tank 27 so as to be positioned at the mount location 31. When the opening door 36 of the mounting/detaching port 34 is returned to the closing location, the mounting of the waste ink tank 27 on the mount location 31 ends.

Since the opening door 36 of the mounting/detaching port 34 is positioned at the closing location in the mount state shown in FIG. 2, the protrusion 93 on the rear surface of the opening door 36 is in a location regulation state close to the convex portion 92 of the front end of the waste ink tank 27. Accordingly, even though the waste ink tank 27 is displaced upward with application of an impact from the outside in a case of carrying the printer 11, the protrusion 93 of the opening door 36 comes in contact with the convex portion 92 of the waste ink tank 27 and thus regulates the upward displacement. Accordingly, the locked step 60 of the waste ink tank 27 does not disengage from the locking step 40 formed at the mount location 31 of the printer 11.

When the cap 25 moves up by drive of the elevation mechanism (not shown) and comes in contact with the nozzle formation surface 21*a* of the print head 21 in the state shown in FIG. 2 and then the sucking pump 42 is driven, the thickened ink in the print head 21 due to negative pressure generated in the cap 25 is forcedly discharged (ejected) as the waste ink into the cap 25 through nozzle openings (not shown). When the inside of the cap 25 becomes an air sucking state where air is sucked by air opening in a state where the sucking pump 42 continues to be driven, the waste ink is guided from the inside of the cap 25 to the downstream end which is the front end of the flexible tube 43 to be discharged into the waste ink tank 27.

In this case, the front end opening 76*a* of the discharge unit 97 extends from the connection port 57 of the waste ink tank 27 to the through-hole 61 of the third ink absorbing member 45*c*. The through-hole 61 of the second ink absorbing member 45*b* is disposed below the through-hole 61 of the third ink absorbing member 45*c*. The fourth ink absorbing member 45*d* and the first ink absorbing member 45*a* are disposed so as to block the upper and lower portions of the two through-holes 61, respectively. In addition, much waste ink discharged into the through-holes 61 is absorbed gradually into the inside from the upper surface of the first ink absorbing member 45*a* located below the through-hole 61 and soaks into the entire first ink absorbing member 45*a*. The waste ink further soaks into the other ink absorbing members 45*b* to 45*d* and spreads inside the ink absorbing members 45*a* to 45*d* to be satisfactorily absorbed and maintained. Some of waste ink is absorbed into the inside of the ink absorbing members 45*a* to 45*d* from the side surface or the upper surface of the through-holes 61.

Accordingly, in the ink absorbing members 45*a* to 45*d*, a location near the through-holes 61 to which the waste ink is discharged from the front end opening 76*a* of the discharge unit 97 is a location where the waste ink is absorbed most. On the other hand, in the ink absorbing members 45*a* to 45*d*, the fourth ink absorbing member 45*d* into which the waste ink is discharged from the front end opening 76*a* of the discharge unit 97 soaks least is a location where an amount of absorbed ink is the least. In general, the waste ink absorbed by the ink absorbing members 45*a* to 45*d* has a property in which the waste ink is easy to be soaked and spread from the location where the amount of absorbed amount is much to the location where the amount of absorbed amount is less.

The air communication hole 90 formed in the film member 46 sealing the upper opening 48 of the container member 44 in the waste ink tank 27 according to this embodiment is configured to be located on the front end side than the center portion of the container member 44. That is, as shown in FIG. 4, the distance Y between the front end opening 76*a* and the air communication hole 90 is configured to be longer than the distance X between the front end opening (discharge port) 76*a* of the discharge unit 97 discharging the waste ink and the connection port 57. The air communication hole 90 is located above the upper surface of the fourth ink absorbing member 45*d* located uppermost among the ink absorbing members 45*a* to 45*d*. Accordingly, after the waste ink soaks up to a location which gets away from the front end opening 76*a* in the front and rear direction and soaks up to the uppermost absorbing member 45*d* in the upper and lower directions, that is, the waste ink spreads to the whole of the ink absorbing members 45*a* to 45*d*, the waste ink evaporates from the upper surface of the uppermost ink absorbing member 45*d*.

Accordingly, since the waste ink evaporates from the ink absorbing members 45*a* to 45*d* during the soaking, the waste ink can soak into the broad range without clogging the ink absorbing members 45*a* to 45*d*. Therefore, it is possible to discharge more amount of waste ink. Gasification of the ink solvent of the waste ink is accelerated from the spread area extending the broad range, thereby accelerating dryness of the ink absorbing members 45*a* to 45*d*. In addition, since the location of the front end opening 76*a* is a location where the waste ink is discharged, the distance X may be set as a distance between the through-hole 61 as a waste liquid receiver for receiving the waste ink and the connection port 57 or the distance Y may be set as a distance between the through-hole 61 and the air communication hole 90.

On the other hand, as shown in FIG. 2, the waste ink tank 27 mounted on the mount location 31 inside the receiving chamber 30 is detached from the printer 11, the opening door 36 of the mounting/detaching port 34 is opened again. Then, the protrusion 93 on the rear surface of the opening door 36 becomes a location non-regulation state where the protrusion 93 gets away from the regulation location where the waste ink tank 27 is close to the convex portion 92 and permits the upward displacement of the waste ink tank 27. When the user of the printer 11 puts hands inside the mounting/detaching port 34, grips the gripping portion 94 on the front end of the waste ink tank 27, raises the front end of the waste ink tank 27 upward to slant the waste ink tank 27 in its posture, the locking state of the locking step 40 and the locked step 60 is released. In this state, since the urging force of the coil springs 80 becomes the pressing force through the brim portion 74 of the support member 72 in the waste ink tank 27 and is applied in the detachment direction (front side), the urging force (pressing force) helps movement in the detachment direction. Accordingly, the waste ink tank 27 is easily detached from the mounting/detaching port 34.

In this case, when the discharge unit 97 of the cylindrical body 73 in the support member 72 is extracted from the connection port 57 of the waste ink tank 27, the right and left inner groove surfaces of the cut-in groove 62 of the third ink absorbing member 45*c* and the lower surface of the fourth ink absorbing member 45*d* and the upper surface of the second ink absorbing member 45*b* blocking the cut-in groove 62 from both the upper and lower sides function as a contact unit, and contact with the cylindrical portion located on the front end side than the fitting cylindrical portion 98 in the discharge unit 97 to remove the waste ink. In particular, when the waste ink tank 27 in a state where the absorption capability of the ink absorbing members 45*a* to 45*d* reaches the limit is detached, the ink absorbing members 45*a* to 45*d* are swollen by the absorbed waste ink. Accordingly, in the swollen third ink absorbing member 45*c*, the right and left groove widths of the cut-in groove 62 are narrowed. In the swollen fourth ink absorbing member 45*d* and second ink absorbing member 45*b*, a distance (that is, a groove height) of the lower surface and the upper surface facing each other to block the cut-in groove 62 of the third ink absorbing member 45*c* from both the upper and lower sides is narrowed. Accordingly, since a contact pressure of the right and left inner groove surfaces of the cut-in groove 62 of the third ink absorbing member 45*c*, the lower surface of the fourth ink absorbing member 45*d*, and the upper surface of the second ink absorbing member 45*b* against the discharge unit 97 becomes more strong, the waste ink attached to the discharge unit 97 is surely removed.

On the other hand, when the waste ink tank 27 in which the amount of absorbed waste ink of the ink absorbing members 45*a* to 45*d* is small is detached, the above absorbing members are not swollen. Therefore, the contact pressure of the right and left inner groove surfaces of the cut-in groove 62, the lower surface of the fourth ink absorbing member 45*d*, and the upper surface of the second ink absorbing member 45*b* against the discharge unit 97 is weak. In this case, since the absorption capability of the ink absorbing members 45*a* to 45*d* is still high, the waste ink attached to the discharge unit 97 is easily absorbed into the ink absorbing members 45*a* to 45*d* even with weak contact pressure through the right and left inner groove surfaces of the cut-in groove 62, the lower surface of the fourth ink absorbing member 45*d*, and the upper surface of the second ink absorbing member 45*b*. Accordingly, in the cylindrical portion of the front end than in the fitting cylindrical portion 98 of the discharge unit 97, the attached waste ink is removed by the right and left inner groove surfaces of the cut-in groove 62 of the third ink absorbing member 45*c*, the lower surface of the fourth ink absorbing member 45*d*, and the upper surface of the second ink absorbing member 45*b*, when the discharge unit 97 is extracted from the connection port 57 of the waste ink tank 27. Therefore, the third ink absorbing member 45*c* provided with the cut-in groove 62 functions as a removing unit and the fourth ink absorbing member 45*d* and the second ink absorbing member 45*b* blocking the cut-in groove 62 of the third ink absorbing member 45*c* from the upper and lower sides also function as the removing unit.

After the old waste ink tank 27 is detached, a new waste ink tank 27 is mounted on the mount location 31 inside the receiving chamber 30 in the same manner described above. In this way, since the waste ink tank 27 can be mounted on and detached from the predetermined mount location 31, the old waste ink tank 27 is easily exchanged with the new waste ink tank 27. A main constituent element of the liquid passage guiding the waste ink up to the waste ink tank 27 is the flexible tube 43 having an excellent non-permeable property of a gasified liquid but no rigidity property. However, since the flexible tube 43 is supported in the straight line by the cylindrical body 73 of the support member 72 having a rigidity property and inserted into the connection port 57 of the waste ink tank 27 together with the discharge unit 97 of the cylindrical body 73, the flexible tube 43 can be surely inserted up to the location (the location of the through-holes 61) close to the center of the waste ink tank 27 in which the ink absorbing members 45*a* to 45*d* are received in the laminated manner.

According to this embodiment, advantages described below can be obtained.

(1) In the waste ink tank 27, the discharge unit 97 of the cylindrical body 73 of the support member 72 supporting the portion having the predetermined length on the downstream end side of the flexible tube 43 is inserted into and extracted from the connection port 57 and the connection port 57 is connected to or disconnected from the downstream end of the flexible tube 43 supported by the support member 72, by moving the container member 44 toward the rear side which is the mount direction in which the waste ink tank 27 is mounted on the mount location 31 inside the receiving chamber 30 or the front side which is the detachment direction. With such a configuration, the old waste ink tank 27 can easily be exchanged with the new waste ink tank 27.

(2) When the waste ink tank 27 is mounted on the mount location 31 of the printer 11 and rotated about the axis of the discharge unit 97 while the discharge unit 97 is inserted into the connection port 57 of the waste ink tank 27, the contact surface 59*a* of the connection terminal 59 of the waste ink tank 27 is moved to be close to or away from the connection terminal 87 of the printer 11 in the rotation direction. That is, the contact surfaces of both the connection terminals 59 and 87 are deviated from each other, when the waste ink tank 27 is rotated in the rotation direction in the connection. In addition, when the contact surface 59*a* of the connection terminal 59 is brought into pressing contact with the connection terminal 87 of the printer 11 during the rotation of the waste ink tank 27, it is possible to ensure the connection state where both the connection terminals 59 and 87 are appropriately brought into contact with each other.

(3) The connection terminal 59 of the waste ink tank 27 is provided in the lower portion in which the rigidity is relatively high in the container member 44 which the box-like shape having the bottom portion. Therefore, even when a stress is applied to the container member 44, a problem with the displacement of the connection terminal 59 can be reduced. As a result, it is possible to satisfactorily maintain the appropriate connection state where the connection terminal 59 is connected to the connection terminal 87 of the printer 11.

(4) Since the connection port 57 into which the discharge unit 97 is inserted is located above the connection terminal 59 in the container member 44, the waste ink can be stored up to the height location of the connection port 57. Accordingly, it is possible to improve a storage efficiency of the waste ink in the container member 44.

(5) The connection terminal 59 of the waste ink tank 27 is not located immediately below the connection port 57. Therefore, even when the stored waste ink leaks from the connection port 57 to the inside in the mount state of the printer 11 on the mount location 31, it is possible to prevent the connection terminal 59 from being smeared due to the leaked waste ink.

(6) When the waste ink tank 27 is rotated in the state where the discharge unit 97 is inserted into the connection port 57 at the time of mounting the waste ink tank 27 on the printer 11 and the contact surface 59*a* of the connection terminal 59 comes in contact with the connection terminal 87 of the printer 11, the further rotation of the waste ink tank 27 is regulated by the connection terminal 87 of the printer 11 which serves as a stopper. In addition, when the waste ink tank 27 is moved toward the inside in the mount direction while maintaining the contact state of both the connection terminals 59 and 87, the discharge unit 97 is inserted into the connection port of the waste ink tank 27. In addition, the contact surfaces 57 of both the connection terminals 59 and 87 appropriately come in contact with each other. Accordingly, it is possible to simply and appropriately mount the waste ink tank 27 on the printer 11.

(7) When the waste ink tank 27 is mounted on the mount location 31 of the printer 11 and the waste ink tank 27 is rotated about the axis of the discharge unit 97 while the discharge unit 97 is inserted into the connection port 57, the rotation can be regulated by a simple operation of inserting the pin 85 as the counter member into the long hole 58*a* as the positioning unit. That is, by adjusting the posture of the waste ink tank 27 to insert the pin 85 as the counter member into the long hole 58*a*, it is possible to position and mount the waste ink tank 27 on the mount location 31 in the connection state where the contact surface 59*a* of the connection terminal 59 appropriately comes in contact with the connection terminal 87 of the printer 11.

(8) In this case, since the connection terminal 59 of the waste ink tank 27 regulates the rotation in the direction getting away from the connection terminal 87 of the printer 11 by bringing the upper inner surface of the inner circumferential surface 99 of the long hole 58*a* into contact with the pin 85. Accordingly, it is possible to prevent the waste ink tank 27 from being rotated in a direction in which a failure in contact between both the connection terminals 59 and 87 is caused.

(9) In this case, the inner circumferential surface 99 of the long hole 58*a* into which the pin 85 is inserted is provided in the insertion and extraction directions of the discharge unit 97 into and from the connection port 57 of the waste ink tank 27. With such a configuration, when the waste ink tank 27 is moved toward the inside in the mount direction while inserting the discharge unit 97 into the connection port 57, the contact state where the inner circumferential surface 99 of the long hole 58*a* comes in contact with the pin 85 is maintained. Moreover, the contact state where the connection terminal 59 of the waste ink tank 27 comes in contact with the connection terminal 87 of the printer 11 is maintained. The contact state of both the connection terminals 59 and 87 at the time of mounting the waste ink tank 27 can be appropriately ensured.

(10) In the waste ink tank 27, the contactable state where the connection terminal 59 of the waste ink tank 27 can come in contact with the connection terminal 87 of the printer 11 is maintained, while regulating the movement from the center 57*a* of the connection port 57 in the radial direction, by first bringing the discharge unit 97 into the connection port 57 at the time of mounting the waste ink tank 27 on the printer 11. In this state, next, on the basis of the positioning function of the long hole 58*a* as the positioning unit, the waste ink tank 27 is positioned so that the contact surfaces of both the connection terminals 59 and 87 are in the appropriate contact state. Accordingly, when the waste ink tank 27 is mounted on the mount location 31 of the printer 11, it is possible to ensure the appropriate connection state where both the connection terminals 59 and 87 come in contact with each other.

(11) Since the urging force (pressing force) of the coil springs 80 is applied to the rear wall (pressed portion) 49 of the waste ink tank 27 in the detachment direction at the mount location 31 inside the receiving chamber 30, the waste ink tank 27 is intended to be moved in the detachment direction by the urging force. In this case, however, since the movement in the detachment direction is regulated thanks to the engagement of the locking step 40, which is provided at the mount location 31, with the locked step 60, which is provided on the bottom surface of the waste ink tank 27, the positioning state of the waste ink tank 27 at the mount location 31 is maintained. Accordingly, it is possible to ensure the stable mount state at the mount location 31.

(12) When the waste ink tank 27 is moved in the mount direction which is a direction reverse to the detachment direction, the locked step 60 on the bottom surface does not engage with the locking step 40 provided at the mount location 31. Accordingly, when the waste ink tank 27 is mounted on the printer 11, the waste ink tank 27 can be easily mounted without association with the presence of the locking step 40.

(13) When the waste ink tank 27 is displaced in its posture in the direction in which the locked step 60 disengages from the locking step 40 in order to detach the waste ink tank 27 from the mount location 31, it is possible to easily detach the waste ink tank 27 by use of the urging force of the coil springs 80 applied to the rear wall 49.

(14) When the gripping portion 94 is gripped by the user and raised in the upper direction intersecting the detachment direction in order to detach the waste ink tank 27 from the mount location 31, the position of the waste ink tank 27 is displaced. At this time, since the engagement of the locked step 60 with the locking step 40 at the mount location 31 is simply released, it is possible to easily detach the waste ink tank 27 from the printer 11.

(15) On the other hand, when the waste ink tank 27 is displaced in its posture in the direction in which the locked step 60 disengages from the locking step 40 due to inclination of the printer 11 in the state where the waste ink tank 27 is mounted, for example, the convex portion 92 protruding toward the front side intersecting the engagement releasing direction comes in contact with the protrusion 93 of the opening door 36. Accordingly, the displacement of the waste ink tank 27 is regulated in the engagement releasing direction in which the locked step 60 disengages from the locking step 40 is released and the stable mount state can be ensured.

(16) In the waste ink tank 27, when the convex portion 92 comes in contact with the protrusion 93 of the opening door 36 with the displacement in the engagement releasing direction in which the locked step 60 disengages from the locking step 40, the container member 44 may be deformed due to the stress applied with the contact. In this case, when the convex portion 92 is located on the side reverse to the connection terminal 59 in view from the connection port 57 in the width direction perpendicular to the insertion and extraction directions of the discharge unit 97 into and from the connection port 57, the deformation degree of the portion in which the connection terminal 59 is provided may increase. Therefore, the failure in the contact with the connection terminal 87 of the printer 11 may be caused. In order to solve this problem, in this embodiment, the connection terminal 59 is located on the same side on which the convex portion 92 is located, when viewed from the connection port 57 through which the discharge unit 97 is inserted and extracted. Therefore, even when the convex portion 92 comes in contact with the protrusion 93 of the opening door 36, the deformation degree of the portion in which the connection terminal 59 of the container member 44 is provided can decrease. Accordingly, it is possible to reduce the failure in the contact with the connection terminal 87 of the printer 11.

(17) When the waste ink tank 27 is mounted on the mount location 31, it is possible to prevent the waste ink tank 27 from being moved carelessly from the mount location 31, by locating the opening door 36 at the closing location so that the protrusion 93 as the displacement regulating unit is located at the regulation location. On the other hand, when the waste ink tank 27 is detached from the mount location 31 of the printer 11, it is possible to easily detach the waste ink tank 27, by locating the opening door 36 at the opening location so that the protrusion 93 as the displacement regulating unit is located at the non-regulation location.

(18) The waste ink tank 27 has the configuration in which the upper opening 48 of the container member 44 is sealed by the film member 46 as the sealing member and the ink solvent of the waste ink absorbed by the ink absorbing members 45*a* to 45*d* through the air communication hole 90 formed at one location of the film member 46 is evaporated to the outside. With such a configuration, this configuration is different from a case where the upper opening 48 of the container member 44 is not sealed and open. The solvent component of the waste ink received inside the waste ink tank 27 is suppressed from being excessively evaporated and volatilized. In addition, the residue of the waste ink is not accumulated on the surfaces of the ink absorbing members 45*a* to 45*d* received in the laminated manner. Accordingly, by suppressing the deterioration in the absorption capability of the ink absorbing members 45*a* to 45*d*, it is possible to prevent deterioration in a storage efficiency of the waste ink by the waste ink tank 27.

(19) In the waste ink tank 27, when the waste ink is discharged from the front end opening 76*a* as the discharge port of the discharge unit 97 in the state where the discharge unit 97 of the printer 11 is inserted into the connection port 57 and the sealing portion 91 comes in contact with the circular mounted portion 96 of the brim portion 74 in the support member 72 of the printer 11, the waste ink is absorbed into the ink absorbing members 45*a* to 45*d*. The waste ink absorbed into the ink absorbing members 45*a* to 45*d* permeates a broad area in the ink absorbing members 45*a* to 45*d* including the portion near the air communication hole 90 which is more away from the portion near the front end opening 76*a* as the discharge port than the connection port 57. In consequence, since the permeating area of the waste ink in the ink absorbing members 45*a* to 45*d* is broad, the gasification of the ink solvent of the waste ink from the broad permeating area is accelerated. Accordingly, since the solvent component gasified from the broad permeating area is evaporated outside the waste ink tank 27 through the air communication hole 90, the waste ink tank 27 can maintain the satisfactory absorption capability of the ink absorbing members 45*a* to 45*d* included therein.

(20) In this case, the air communication hole 90 is configured to allow the reception space 47 as the inner space of the waste ink tank 27 receiving the ink absorbing members 45*a* to 45*d* to communicate with the air at the location above the upper surface of the uppermost ink absorbing member 45*d*. With such a configuration, even when the waste ink is absorbed to the extent that the absorption capability of the ink absorbing members 45*a* to 45*d* reaches the limit, the problem with leakage of the waste ink from the air communication hole 90 to the outside can be reduced.

(21) The waste ink tank 27 can be manufactured by a simple work for attaching the film member 46 to the upper opening 48 of the container member 44 having the ink absorbing members 45*a* to 45*d* therein after forming the air communication hole 90 in the film member 46.

(22) Even when a downstream passage portion (the discharge unit 97 of the cylindrical body 73 in the support member 72) of the liquid passage extracted from the connection port 57 of the container member 44 with the detachment of the waste ink tank 27 from the mount location 31 is smeared due to the attachment of the waste ink in the container member 44, the waste ink is removed by the contact of the right and left inner groove surfaces of the cut-in groove 62 of the third ink absorbing member 45*c*. In this case, as for the discharge unit 97, the lower surface of the uppermost fourth ink absorbing member 45*d* comes in contact with the discharge unit 97 from the upper side and the right and left inner groove surfaces of the cut-in groove 62 of the third ink absorbing member 45*c* on the second layer from the upper side comes in contact with the discharge unit 97 from both the right and left sides. Additionally, the upper surface of the second ink absorbing member 45*b* on the third layer from the upper side comes in contact with the discharge unit 97 from the lower side. That is, the three ink absorbing members 45*b*, 45*c*, and 45*d* come in contact with the discharge unit 97 in an insertion manner from the upper, lower, right, and left directions. Accordingly, it is possible to prevent the vicinity of the connection port 57 of the waste ink tank 27 or the mount location 31 from being smeared due to the leakage of the waste ink from the front end cylindrical portion 76 and the non-cylindrical portion 77 of the cylindrical body 73 and the portion (that is, the discharge unit 97) of the flexible tube 43 exposed in the non-cylindrical portion 77 in the support member 72, when the waste ink tank 27 is detached from the printer 11.

(23) In particular, when the waste ink tank 27 in which the absorption capability of the ink absorbing members 45*a* to 45*d* reaches the limit is detached, the ink absorbing members 45*a* to 45*d* are swollen due to the absorbed waste ink. Therefore, the lower surface of the fourth ink absorbing member 45*d* and the upper surface of the second ink absorbing member 45*b* blocking the cut-in groove 62 and the groove width of the cut-in groove 62 from the upper and lower sides becomes narrow. Accordingly, since the contact pressure of the right and left inner groove surfaces of the cut-in groove 62 of the third ink absorbing member 45*c*, the lower surface of the fourth ink absorbing member 45*d*, and the upper surface of the second ink absorbing member 45*b* against the discharge unit 97 becomes strong, the waste ink attached on the discharge unit 97 can be surely removed.

(24) On the other hand, when the waste ink tank 27 in which an absorption amount of waste ink is small in the ink absorbing members 45*a* to 45*d* is detached, the ink absorbing members 45*a* to 45*d* are not swollen. In addition, the contact pressure of the right and left inner groove surfaces of the cut-in groove 62 of the third ink absorbing member 45*c*, the lower surface of the fourth absorbing member 45*d*, and the upper surface of the second absorbing member 45*b* against the discharge unit 97 is weak. However, in this case, the absorption capability of the ink absorbing members 45*a* to 45*d* is high. Accordingly, even when the contact pressure against the discharge unit 97 is weak, the waste ink attached to the discharge unit 97 can easily be removed by absorption of the ink absorbing members 45*a* to 45*d* through the right and left inner groove surfaces of the cut-in groove 62, the lower surface of the fourth absorbing member 45*d*, and the upper surface of the second absorbing member 45*b*.

(25) In particular, the upper surface of the second absorbing member 45*b* comes in contact with the discharge unit 97 from the lower side in the gravity direction. Accordingly, in the discharge unit 97, the waste ink attached to the circumferential surface is surely removed. In particular, it is possible to efficiently remove the waste ink attached to the discharge unit 97 extracted from the connection port 57, since the upper surface of the second absorbing member 45*b* surely comes in contact with the lower surface of the discharge unit 97 considered that an attachment degree of the waste ink is the highest because the attached waste ink is curved along the outer circumferential surface of the discharge unit 97 in the gravity.

(26) In order to remove the waste ink attached to the discharge unit 97, the cut-in groove 62 may extend in the insertion and extraction directions of the discharge unit 97 in the ink absorbing member 45*c*. Accordingly, it is possible to improve a manufacture efficiency of the waste ink tank 27.

(27) When the discharge unit 97 is inserted into the connection port 57 at the time of mounting the waste ink tank 27, the right and left inner groove surfaces of the cut-in groove 62 of the third ink absorbing member 45*c*, the lower surface of the fourth absorbing member 45*d*, and the upper surface of the second absorbing member 45*b* serving as a guide unit guide the discharge unit 97 in the predetermined direction (that is, the direction in which the through-holes 61 are present). Therefore, the discharge unit 97 is inserted into the connection port 57 in an appropriate direction. As a result, the waste ink tank 27 can be mounted easily and precisely at the time of mounting the waste ink tank 27.

(28) Even when the center of the discharge unit 97 is locationally deviated in the direction perpendicular to the insertion and extraction directions at the time of inserting the discharge unit 97 into the connection port 57, the deviation of the discharge unit 97 is corrected by the tapered portion 95 located on the side of the connection port 57 in the cut-in groove 62 serving as the guide unit. Accordingly, it is possible to easily guide the discharge unit 97 in the appropriate direction after the deviation.

(29) Since the cut-in groove 62 serving as the guide unit extends along the insertion and extraction directions of the discharge unit 97 at the location corresponding to the connection port 57, a long guide distance can be secured for the discharge unit 97 inserted into the connection port 57 at the time of mounting the waste ink tank 27. Accordingly, it is possible to guide the insertion direction more exactly.

(30) The movement of the waste ink tank 27 toward the inner wall surface is regulated by the engagement of the post 54 serving as the movement regulating unit with the ink absorbing members 45*b*, 45*c*, and 45*d* received inside the container member 44, even when the waste ink tank 27 is dropped after the detachment from the printer 11. With such a configuration, the ink absorbing members 45*b*, 45*c*, and 45*d* do not strongly come in pressing contact with the inner wall surface of the container member 44 when the waste ink tank 27 is dropped, and the waste ink absorbed therein is not squeezed. Accordingly, even when the waste ink tank 27 is dropped after the detachment from the printer 11, the waste ink absorbed and maintained by the ink absorbing members 45*b*, 45*c*, and 45*d* can be prevented from being leaked from the inside.

(31) In this case, since the post 54 serving as the movement regulating unit can ensure a locking function of regulating the movement of the ink absorbing members 45*b*, 45*c*, and 45*d* by a fitting depth of the post 54 with the holes 55 as fitting holes of the ink absorbing members 45*b*, 45*c*, and 45*d*, it is possible to reduce a problem with pivot when the ink absorbing members 45*b*, 45*c*, and 45*d* is dropped.

(32) The post 54 is erected at the substantially center on the inner bottom surface of the container member 44. Therefore, even when a direction of the container member 44 is oriented in any direction in which the waste ink tank 27 is accidentally dropped, a distance between the post 54 formed in the substantially center of the inner bottom surface and the inner wall surface which is a lower side of a drop direction of the container member 44 is almost uniform. Accordingly, even though the ink absorbing members 45*b*, 45*c*, and 45*d* may be swollen in the drop direction due to an impact when the waste ink tank 27 is dropped, the swollen portions of the ink absorbing members 45*b*, 45*c*, and 45*d* can be prevented from strongly coming in pressing contact with the inner wall surface of the container member 44 depending on the direction of the ink absorbing members.

(33) Even when the liquid passage for discharging the waste ink is formed by the flexible tube 43 which is the main constituent element, the flexible tube 43 is inserted into and extracted from the connection port 57 of the container member 44 in the waste ink tank 27 in the state where the flexible tube 43 is supported in the straight line by the support member 72 having rigidity. Accordingly, it is possible to satisfactorily mount and detach the waste ink tank 27.

(34) The liquid passage for discharging the waste ink into the waste ink tank 27 is formed by supporting the flexible tube 43 by use of the front end cylindrical portion 76 as a first support unit, the base end cylindrical portion 75 as a second support unit, and the cylindrical body 73 of the support member 72 including the non-cylindrical portion 77. The downstream end of the flexible tube 43 which is the downstream end of the liquid passage formed in the above-described manner is supported by the discharge unit 97 including the front end cylindrical portion 76 of the cylindrical body 73 in the support member 72 in the state oriented in the direction in which the mount location 31 is present. Accordingly, it is possible to stably form the liquid passage in which the flexible tube 43 of which the movement is unstable is the main constituent element.

(35) When the liquid passage for discharging the waste ink is formed, the downstream end of the flexible tube 43 is inserted into the front end cylindrical portion (the first support unit) 76 having the cylindrical shape in the support member 72, the downstream end of the flexible tube 43 is supported in the fitting state. Since the front end cylindrical portion 76 supporting the downstream end of the flexible tube 43 in this manner is formed in the front end of the cylindrical body 73 having the predetermined length in the support member 72, the downstream end of the flexible tube 43 which is a substantial discharge port of the waste ink is also disposed in the front end of the cylindrical body 73 in the support member 72. Accordingly, it is possible to satisfactorily discharge the waste ink.

(36) In the flexible tube 43, the portion having the predetermined length on the downstream end side is supported in the substantially straight shape by the cylindrical body 73 of the support member 72 in the direction in which the downstream end is oriented. For example, when the waste ink is discharged into the waste ink tank 27, the downstream end of the flexible tube 43 can be easily guided up to the center of the waste ink tank 27.

(37) In the flexible tube 43, the downstream end is supported in the fitting state by the front end cylindrical portion 76 of the support member 72. In addition, the portion having the predetermined length on the base end side from the downstream end is supported by the base end cylindrical portion 75 of the support member 72 and interposed by the fixing claws 78 of the non-cylindrical portion 77. Accordingly, the portion having the predetermined length on the downstream side of the flexible tube 43 can be supported in the stable state by the cylindrical body 73 (the front end cylindrical portion 76, the non-cylindrical portion 77, and the base end cylindrical portion 75) of the support member 72.

(38) Even when the container member 44 is slanted in its posture at the time of mounting or detaching the waste ink tank 27, the cylindrical body 73 of the support member 72 inserted into or extracted from the connection port 57 of the container member 44 at the slant in the support state of the flexible tube 43 is shaken. Accordingly, it is possible to easily mount and detach the waste ink tank 27 without any problem.

Second Embodiment

Next, a second embodiment of the invention will be described with reference to FIG. 12. In the second embodiment, since only a formation location of the air communication hole 90 is different from that in the first embodiment and the other configuration is the same, the air communication hole 90 will be mainly described below. In addition, the same reference numerals are given to the same constituent elements and repeated description is omitted.

Figure 12:
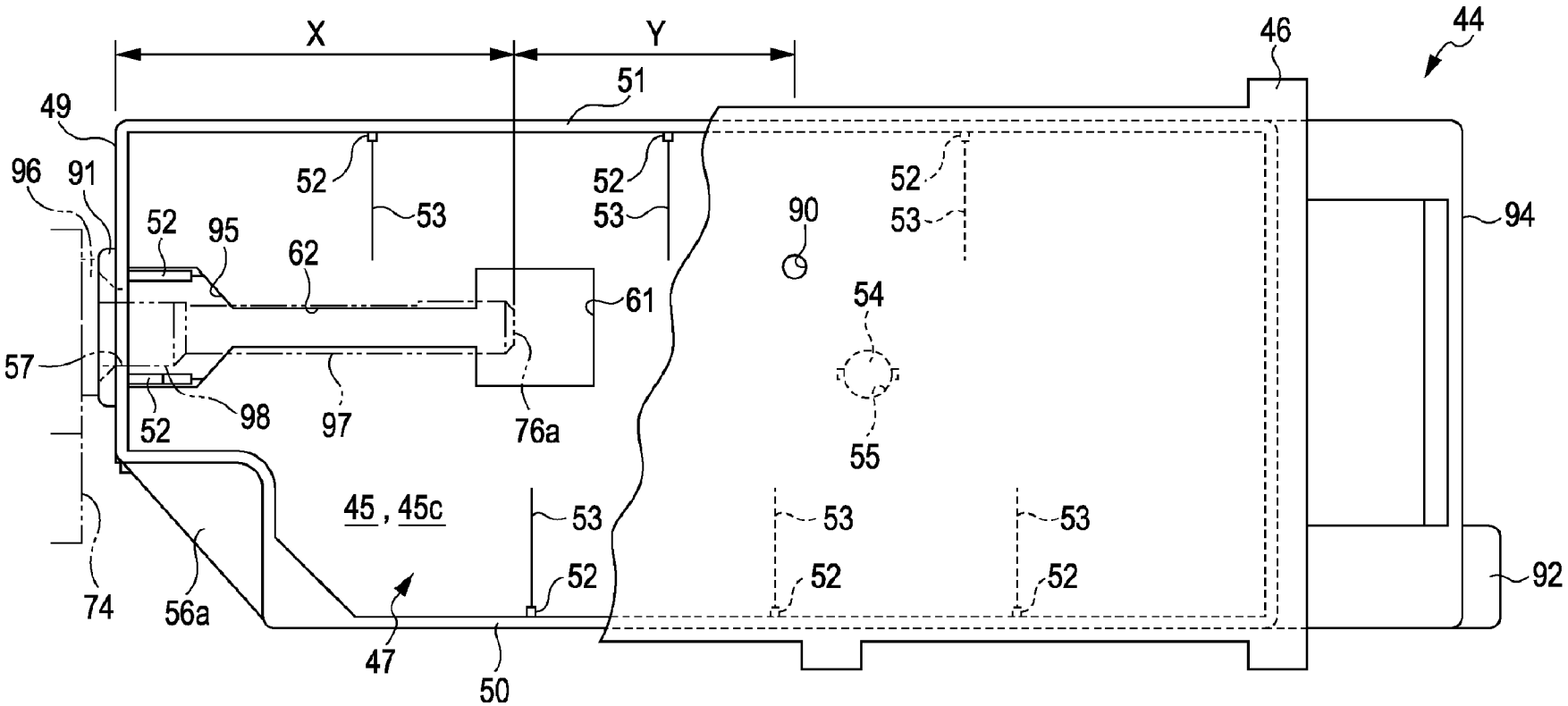
FIG. 12 is a partially-exploded plan view illustrating a waste ink tank according to a second embodiment.
Figure 13B:
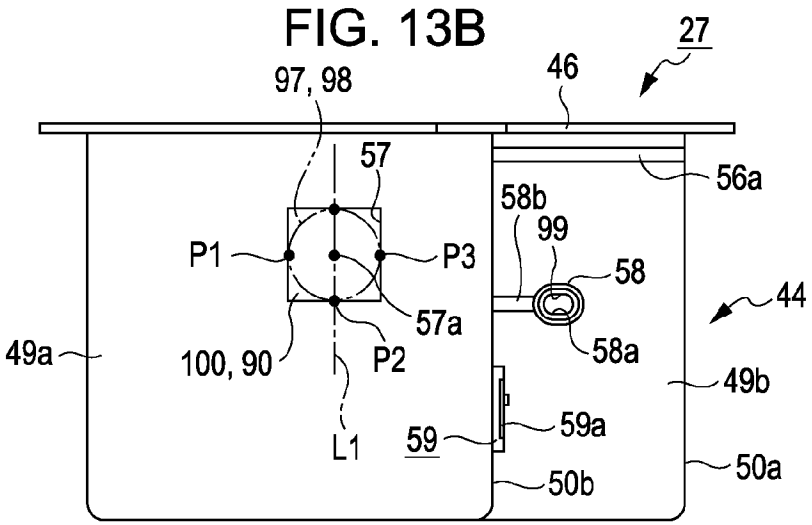
FIGS. 13A to 13D are rear side views simply illustrating a waste ink tank according to modified examples.
Figure 13A:
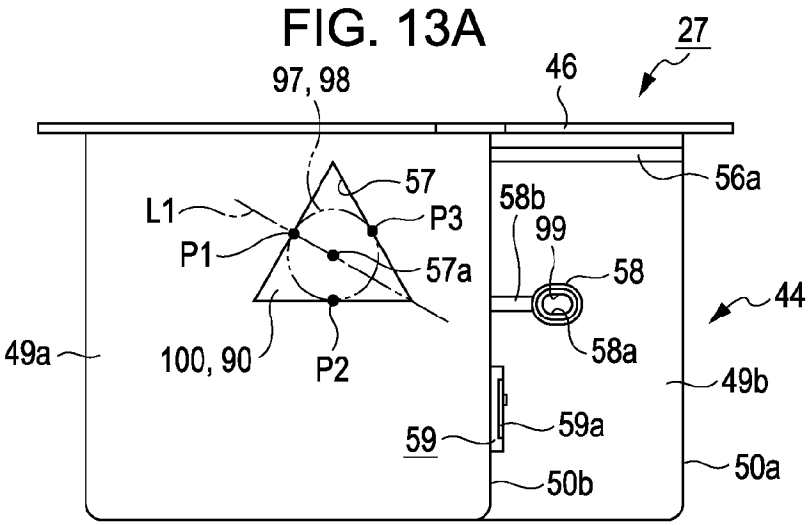
Figure 13D:
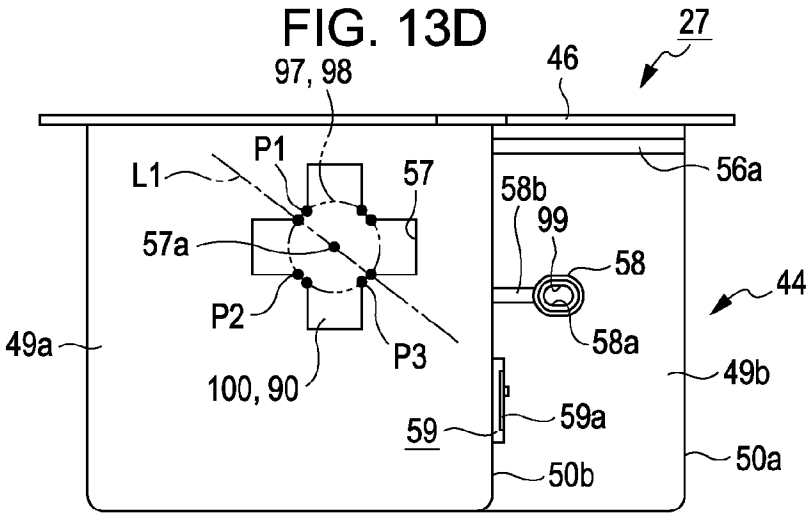
Figure 13C:
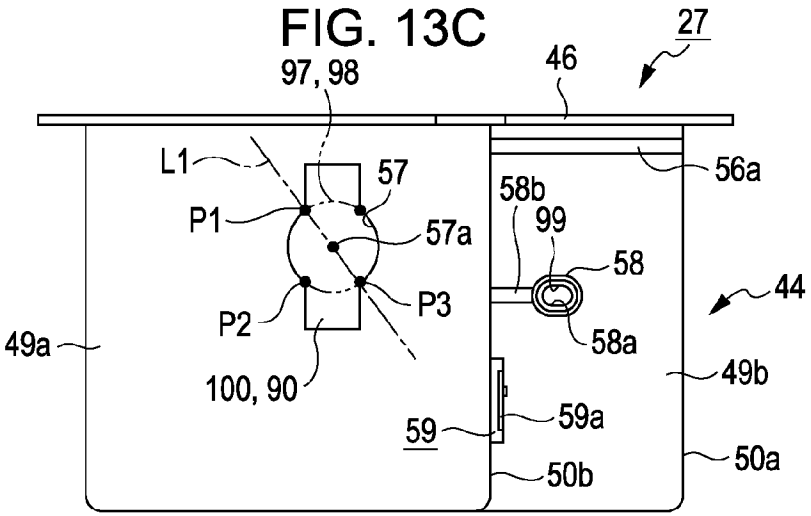

In the waste ink tank 27 according to this embodiment, as shown in FIG. 12, the air communication hole 90 is formed at the substantially center in the longitudinal direction of the film member 46. In addition, when the discharge unit 97 of the cylindrical body 73 is inserted into the container member 44 from the connection port 57 of the waste ink tank 27, a distance Y between the front end opening 76*a* and the air communication hole 90 is configured to be shorter than a distance X between the connection port 57 and the front end opening 76*a* as the discharge port of the discharge unit 97.

With such a configuration, in this embodiment, the waste ink is actively evaporated in portions near the through-holes 61, which are locations where the waste ink discharged from the front end opening 76*a* as the discharge port of the discharge unit 97 and absorbed by the ink absorbing members 45*a* to 45*d* is stored most. Therefore, an amount of absorbed waste ink can be reduced before the waste ink soaks into the entire ink absorbing members 45*a* to 45*d*. As a result, it is possible to increase the amount of waste ink to be discharged into the ink absorbing members 45*a* to 45*d*.

In the second embodiment, the following advantage can be obtained instead of the advantage of (19) described in the first embodiment.

(39) In the waste ink tank 27, the air communication hole 90 is located in the vicinity of the front end opening 76*a* as the discharge port of the discharge unit 97 discharging the waste ink. With such a configuration, gasification of the solvent component of the waste ink can be accelerated from the portions near the through-holes 61 which are the portions absorbing the most amount of waste ink absorbed in the ink absorbing members 45*a* to 45*d*. Moreover, it is possible to satisfactorily maintain the absorption capability of the ink absorbing members 45*a* to 45*d* included in the waste ink tank 27.

The embodiments described above can be modified as follows.

As shown in FIGS. 13A to 13D, the connection port 57 of the waste ink tank 27 may have a non-circular shape. For example, a gap 100 is formed between the connection port 57 and the discharge unit 97 in the mount state where the discharge unit 97 is inserted into the connection port 57. In this case, a communication passage (not shown) communicating the gap 100 to the air is formed in at least one of the circular mounted portion 96 of the brim portion 74 of the support member 72 and the sealing portion 91 of the waste ink tank 27.

In this case, in the mount state where the discharge unit 97 is inserted into the connection port 57, the gap 100 is formed between the discharge unit 97 and the opening edge of the connection port 57 serves as the air communication hole 90. Therefore, it is necessary to form the air communication hole 90 as a part (the film member 46 or the like) of the waste ink tank 27. In addition, the solvent of the waste ink discharged into the waste ink tank 27 through the gap 100 serving as the air communication hole 90 can be evaporated.

In this case, in the connection port 57, the opening edge of the connection port 57 contacts with the outer circumference of the fitting cylindrical portion 98 of the discharge unit 97 at least three points P1, P2, and P3, when the discharge unit 97 is inserted into the connection port 57. When the opening edge is halves by a straight line L1 formed by one point (for example, P1) amount at least the three points P1, P2, and P3 and the center (the center 57*a* of the connection port 57) of the discharge unit 97, the other points (P2 and P3) other than the one point (for example, P1) are located on one edge and the other edge of the opening edge halved by the straight line L1. Accordingly, when the discharge unit 97 is inserted into the connection port 57, the movement of the discharge unit 97 in the connection port 57 in a direction perpendicular to the insertion and extraction directions of the discharge unit 97 into the connection port 57 is regulated by bringing the three points (P1, P2, and P3) on the opening edge into contact with the outer circumference of the fitting cylindrical portion 98 of the discharge unit 97.

Accordingly, in the case of the waste ink tank 27 shown in FIGS. 13A to 13D, the gap 100 formed between the connection port 57 and the discharge unit 97 serves as the air communication hole 90, even though the air communication hole 90 is not formed. As a result, it is possible to satisfactorily maintain a collection efficiency of ink.

The opening edge of the connection port 57 contacts with the outer circumference of the fitting cylindrical portion 98 of the discharge unit 97 at least at three points (P1, P2, and P3) and the movement of the discharge unit 97 is regulated in the direction perpendicular to the insertion and extraction directions. Accordingly, even though the positioning unit is not provided, the discharge unit 97 can be positioned by the connection port 57.

In the modified examples shown in FIGS. 13A to 13D, the fitting cylindrical portion 98 of the discharge unit 97 is formed to have a cylindrical shape of a cross-sectional non-circle (for example, a polygon such as a triangle or a quadrangle). In addition, the opening edge of the connection port 57 as opening of the waste ink tank 27 into which the discharge unit 97 is inserted may be formed to have a circular shape. Even with such a configuration, the advantages described above in the modified examples shown in FIGS. 13A to 13D can be obtained likewise.

Figure 14:
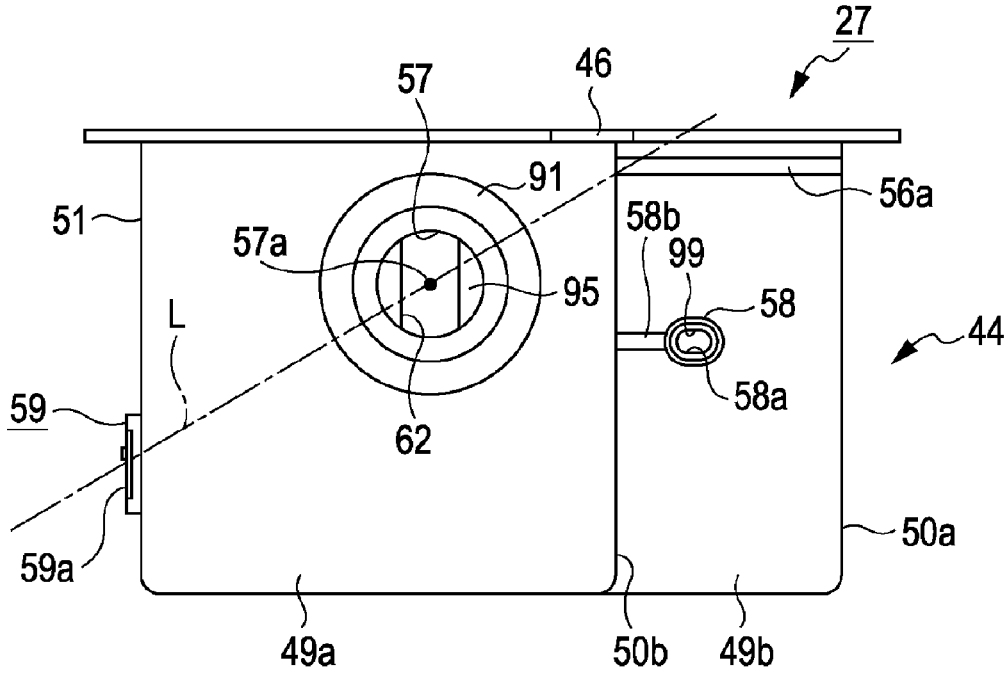
FIG. 14 is a rear side view illustrating a waste ink tank according to a modified example.

As shown in FIG. 14, the connection terminal 59 of the waste ink tank 27 may be formed below the right wall 51 of the container member 44. With such a configuration, in the connection terminal 59, the contact surface 59*a* of the connection port 57 is also not perpendicular to a straight line L passing through the center 57*a* of the connection port 57. Accordingly, the same advantages as those in the embodiments can be obtained.

Figure 15:
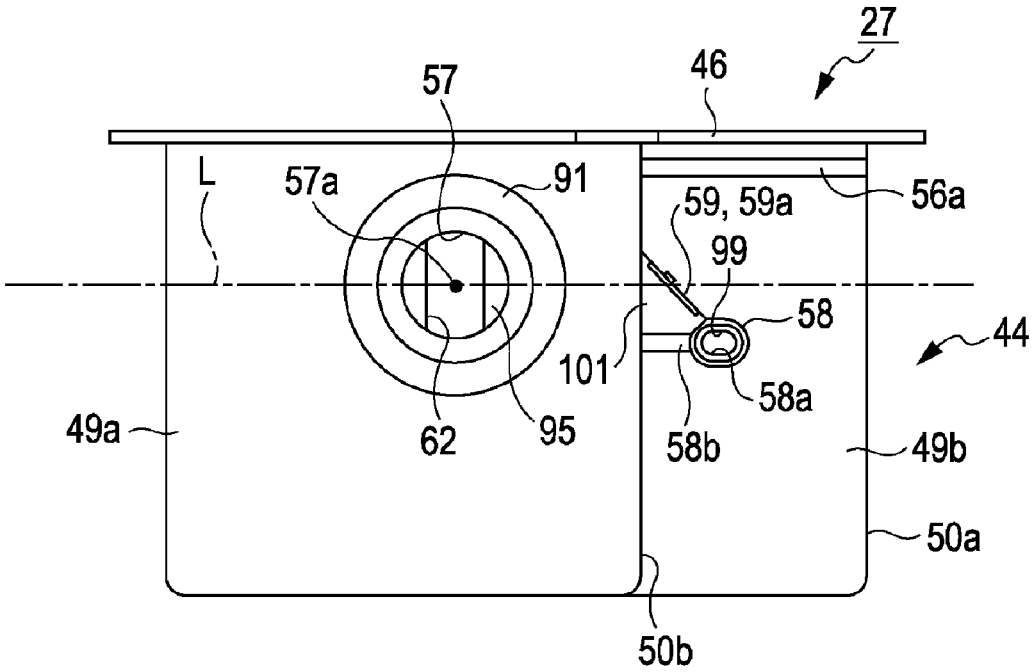
FIG. 15 is a rear side view illustrating a waste ink tank according to a modified example.

As shown in FIG. 15, the connection terminal 59 of the waste ink tank 27 may be formed in the same height as that of the center 57*a* of the connection port 57 in the sub left wall 50*b* of the container member 44. With such a configuration, when a swollen portion 101 having a slant surface on the sub left wall 50*b* of the container member 44 and the connection terminal 59 is formed on the slant surface, the contact surface 59*a* of the connection port 57 is also not perpendicular to a straight line L passing through the center 57*a* of the connection port 57. Accordingly, the same advantages as those in the embodiments can be obtained.

Figure 16:
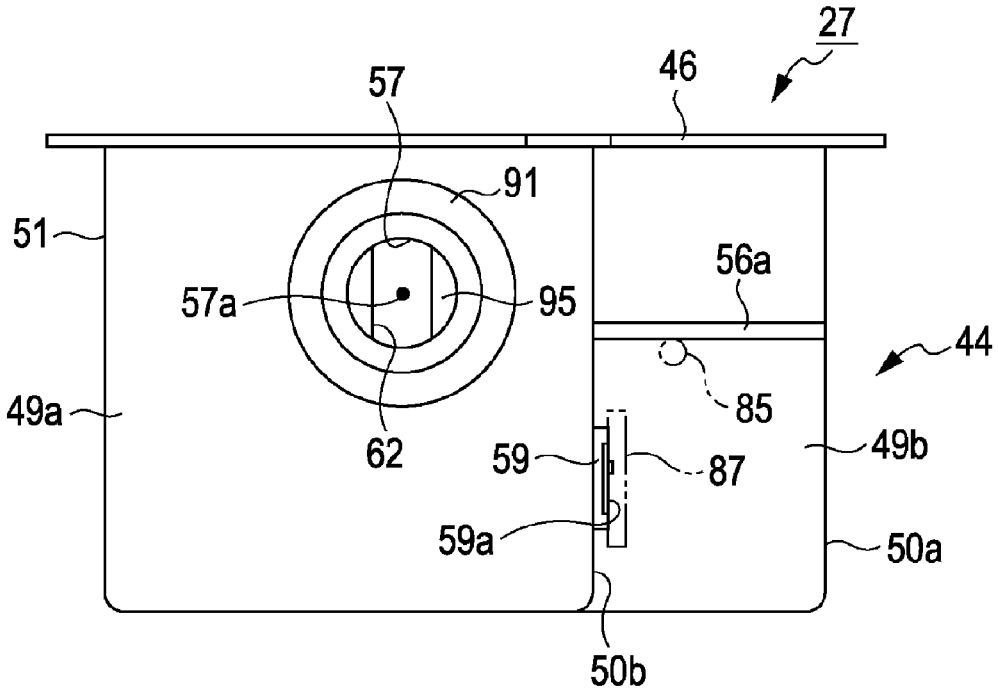
FIG. 16 is a rear side view illustrating a waste ink tank according to a modified example.

As shown in FIG. 16, in the positioning unit, the cylinder portion 58 may be omitted and a contact portion may be formed by the reinforcing rib 56*a*. In addition, the positioning unit serving as the contact portion may be configured by a member having a plate shape different from that of the reinforcing rib 56*a* of the concave portion 56.

Figure 17:
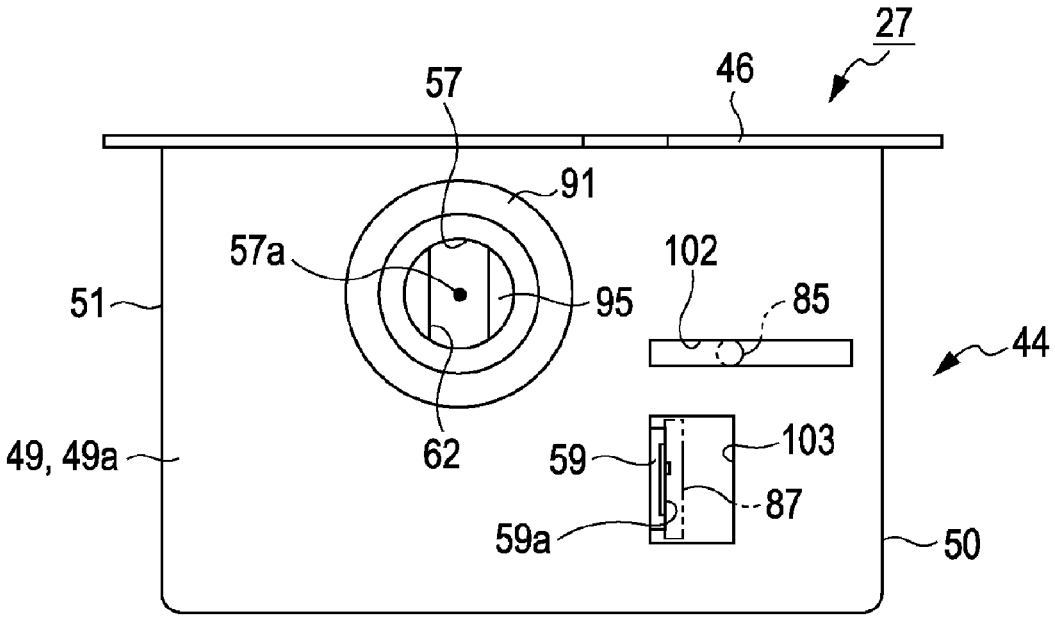
FIG. 17 is a rear side view illustrating a waste ink tank according to a modified example.

As shown in FIG. 17, without dividing the rear wall 49 of the container member 44 of the waste ink tank 27 into the main rear wall 49*a* and the sub rear wall 49*b*, the connection port 57 is perforated through the rear wall 49. In addition, a rectangular hole 102 as a positioning unit into which the pin 85 can be inserted and a rectangular hole 103 as a fixing location of the connection terminal 59 may be punched.

Figure 18:
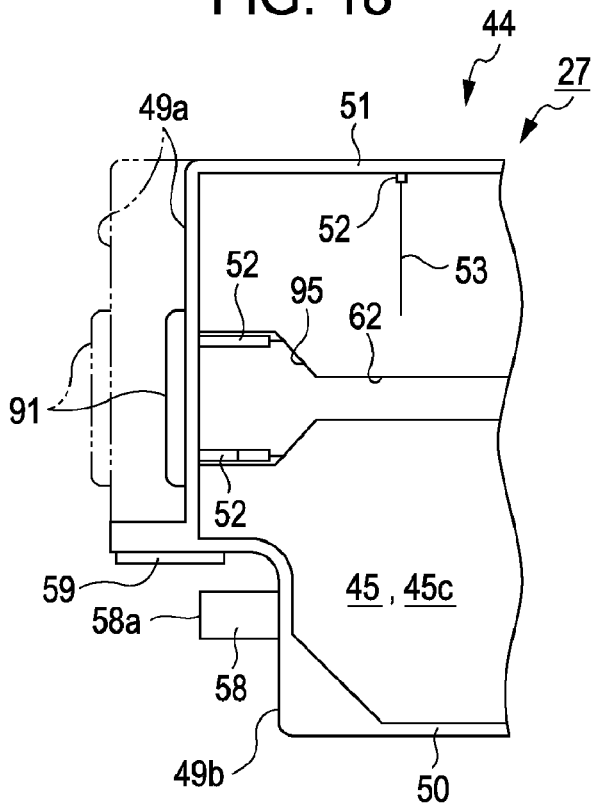
FIG. 18 is a partially-omitted plan view illustrating a waste ink tank according to a modified example.
Figure 19:
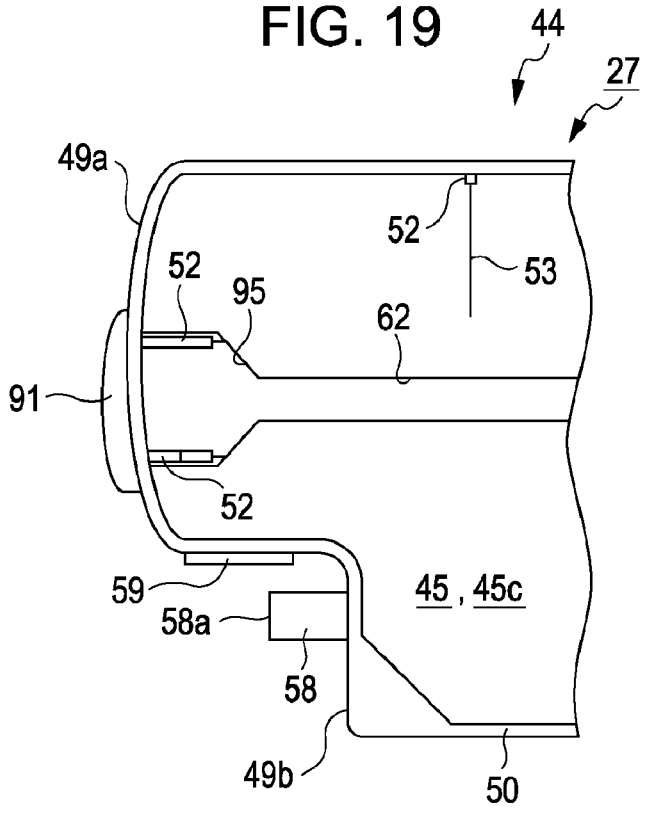
FIG. 19 is a partially-omitted plan view illustrating a waste ink tank according to a modified example.

As shown in FIG. 18, the waste ink tank 27 may be formed so that the main rear wall 49*a* on which the connection port 57 of the container member 44 is formed is retreated toward an inward side of the container member 44. As shown in FIG. 19, in the waste ink tank 27, the main rear wall 49*a* on which the connection port 57 of the container member 44 is formed may not be formed in a plane shape, but may be formed in a circular arc plane shape.

Figure 20:
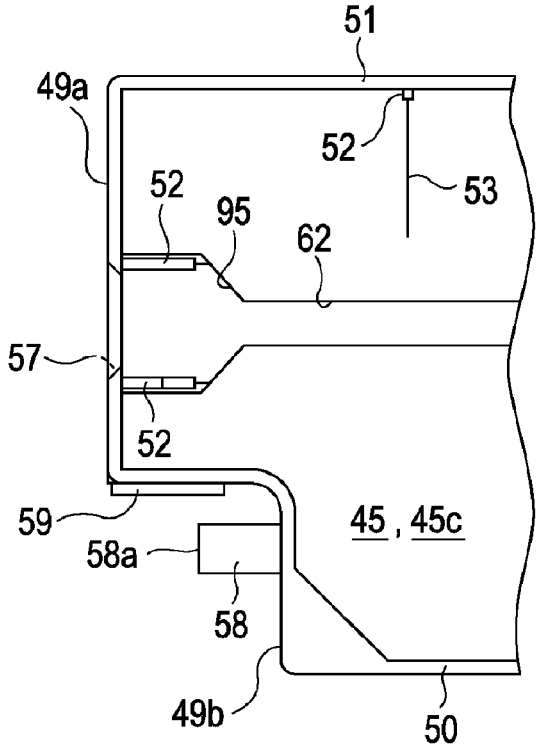
FIG. 20 is a partially-omitted plan view illustrating a waste ink tank according to a modified example.

As shown in FIG. 20, in the waste ink tank 27, the sealing portion 91 may not be formed on the main rear wall 49*a* on which the connection port 57 of the container member 44 is formed.

Figure 21:
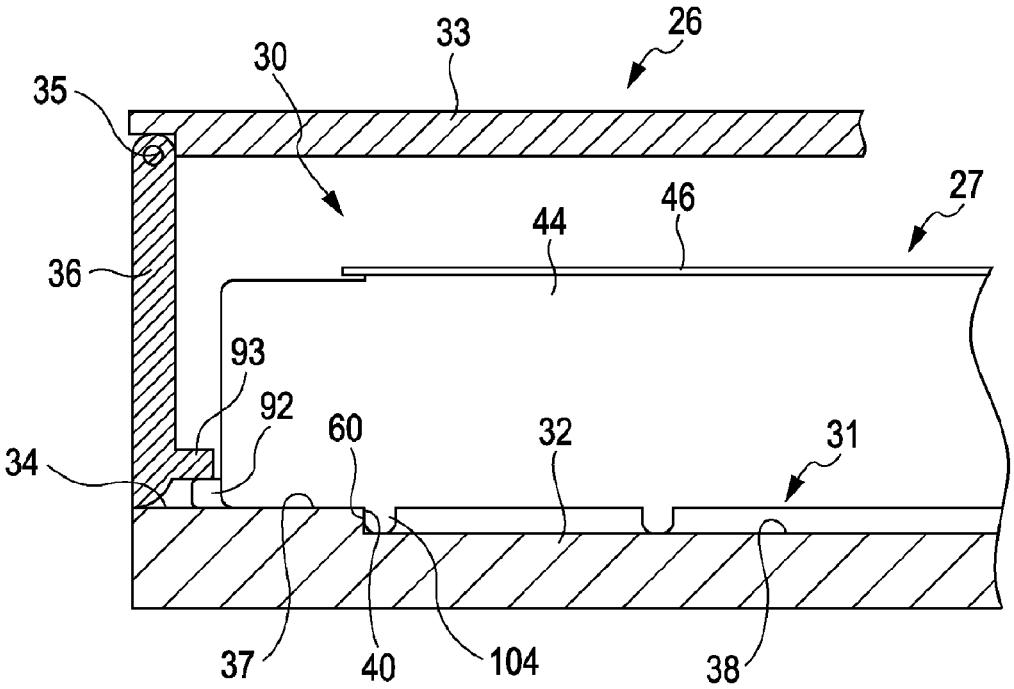
FIG. 21 is a partially-omitted sectional view illustrating a housing receiving a waste ink tank according to a modified example.

As shown in FIG. 21, in the waste ink tank 27, the locked step 60 formed on the bottom surface of the container member 44 may be configured by the protrusion 104 protruding from the bottom surface.

Figure 22A:
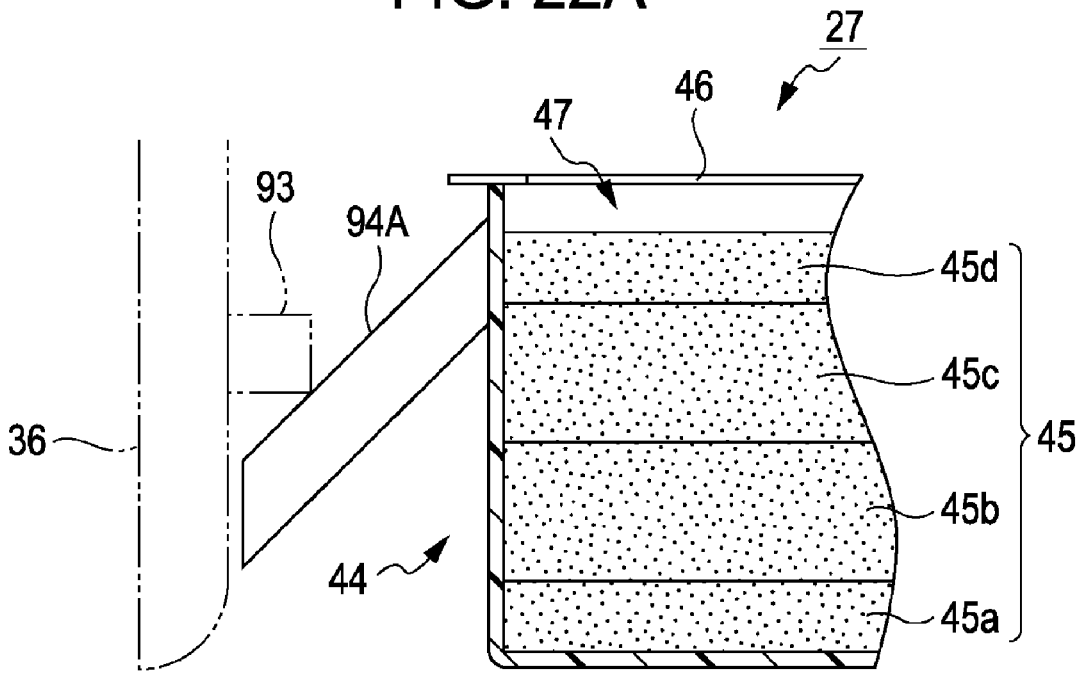
FIGS. 22A and 22B are partially-omitted sectional views illustrating a waste ink tank according to modified examples.
Figure 22B:
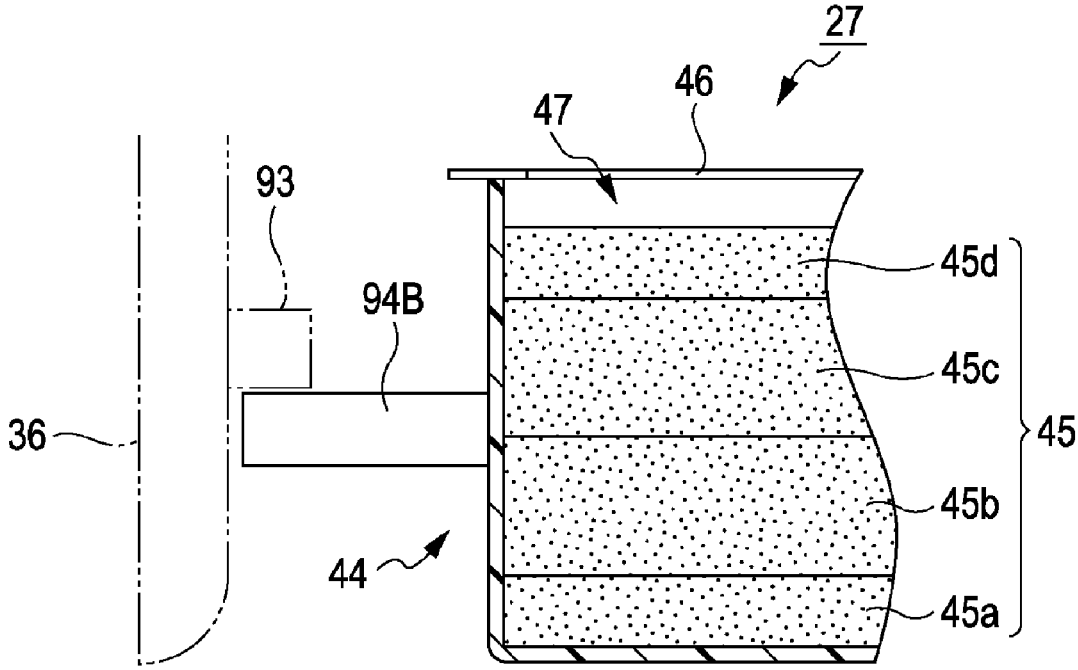

As shown in FIGS. 22A and 22B, in the waste ink tank 27, the gripping portion 94 formed on the front end of the container member 44 may be configured by a slant shaft 94A or a horizontal shaft 94B. In this case, when the opening door 36 is at the closing location for the slant shaft 94A or the horizontal shaft 94B, the protrusion 93 may come close to regulate displacement. In this case, the convex portion 92 is not necessary.

Figure 23A:
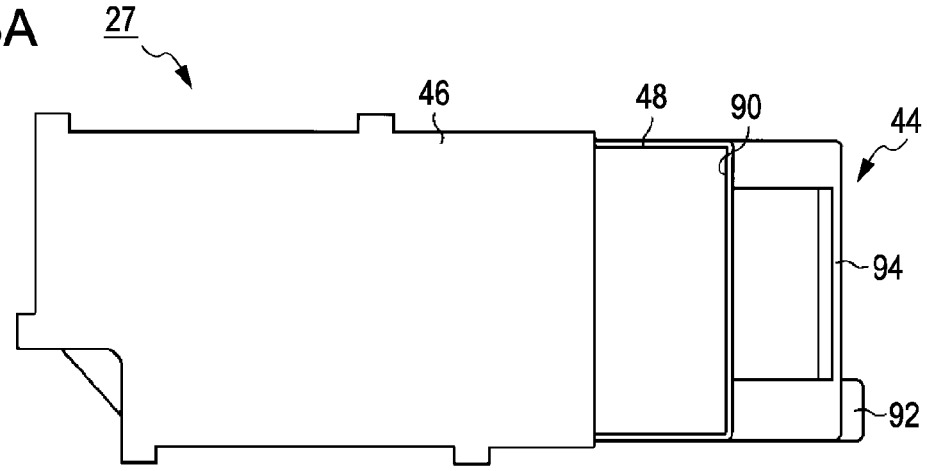
FIGS. 23A to 23C are plan views illustrating a waste ink tank according to modified examples and FIG. 23C is a front view illustrating a waste ink tank according to a modified example.
Figure 23B:
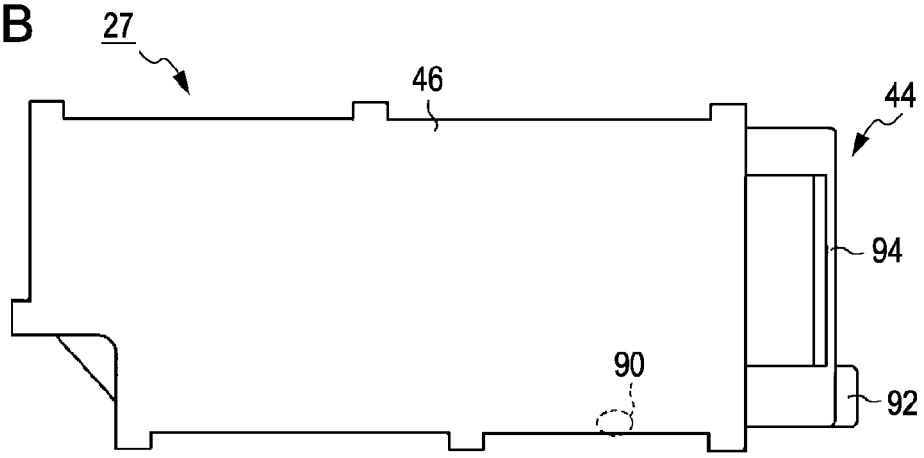
Figure 23C:
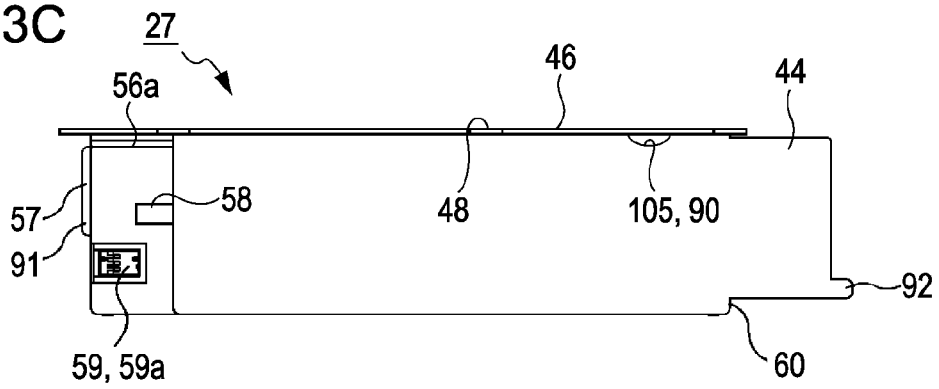
Figure 24A:
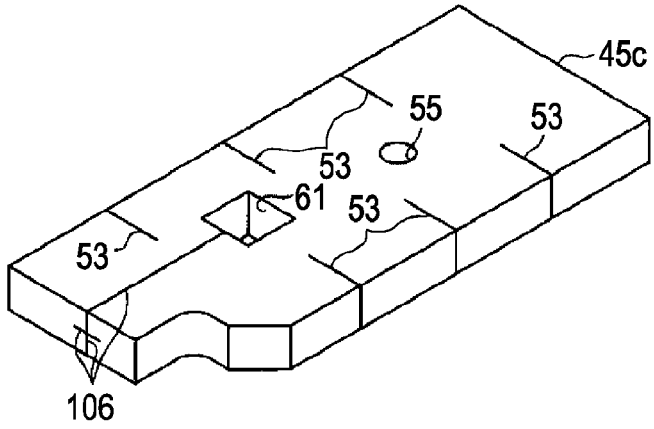
FIGS. 24A to 24D are perspective views illustrating an ink absorbing member according to modified examples.
Figure 24B:
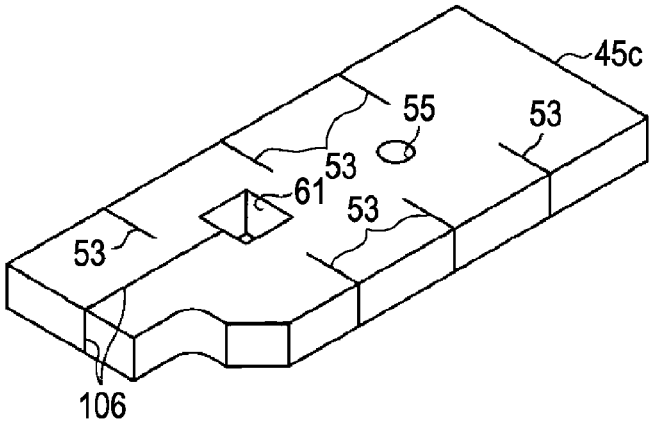
Figure 24C:
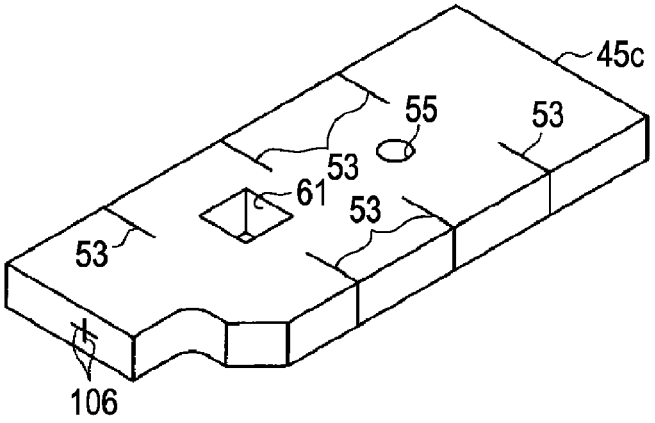
Figure 24D:
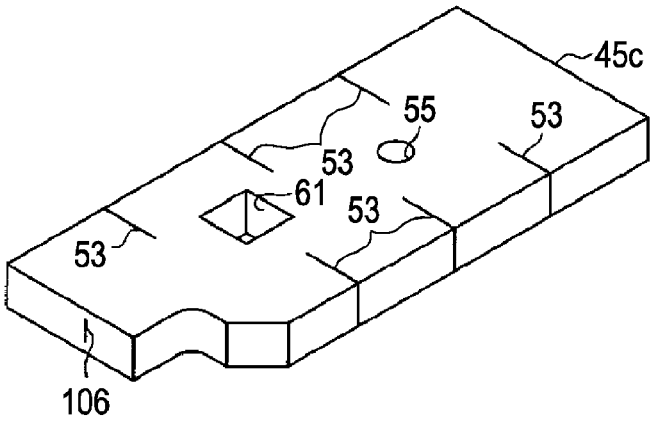

As shown in FIG. 23A, the air communication hole 90 may be formed by cutting the front end side of the film member 46. As shown in FIG. 23B, a portion (a part having an elliptic shape indicated by a dashed line) of the upper opening 48 of the container member 44 may not be adhered to the film member 46. As shown in FIG. 23C, a notched portion 105 may be formed in a part of the upper opening 48 of the container member 44 to which the film member 46 is adhered.

As shown in FIGS. 24A to 24D, as the contact portions for removing the ink attached to the discharge unit 97 and the guide unit guiding the insertion direction, a slit 106 having a cross shape or the like may be formed from the cress-section of the ink absorbing member 45*c* to the through-holes 61, instead of the cut-in groove 62. Alternatively, a hole extending in the insertion and extraction directions of the discharge unit 97 may be formed instead of the slit 106.

Figure 25:
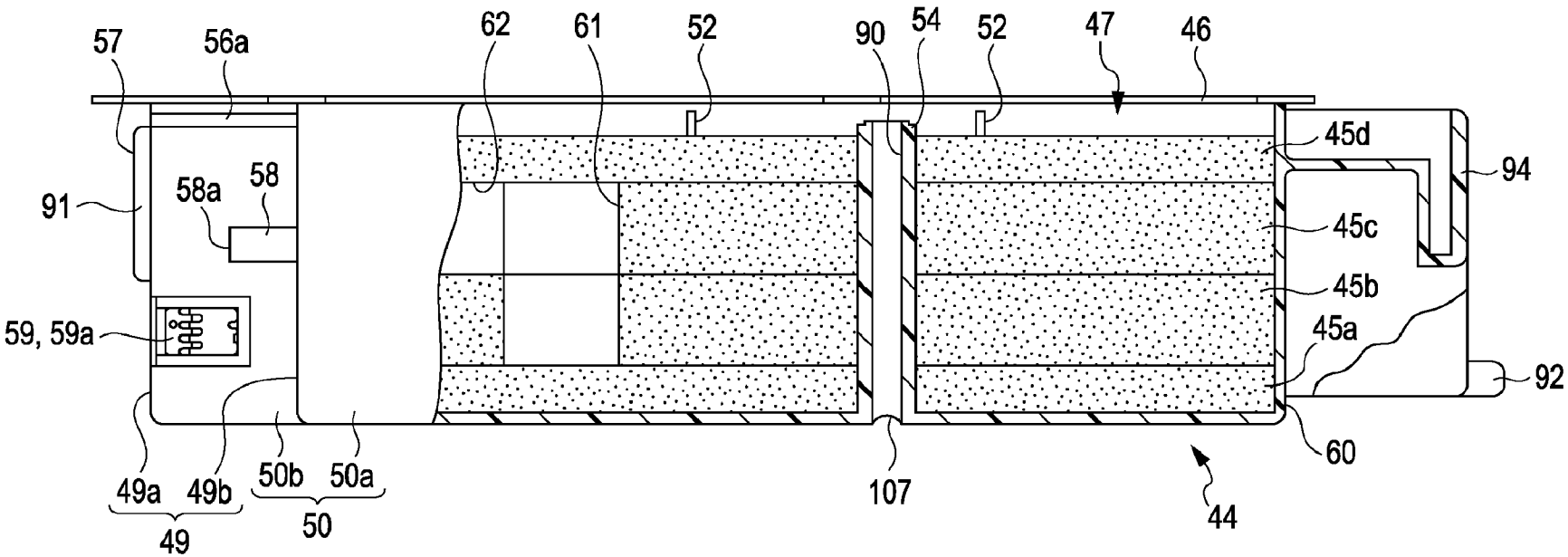
FIG. 25 is a partially-exploded front view illustrating a waste ink tank according to a modified example.

As shown in FIG. 25, in the post 54 fitting and engaging with the holes 55 of the ink absorbing members 45*a* to 45*d*, the air communication hole 90 is formed from the upper end surface located above the upper surface of the uppermost ink absorbing member 45*d* in an axial direction and the lower portion of the air communication hole 90 may communicate with the air communication hole 90 by an omission groove 107 on the outside of the right and left walls in the lower portion of the post 54.

In the waste ink tank 27, the ink absorbing members 45*a* to 45*d* are not received in the reception space 47 which is the inner space, but the reception space 47 may store the waste ink as a waste ink container.

The thicknesses of the ink absorbing members 45*a* to 45*d* may be the same as each other or may be different from each other. The thickness can be arbitrarily determined and the number of the ink absorbing members 45*a* to 45*d* can be changed.

The printer 11 may be realized as a so-called full line type printer in which the shape of a print head corresponds to the entire width of a print sheet P in a direction intersecting a transport direction of the print sheet P.

The printer 11 may be realized as a so-called off-carriage type printer 11 in which the ink cartridges 23 are not mounted on the carriage 16 but on a predetermined location inside the printer 11, and ink is pressurized and supplied from the ink cartridges 23 to the print head 21 through an ink supply tube.

The sealing member may be a lid member such as a resin plate other than the film member 46.

In the container member 44 of the waste ink tank 27, the upper opening 48 may be sealed by a sealing member, when mounted on the mount location 31. That is, the container member may be displaced in the state where the upper opening 48 is sealed, by bringing a lid member, which is opened and closed on the rear end edge of the upper opening 48 of the container member 44, into contact with a contact member formed inside the reception 30 at the time of moving the container member 44 in the mount direction.

In the tube support mechanism 28, the coil springs 80 may be disposed between the brim portion 74 of the support member 72 and the front wall of the base body 63. In this case, the cylinders 79 may not be provided on the rear surface of the brim portion 74.

The non-cylindrical portion 77 of the cylindrical body 73 of the support member 72 may not be formed by cutting the circumferential wall of the cylindrical body 73, but may be formed by a connection member which connects a space between two cylindrical bodies individually forming the front end cylindrical portion 76 and the base end cylindrical portion 75 which each a cylindrical shape.

A removing member having a circularly ring shape may be mounted on the inner circumferential surface of the connection port 57 of the container member 44 in the waste ink tank 27.

In the tube support mechanism 28, the portion having the predetermined length on the downstream end side of the flexible tube 43 may be supported by a support member having a straight line shape and the plural tube fixing portions 71 provided on the upper surface of the base body 63 in the front and rear directions at an interval. In this case, the support member 72 may be formed only by a simple cylindrical member or a non-cylindrical member.

In the cylindrical body 73 of the support member 72, the entire front end may be formed as a non-cylindrical portion than the brim portion 74. In this case, it is preferable that the front end of the non-cylindrical portion is provided with the insertion claws 78 as the fixing portion.

In the cylindrical body 73 of the support member 72, the base end cylindrical portion may be formed as a non-cylindrical portion. In this case, it is preferable that the base end of the non-cylindrical portion is provided with the insertion claws 78 as the fixing portion.

As for the pin 85 and the long hole 58*a*, the pin 85 may be provided in the container member 44 of the waste ink tank 27 and the long hole 58*a* may be provided at the mount location 31 inside the receiving chamber 30.

The support member 72 of the tube support mechanism 28 may be fixed in a horizontal state so as not to be shaken with respect to the base body 63.

The locking unit locking with the waste ink tank 27 at the mount location 31 from the detachment direction may be formed as a locking protrusion protruding from the bottom wall 32 of the receiving chamber 30, as well as the locking step 40. Alternatively, the locking unit may lock with the side walls 50 and 51 of the container member 44 of the waste ink tank 27 by friction.

The locking step 40 may lock with the rear wall 49 of the waste ink tank 27.

In the embodiments described above, the liquid ejecting device has been realized as the ink jet printer, but the invention is not limited thereto. The liquid ejecting device can be realized as a device capable of ejecting or discharging another liquid other than ink, a liquid-formed substance in which particles of a functional material are dispersed or mixed, or a fluid-formed substance such as gel. Examples of the liquid ejecting device include a liquid-formed substance ejecting device ejecting a liquid-formed substance in which a material such as an electrode material or a coloring material (pixel material) used to manufacture a liquid display device, an EL (electroluminescence) display device, and a plane emission display is dispersed or solved; a liquid ejecting device ejecting a bio organic material used to manufacture a bio chip; and a liquid ejecting device ejecting a liquid as a sample used by a precise pipette. In addition, examples of the liquid ejecting device include a liquid ejecting device ejecting a lubricant to a precision instrument such as a clock or a camera by a pin point; a liquid ejecting device ejecting a transparent resin liquid such as ultraviolet cured resin on a board to form a minute hemispheric lens (optical lens) used in an optical communication element or the like; a liquid ejecting device ejecting an acid etching liquid or an alkali etching liquid to etch a substrate; and a liquid-formed substance ejecting device ejecting gel (for example, physical gel). The invention is applicable to one device thereof. In addition, in the specification of the invention, "the liquid" includes an inorganic solvent, an organic solvent, a solution, a liquid resin, a liquid metal (metallic melt), a liquid-formed substance, and a fluid-formed substance.

Third Embodiment

Hereinafter, an ink jet printer which is an example of a liquid ejecting device including a waste liquid collecting system in which a waste liquid collector according to the invention is detachably mounted will be described with reference to FIGS. 1 to 11 according to a first embodiment. "Front and rear directions", "upper and lower directions", and "right and left direction" in the following description refer to "front and rear directions", "upper and lower directions", and "right and left direction" indicated by arrows in FIGS. 1 to 3, unless particularly mentioned.

As shown in FIG. 1, an ink jet printer (hereinafter, referred to as "a printer) 11 as a liquid ejecting device according to this embodiment includes a frame 12 having a rectangular shape in plan view. A platen 13 extends in the right and left direction inside the frame 12. A sheet-feeding mechanism which is disposed above the platen 13 and includes a sheet-feeding motor 14 feeds a print sheet P from the rear side to the front side. In addition, a guide shaft 15 extending in parallel to a longitudinal direction (the right and left directions) of the platen 13 is disposed above the platen 13 inside the frame 12.

A carriage 16 is supported in the guide shaft 15 so as to reciprocate along a shaft direction (the right and left directions) of the guide shaft 15. A driving pulley 17 and a driven pulley 18 are rotatably supported at locations corresponding to both ends of the guide shaft 15 in the rear surface of the inside of the frame 12, respectively. A carriage motor 19 which serves as a driving source when the carriage 16 reciprocates is connected to the driving pulley 17. A timing belt 20 fixing and supporting the carriage 16 is suspended between the pair of pulleys 17 and 18. Accordingly, the carriage 16 is configured to move in the right and left directions through the timing belt 20 by drive of the carriage motor 19 while being guided by the guide shaft 15.

As shown in FIG. 1, a print head as a liquid ejecting head 21 is disposed on the lower surface of the carriage 16. On the other hand, plural ink cartridges 23 (in this embodiment, five ink cartridges) for supplying ink as a liquid to the print head 21 are detachably mounted on the carriage 16. The ink cartridges 23 individually correspond to plural nozzle opening rows (not shown) formed on a nozzle formation surface 21*a* (see FIG. 2) which is the lower surface of the print head 21. In addition, the ink cartridges 23 individually supply ink to the corresponding nozzle rows through ink passages (not shown) formed inside the print head 21.

A home position HP which is a maintenance location where the carriage 16 is positioned when the printer 11 is turned off or the print head 21 is subjected to maintenance is provided in one end (the right end in FIG. 1) of the inside of the frame 12, that is, in a non-print area which the print sheet P does not reach. In addition, a maintenance unit 24 for performing various maintenance operations is disposed below the home position HP so that the print head 21 keeps performing satisfactory ejection of ink onto the print sheet P.

The maintenance unit 24 includes a cap 25 having a substantially rectangular box-like shape corresponding to the lower surface (the nozzle formation surface) of the print head 21 and an elevation mechanism (not shown) moving up and down the cap 25. In addition, when the cap 25 is moved up by drive of the elevation mechanism (not shown) in the state where the carriage 16 moves to the home position HP, the cap 25 is configured so as to come in contact with the nozzle formation surface 21*a* which is the lower surface of the print head 21 in the state where the cap 25 surrounds the nozzle rows.

As shown in FIGS. 1 and 2, a housing 26 having a rectangular parallelepiped shape and being formed in the front and rear directions is formed in one end (the right end in FIG. 1) of the inside of the frame 12 and below the home position HP. A receiving chamber 30 receiving a waste liquid collecting system 29 including a waste ink tank 27 as a waste liquid collector and a tube supporting mechanism 28 as a liquid passage forming unit is formed inside the housing 26. In addition, a mount location 31 of the waste ink tank 27 is configured below the receiving chamber 30. As shown in FIGS. 2 and 10, the height (which is a distance between a bottom wall 32 and a top wall 33) of the inside of the receiving chamber 30 is set sufficiently higher than the height of the waste ink tank 27 so that the waste ink tank 27 is tilted in its posture inside the receiving chamber 30.

A rectangular mounting/detaching port 34 for passing the waste ink tank 27 at the time of mounting or detaching the waste ink tank 27 to or from the mount location 31 inside the receiving chamber 30 is formed on the front surface of the housing 26. An opening door 36 is provided in the mounting/detaching port 34 so that the upper end portion thereof is rotatably supported on a pair of right and left shafts 35 formed in both ends of the upper edge of the mounting/detaching port 34. By holding a hand 36*a* formed on the front surface of the opening door 36 to open or close the opening door 36 about the shafts 35, the opening door 36 is opened and closed between a closing location indicated by a solid line and an opening location indicated a two-dot chain line in FIG. 2.

As shown in FIG. 2, inside the receiving chamber 30 of the housing 26, a front step surface 37, an intermediate step surface 38, and a rear step surface 39 are formed in a stepped shape from a front side to a rear side in the front and rear directions on the upper surface of the bottom wall 32. The front step surface 37 is formed so as to have the same height as that of the lower edge of the mounting/detaching port 34. A locking step 40 as a locking portion which makes the intermediate step surface 38 lower than the front step surface 37 is formed between the rear end of the front step surface 37 and the front end of the intermediate step surface 38 so as to extend in the right and left directions.

The intermediate step surface 38 is formed so as to have a length in the front and rear directions slightly shorter than the length of the waste ink tank 27 in the front and rear directions. The almost entire area of the intermediate step surface 38 and the rear half area of the front step surface 37 form the mount location 31 of the waste ink tank 27. The rear step surface 39 is formed so as to be slightly lower than the intermediate step surface 38 with a stepped portion 41 interposed therebetween. The tube supporting mechanism 28 supporting the flexible tube 43, which discharges ink forcedly sucked as waste ink (waste liquid) from the inside of the cap 25 to the waste ink tank 27 with drive of a sucking pump 42, is disposed on the rear step surface 39.

Next, the waste liquid collecting system 29 having the waste ink tank 27 and the tube supporting mechanism 28 and being provided in the printer 11 will be described.

First, the waste ink tank 27 will be described.

As shown in FIG. 3, the waste ink tank 27 includes a container member 44 which is made of synthetic resin and has a box-like shape having an open top portion and a bottom portion, plural ink absorbing members (waste ink absorbing member) 45*a* to 45*d* (four ink absorbing members in this embodiment) formed of a non-woven fabric or a felt having an external shape corresponding to the open shape of the container member 44, and a film member 46 as a sealing member which has an external shape corresponding to the open shape of the container member 44. An inside space of the container member 44 serves as a receiving space 47. The ink absorbing members 45*a* to 45*d* are received in a laminated manner in the receiving space 47. An upper opening 48 of the container member 44 is sealed by attaching the film member 46 to the container member 44 to cover the upper opening 48 of the container member 44 in which the ink absorbing members 45*a* to 45*d* are received. As shown in FIGS. 3 and 4, an air communicating hole 90 is formed at one location on a front side of the intermediate portion of the film member 46.

Ribs 52 having a thin plate shape are formed in the upper and lower directions at plural locations of inner wall surfaces of a rear wall 49, a left wall 50, and a right wall 51 of the container member 44 (two locations on the rear wall 49 and three locations on each of the left wall 50 and the right wall 51). In FIG. 3, just one rib 52 on the rear wall 49 and just three ribs 52 on the right wall 51 are illustrated. In addition, cut-in portions 53 are formed in the outer peripheries of the ink absorbing members 45*a* to 45*d* so as to correspond to the locations of the ribs 52.

A columnar post 54 is positioned at the almost central location of the inner bottom surface of the container member 44. Round holes 55 as fitting holes for fitting with the post 54 are perforated at the almost central locations of the ink absorbing members 45 so as to correspond to the post 54. The ribs 52 are inserted into the corresponding cut-in portions 53 and the post 54 is inserted into the holes 55 so that the ink absorbing members 45*a* to 45*d* are received in the laminated manner in the reception space 47 of the container member 44. In particular, the ink absorbing members 45*a* to 45*d* are regulated so as not to move toward the inner wall surfaces of the side walls inside the container member 44 by locking the ink absorbing members 45*a* to 45*d* with the post 54 fitting with the holes 55 formed at the almost central locations.

As shown in FIG. 3, a concave portion 56 is formed in the rear left corner of the container member 44. In consequence, the rear wall 49 is divided into a main rear wall 49*a* located on the relatively rear side and a sub rear wall 49*b* located on the relatively front side. In addition, the left wall 50 is divided into a main left wall 50*a* located on the relatively left side and a sub left wall 50*b* located on the relatively right side. In the upper of the concave portion 56, a reinforcing rib 56*a* having a substantially triangular plate shape in plan view is formed between the sub rear wall 49*b* and the sub left wall 50*b*.

A connection port 57 as an opening having a round shape is formed through the main rear wall 49*a*. A cylinder portion 58 having a cylindrical shape which is horizontally long in the cross-section is formed on the sub rear wall 49*b* so as to protrude toward the rear side. A long hole 58*a* of the cylinder portion 58 serves as a positioning unit. The cylinder portion 58 is connected to the sub left wall 50*b* through the reinforcing rib 58*b*. The connection port 57 is formed so that the diameter of the inner circumferential surface becomes gradually smaller in a deeper portion. In addition, the connection port 57 has a function of guiding a member toward the inner center of the connection port 57, when a member inserted into the connection port 57 from the outside comes in contact with the inner circumferential surface of the connection port 57 in the front and rear directions. A sealing portion 91 having a ring shape surrounding the connection port 57 bulges from the main rear wall 49*a* in the circumference of the connection port 57. In addition, the end surface of the sealing portion 91 forms a flat and smooth surface shape parallel to the main rear wall 49*a*.

A connection terminal (collector-side connection terminal) 59 of a circuit board (not shown) storing various kinds of information on the capacity or the like of the waste ink tank 27 is attached to the outside surface of the sub left wall 50*b*. When the waste ink tank 27 is mounted on the mount location 31 of the printer 11, as shown in FIG. 2, a plane-shaped contact surface 59*a* of the connection terminal 59 comes in contact with the connection surface of a connection terminal (device-side connection terminal) 87 (see FIG. 7 to FIGS. 9A and 9B) provided in the tube support mechanism 28 on the side of the printer 11, as indicated by two-dot chain line in FIG. 6A. When both the connection terminals 59 and 87 are appropriately connected to each other, various information (for example, information on a use start date of the waste ink tank 27, the number of times of cleaning, an integration value of a discharge amount of waste ink, and the like) on the waste ink are exchanged between the circuit board on the side of the waste ink tank 27 and a control unit (not shown) of the printer 11.

In the waste ink tank 27, as shown in FIGS. 3, 5, and 6A, the connection terminal 59 is not formed on the main rear wall 49*a* on which the connection port 57 is formed, but formed at a location lower than the locations of the connection port 57 and the cylinder portion 58 (the long hole 58*a*) on the sub left wall 50*b* formed perpendicularly to the main rear wall 49*a*. That is, in the container member 44 having the box-like shape which has the bottom portion, the connection terminal 59 is not formed at an upper side location in which deformation is easily caused when a stress is applied and which is closer to the upper opening 48, but formed at a lower side location in which rigidity is relatively high and deformation is difficult due to closeness to the bottom portion and at a location which is not formed immediately below the connection port 57.

As shown in FIG. 6A, the connection terminal 59 is provided at the lower location of the sub left wall 50*b* so that the contact surface 59*a* is not perpendicular to a straight line L extending in a radial direction oriented from the center 57*a* of the connection port 57 to the oblique downward side when the main rear wall 49*a* is viewed from the front side. That is, the connection terminal 59 is provided so that the contact surface 59*a* extends along the vertical plane and in the front and rear directions. In the waste ink tank 27, as shown in FIG. 5, the connection terminal 59 is provided at a location between the connection port 57 and the cylinder portion 58 (the long hole 58*a*) in the front and rear directions.

A locked step 60 as an engagement portion which makes concave and convex engagement in the front and rear directions with the locking step 40 formed on the bottom wall 32 of the housing 26 is formed at a location closer to the rear end than the front end of the outside bottom surface of the container member 44 so as to extend in the right and left directions. In the container member 44, as shown in FIGS. 2 to FIG. 5, a convex portion 92 having a rectangular parallelepiped shape protrudes from a left end location of the lower front end toward the front side. On the other hand, a protrusion 93 as a displacement regulating unit is formed as a member corresponding to the convex portion 92 on the side of the rear surface of the opening door 36 which is provided in the mounting/detaching port 34 of the receiving chamber 30 in the printer 11 so as to be opened or closed. In addition, when the waste ink tank 27 is mounted on the mount location 31 inside the receiving chamber 30 and the opening door 36 is closed, the protrusion 93 becomes a location regulation state where the protrusion 93 is located above the convex portion 92 of the waste ink tank 27 with a slight clearance interposed therebetween. On the other hand, when the opening door 36 is opened, the protrusion 93 becomes a location non-regulation state where the protrusion 93 is spaced from the regulation location.

In the upper front end of the container member 44, as shown in FIG. 5, a gripping portion 94 gripped when a user mounts or detaches the waste ink tank 27 is formed in a cross-sectional L shape in which the front end is curved downward. That is, the gripping portion 94 is formed like cutting the lower portion of the front surface of the container member 44 from a midway point in the upper and lower directions in an inward direction (the rear side in this case) of the container member 44, thereby having a shape which can be easily gripped by the fingers of the user. In addition, the convex portion 92 described above is formed on the left side of both sides of the cut concave portion.

As shown in FIG. 3, the ink absorbing members 45*a* to 45*d* are formed so that a lowermost first ink absorbing member 45*a* has the same thickness of that of an uppermost fourth ink absorbing member 45*d* and a second ink absorbing member 45*b* on a second layer from the downward side has the same thickness as that of a third ink absorbing member 45*c* on a third layer from the downward side. In each of the second ink absorbing member 45*b* and the third ink absorbing member 45*c*, a through-hole 61 having a square shape is formed at a location closer to the rear side than the center portion. In the third ink absorbing member 45*c*, a cut-in groove 62 serving as a connection portion and a guide unit having a predetermined width and is cut in the front and rear directions from the rear end edge to the through-hole 61. In each of the fourth ink absorbing member 45*d* and the second ink absorbing member 45*b*, no cut-in groove is formed at a location corresponding to the cut-in groove 62 of the third ink absorbing member 45*c*. In addition, when the fourth ink absorbing member 45*d* and the second ink absorbing member 45*b* are received in the reception space 47 of the container member 44 in a lamination state where the third ink absorbing member 45*c* is interposed therebetween from both the upper and lower sides, the cut-in groove 62 of the third ink absorbing member 45*c* is blocked from both the upper and lower sides.

As shown in FIG. 4, the groove width of the rear end portion of the cut-in groove 62 is configured as a broader groove corresponding to an arrangement distance between the pair of ribs 52 which are formed on the inner wall surface of the rear wall 49 of the container member 44 so as to interpose the connection port 57 from the both right and left sides. However, the groove width of the front end portion close to the through-hole 61 is narrower than the groove width of the rear end portion. A tapered portion 95 which is broader toward the rear end portion is formed at a connection location between the front end groove having the narrower width and the rear end groove having the broader width.

Next, the tube supporting mechanism 28 will be described.

As shown in FIG. 7 and FIGS. 8A and 8B, the tube supporting mechanism 28 includes a base body 63 in which a front end distance between both the right and left walls having a rectangular shape is the same and which having a substantial ⊃-shape in plan view connected to a front wall having a rectangular shape. A horizontal plate 64 having a rectangular plate shape extends frontward from the lower front end of the base body 63. Right and left screw holes 65 are formed in the horizontal plate 64. The base body 63 is fixed to the rear step surface 39 in the bottom wall 32 of the housing 26 by screw-connecting setscrews 66 to the screw holes 65 of the horizontal plate 64, respectively.

As shown in FIG. 7, plural through-holes 67, 68, and 69 (three through-holes in this embodiment) are formed in the front wall of the base body 63 so as to extend in the upper and lower directions. Among the through-holes 67 to 69, the central through-hole 68 has the height to be arranged coaxially with the connection port 57 of the waste ink tank 27 mounted on the mount location 31 of the receiving chamber 30, when the base body 63 is fixed onto the rear step surface 39 of the bottom wall 32 of the housing 26. An inward flanges 70 (see FIGS. 8A and 8B) is formed at an intermediate location in an axial direction of the inner circumferential surface of each of the upper through-hole 67 and the lower through-hole 69. In addition, in the base body 63, a substantially U-shaped tube fixing portion 71 through which the flexible tube 43 is inserted to be supported is formed in the intermediate portion of the upper end of the front wall.

As shown in FIG. 7 and FIGS. 8A and 8B, a support member 72 for supporting the flexible tube 43 in a straight shape is assembled with the front surface of the base body 63. The support member 72 is a resin molded product having rigidity, including a cylindrical body 73 as a main body which can be inserted into and extracted from the connection port 57 of the waste ink tank 27, and having a predetermined length in the front and rear directions. A brim portion 74 having a rectangular plate shape is integrally formed at a location on the slight rear side (base end side) from the intermediate location in an axial direction of the cylindrical body 73. In the support member 72, a base end cylindrical portion (second support member) 75 protruding more rearward than the brim portion 74 of the cylindrical body 73 has an outer diameter smaller than the hole diameter of the intermediate through-hole 68 of the base body 63 and an inner diameter into which the flexible tube 43 can be inserted.

On the other hand, in the support member 72, a circular mounted portion 96 having a diameter slightly larger than the outer diameter of the sealing portion 91 of the waste ink tank 27 bulges from the front surface of the brim portion 74 so as to be arranged coaxially with the cylindrical body 73. A cylinder-shaped portion of the support member 72 protruding more frontward than the circular mounted portion 96 of the brim portion 74 of the cylindrical body 73 is formed as a discharge unit 97 which is inserted to support the downstream end side of the flexible tube 43 inside the connection port 57 in order to discharge the waste ink into the waste ink tank 27, when the waste ink tank 27 is mounted on the mount location 31.

In the discharge unit 97, the base end joined to the circular mounted portion 96 is formed as a fitting cylindrical portion 98 of which an inner diameter and an outer diameter are the same in an inside deep portion of the connection port 57 of the waste ink tank 27. In a portion having a predetermined length and serving as the second support member formed more frontward (on front end side) than the fitting cylindrical portion 98, the outer diameter of the portion is slightly smaller than the width in the right and left directions of the cut-in groove 62 of the third ink absorbing member 45*c* received inside the waste ink tank 27 and the length of the portion is substantially equal to a distance from the rear end edge of the third ink absorbing member 45*c* to a substantial center of the through-hole 61. In the discharge unit 97 of the cylindrical body 73, a portion having a predetermined length on the front end side than the fitting cylindrical portion 98 is formed as a non-cylindrical portion 77 in which the circumferential wall of the relatively long cylindrical shape formed from a front end cylindrical portion 76 to the rear-side fitting cylindrical portion 98 is cut by the about half, excluding the front end cylindrical portion 76 which is relatively short and has a cylindrical shape in order to inward fit with the front end serving as a downstream end of the flexible tube 43. In addition, on the inside surface of the non-cylindrical portion 77, a pair of insertion claws (fixing portions) 78 protrude at each of plural locations (three locations in this embodiment) in an axial direction of the cylindrical body 73 so that a distance with the pair of insertion claws 78 facing each other is slightly smaller than the outer diameter of the flexible tube 43.

In the support member 72, when the base end cylindrical portion 75 in the cylindrical body 73 is loosely inserted into the intermediate through-hole 68 of the base body 63, the portion having the predetermined length on the front end side including the front end (downstream end) in the flexible tube 43 inserted from the base end side opening of the base end cylindrical portion 75 is supported by the front end cylindrical portion 76 and the non-cylindrical portion 77. That is, the front end cylindrical portion 76 in the cylindrical body 73 supports the front end of the flexible tube 43 in the fitting state in that the inner diameter of the front end cylindrical portion 76 is the same as the outer diameter of the flexible tube 43. In addition, the non-cylindrical portion 77 fixes the flexible tube 43 by inserting the flexible tube 43 from the side so that the fixing claws 78 fix the plural locations (three locations in this embodiment) of the portion from the front end to the base end of the flexible tube 43. Accordingly, the portion having the predetermined length on the front end side in the flexible tube 43 is supported by the cylindrical body 73 of the support member 72 so as to extend in a direction in which the front end of the flexible tube 43 is oriented.

When the discharge unit 97 of the cylindrical body 73 in the support member 72 supporting the flexible tube 43 is inserted into the container member 44 from the connection port 57 of the waste ink tank 27, as indicated by two-dot chain line in FIG. 4, the waste ink is discharged into the through-holes 61 formed in the second ink absorbing member 45*b* and the third ink absorbing member 45*c* from a front end opening 76*a* of the front end cylindrical portion 76 of the cylindrical body 73. Accordingly, in this embodiment, the front end opening 76*a* of the front end cylindrical portion 76 in the discharge unit 97 of the support member 72 supporting the flexible tube 43 forms a discharge port for discharging the waste ink.

In this embodiment, as shown in FIG. 4, when the discharge unit 97 of the cylindrical body 73 is inserted into the container member 44 from the connection port 57 of the waste ink tank 27, a distance Y between the front end opening 76*a* and an air communication hole 90 is configured to be longer than a distance X between the front end opening 76*a* as the discharge port of the discharge unit 97 and the connection port 57. In addition, after the waste ink discharged from the front end opening 76*a* is absorbed by the ink absorbing members 45*a* to 45*d* and the waste ink soaks and spreads in the ink absorbing members 45*a* to 45*d*, an ink solvent gasifies. Then, the ink solvent evaporates from the air communication hole 90 of the film member 46 to the outside.

A pin 85 as a counter member which can be inserted into or extracted from the long hole 58*a* of the cylinder portion 58 of the waste ink tank 27 protrudes toward the front side in the left edge of the front surface of the brim portion 74 of the support member 72. Likewise, a vertical plate portion 86 having a rectangular plate shape protrudes in the left edge of the front surface of the brim portion 74 toward the front side from a location below the pin 85. A connection terminal 87 (device-side connection terminal) corresponding to the connection terminal 59 formed on the sub left wall 50*b* of the waste ink tank 27 is mounted on one surface (right surface) of the vertical plate portion 86. The connection terminal 87 is connected to the control unit (not shown) of the printer 11 with a harness (not shown) interposed therebetween.

On the other hand, a pair of upper and lower cylinders 79 formed so as to be respectively inserted into the upper through-hole 67 and the lower through-hole 69 of the base body 63 bulge in parallel toward the rear side from two upper and lower locations of the base end cylindrical portion 75 in the rear surface of the brim portion 74 of the support member 72. In addition, the upper and lower cylinders 79 are respectively inserted into the upper through-hole 67 and the lower through-hole 69 of the base body 63 in a state where the cylinders 79 are put into coil springs 80 serving as an urging unit against each circumferential surface. In this case, the front ends of the coil springs 80 come in contact with the rear surface of the brim portion 74 of the support member 72. In addition, the rear ends of the coil springs 80 come in contact with the flanges 70 respectively formed at the midway locations of the inner circumferential surfaces of the upper through-hole 67 and the lower through-hole 69, respectively. A screw holes (not shown) is formed on the front end surface of each of the cylinders 79.

As shown in FIG. 7 and FIGS. 8A and 8B, an assemble plate 81 for assembling the support member 72 to the base body 63 is disposed on the rear surface of the base body 63. The assembly plate 81 has a rectangular plate shape coming in contact with the rear surface of the front wall when the assembly plate 81 is disposed between both the right and left walls of the base body 63 having the substantial ⊃-shape in plan view. A through-hole 82 corresponding to the intermediate through-hole 68 of the base body 63 is formed in the substantial center of the assembly plate 81. Screw insertion holes 83 are formed at two locations which correspond to the upper though-hole 67 and the lower through-hole 69 of the base body 63 in upper and lower portions of the through-hole 82 in the assembly plate 81. In addition, the assembly plate 81 is screw-fixed by setscrews 84 inserted through the screw insertion holes 83 into the cylinders 79 of the support member 72 of which the front ends protrude from the upper through-hole 67 and the lower through-hole 69 of the base body 63 toward the rear side.

Next, operations of the waste ink collecting system 29 having the above-described configuration and the printer 11 will be described below.

First, a method of forming a liquid passage when the liquid passage is formed by supporting the flexible tube 43 discharging the waste ink into the waste ink tank 27 by the tube support mechanism 28 in the waste ink collecting system 29 will be described.

Here, when the liquid passage for discharging ink (liquid) ejected as waste ink (waste liquid) from the print head 21 into the waste ink tank 27 is formed, the base body 63 in the tube support mechanism 28 is first fixed onto the rear step surface 39 inside the receiving chamber 30 by the setscrews 66. Then, after the front end (downstream end) of the flexible tube 43, of which the base end (upstream end) is connected to the cap 25, is inserted into the through-hole 82 of the assembly plate 81 from the rear side, the front end of the flexible tube 43 is also inserted into the intermediate through-hole 68 of the base body 63 from the rear side and the front end of the flexible tube 43 is extracted toward to the front side from the intermediate through-hole 68 to some extent.

Subsequently, the front end of the flexible tube 43 extracted toward the front side from the intermediate through-hole 68 of the base body 63 is inserted into the cylindrical body 73 of the support member 72 which is not assembled to the base body 63. That is, the front end of the flexible tube 43 is inserted into the base end cylindrical portion 75 of the cylindrical body 73. Likewise, the front end of the inserted flexible tube 43 is extracted from the non-cylindrical portion 77 of the front end cylindrical portion 76 of the cylindrical body 73 to the outside for the moment.

Then, a portion having a predetermined length on the front end side of the flexible tube 43 is loosened to some extent so as to easily grip the portion having the predetermined length in the outside of the non-cylindrical portion 77. In this state, the front end of the flexible tube 43 is inserted into the front end cylindrical portion 76 of the cylindrical body 73 from the rear side (base end side). At this time, the front end of the flexible tube 43 is locationally matched with the front end of the front end cylindrical portion 76 of the cylindrical body 73 in the front and rear directions. Then, the flexible tube 43 is fitted and supported by the front end cylindrical portion 76 in a stable state.

Subsequently, the base end side of the flexible tube 43 is pulled from the base end cylindrical portion 75 of the cylindrical body 73 in an extraction direction and the loosened portion of the flexible tube 43 formed outside the side of the non-cylindrical portion 77 is removed. The portion having the predetermined length on the front end side of the flexible tube 43 of which the loosened state is removed is pressed sequentially from the front end side against the inner surface of the non-cylindrical portion 77 to be pushed between the insertion claws 78 facing each other. Then, the flexible tube 43 is fixed by the insertion claws 78 to become a stably supported state so that the portion having the predetermined length on the front end side is expanded in a substantial straight shape along the non-cylindrical portion 77.

In this way, the flexible tube 43 is supported by the support member 72. Subsequently, the support member 72 which has supported the flexible tube 43 in the above-described manner is assembled to the base body 63. That is, the base end cylindrical portion 75 of the cylindrical body 73 is loosely inserted into the intermediate through-hole 68 of the base body 63 inserted into the base end side of the flexible tube 43. In addition, the cylinders 79 protruding from the brim portion 74 of the support member 72 toward the rear side are inserted into the upper through-hole 67 and the lower-through-hole 69 of the base body 63, respectively. At this time, the coil spring 80 is inserted in advance into each of the cylinders 79.

Then, the coil springs 80 through which the cylinders 79 are respectively inserted are respectively interposed between the rear surface of the brim portion 74 and the flanges 70 of the upper through-hole 67 and the lower through-hole 69 to be slightly contracted. In addition, the front ends of the cylinders 79 protrude from the through-holes 67 and 69 toward the rear side, respectively. The assembly plate 81 is brought into contact with the front ends of the cylinders 79 of which the heads respectively protrude from the through-holes 67 and 69, while locationally matched to the screw insertion holes 83. Then, the assembly plate 81 is screw-fixed by the setscrews 84. Subsequently, the midway portion on the base end side of the flexible tube 43 extracted from the through-hole 82 of the assembly plate 81 toward the rear side is fixed by the tube fixing portion 71 formed in the upper portion of the base body 63.

In this way, the flexible tube 43 is supported by the tube support mechanism 28. As shown in FIGS. 2 and 8A, the tube support mechanism 28 is installed below the cap 25 in the home position HP, while supporting the flexible tube 43 in a state where the flexible tube 43 is oriented toward the front side in which the mount location 31 of the waste ink tank 27 is positioned. In this installation state, in order for the coil springs 80 through which the cylinders 79 of the support member 72 are inserted to maintain the slightly contracted state and press the brim portion 74 toward the front side by the contracted press force, the support member 72 is movably maintained in the front and rear directions in a state where the cylindrical body 73 is oriented toward the front side.

The support member 72 of the tube support mechanism 28 is in an urged state toward the front side by an urging force of the coil springs 80, since the coil springs 80 respectively inserted through the cylinders 79 are respectively inserted are in the slightly contracted state. Accordingly, when a press force is further applied to the brim portion 74 of the support member 72 from the front side to the rear side, the brim portion 74 receives the press force and is retreated toward the rear side. Therefore, as shown in FIG. 8B, the support member 72 is retreated toward the rear side in the state where the support member 72 supports the assembly plate 81 and the flexible tube 43, while further contracting the coil springs 80.

In the support member 72 of the tube support mechanism 28, the base end cylindrical portion 75 of cylindrical body 73 and the cylinders 79 protruding from the brim portion 74 toward the rear side are loosely inserted into the through-holes 67, 68, and 69 of the base body 63, respectively, so that a clearance is present in a diametric direction. Accordingly, when an external force is applied to the cylindrical body 73 (particularly, the front end cylindrical portion 76) of the support member 72 from a direction intersecting the axial direction of the cylindrical body 73, the support member 72 receiving the external force is pivoted on a point on the base end side (specifically, a point coming in contact with the flange 70 in the cylinder 79).

That is, when the external force oriented from the downward side to the upward side is applied to the front end cylindrical portion 76 of the cylindrical body 73, the support member 72 is pivoted so that the front end cylindrical portion 76 of the cylindrical body 73 is moved upward, as shown in FIG. 9A. On the other hand, when the external force oriented from the upward side to the downward side is applied to the front end cylindrical portion 76 of the cylindrical body 73, the support member 72 is pivoted so that the front end cylindrical portion 76 of the cylindrical body 73 is moved downward, as shown in FIG. 9B. Even though not shown, when the external force is applied to the front end cylindrical portion 76 of the cylindrical body 73 from the right and left directions, the support member 72 is pivoted so that the front end cylindrical portion 76 of the cylindrical body 73 is moved in the right and left directions. In this way, the support member 72 supporting the flexible tube 43 in the tube support mechanism 28 has a configuration in which the front end is pivotable on the point on the base end side.

Next, a method of mounting or detaching the waste ink tank 27 on or from the mount location 31 formed inside the receiving chamber 30 of the housing 26 of the printer 11 will be described.

When the waste ink tank 27 is mounted on the mount location 31 inside the receiving chamber 30, the opening door 36 on the front side of the housing 26 is first opened. Subsequently, the waste ink tank 27 is inserted into the opened mounting/detaching port 34 from the rear end side on which the connection port 57 is formed, and then the waste ink tank 27 is moved toward the rear side which is the mount direction in which the waste ink tank 27 is mounted on the mount location 31. As shown in FIG. 10, in the waste ink tank 27, the front end cylindrical portion 76 of the cylindrical body 73 of the support member 72 in the tube support mechanism 28 is inserted into the connection port 57 of the main rear wall 49*a* in a previous step in which the entire waste ink tank 27 is inserted inside the receiving chamber 30.

Here, when the waste ink tank 27 is moved up to the inside deep portion of the receiving chamber 30 through the mounting/detaching port 34, the gripping portion 94 in the front end of the waste ink tank 27 is gripped by the user of the printer 11 and the waste ink tank 27 is moved in the mount direction manually by the user. Accordingly, when the gripping portion 94 in the front end of the waste ink tank 27 is gripped by the user, the container member 44 rarely maintains a horizontal state in its posture in the previous step in which the entire waste ink tank 27 is inserted inside the receiving chamber 30. Instead, as shown in FIG. 10, the container member 44 is normally slanted in its posture so that the rear end of the waste ink tank 27 is lower than the front end. Accordingly, in a case where the cylindrical body 73 of the support member 72 of the tube support mechanism 28 is fixed in a horizontally oriented state, it is difficult to insert the front end cylindrical portion 76 of the cylindrical body 73 up to the inside deep portion of the connection port 57 of the waste ink tank 27 moved in the mount direction in the slanted state.

However, the tube support mechanism 28 according to this embodiment has the configuration in which the front end of the support member 72 is pivotable on the point on the base end side. With such a configuration, when the front end cylindrical portion 76 of the cylindrical body 73 is inserted into the connection port 57 of the waste ink tank 27 moved in the state where the waste ink tank 27 is slanted in its posture, the front end of the support member 72 of the tube support mechanism 28 is pivoted so as to correspond to the slant. Accordingly, the front end cylindrical portion 76 of the cylindrical body 73 in the support member 72 is inserted up to the inside deep portion of the connection port 57 of the waste ink tank 27 without any problem.

The support member 72 of the tube support mechanism 28 may be locationally deviated from the center 57*a* of the connection port 57, when the front end cylindrical portion 76 of the cylindrical body 73 is inserted into the connection port 57 of the waste ink tank 27. In this embodiment, however, the inner circumferential surface of the connection port 57 in the waste ink tank 27 is configured as the tapered surface which the diameter is smaller as getting deeper to the inside portion of the connection port 57. Therefore, the cylindrical body 73 of the support member 72 is slidably guided toward the center 57*a* of the connection port 57, when the cylindrical body 73 is inserted into the connection port 57. In consequence, in the cylindrical body 73 of the support member 72, the front end cylindrical portion 76 is smoothly inserted into the cut-in groove 62 of the third absorbing member 45*c* disposed so as to correspond to the location of the connection port 57 in the waste ink tank 27.

In the cut-in groove 62, the tapered portion 95 of which the width is narrower toward the front end is formed on the rear end which is the connection port 57 and the groove width of a portion in the front end of the tapered portion 95 is slightly larger than the outer diameter of the discharge unit 97. The thickness of the third ink absorbing member 45*c* provided with the cut-in groove 62 is slightly larger than the outer diameter of the discharge unit 97. Accordingly, in the discharge unit 97, when the front end cylindrical portion 76 is inserted into the cut-in groove 62, the front end cylindrical portion 76 is slidably guided by the right and left inner groove surfaces of the cut-in groove 62 including the tapered portion 95 in the third ink absorbing member 45*c* and by the lower surface of the fourth ink absorbing member 45*d* and the upper surface of the second ink absorbing member 45*b* blocking the cut-in groove 62 from both the upper and lower sides so that the insertion direction becomes a direction (predetermined direction) oriented toward the through-hole 61.

When the waste ink tank 27 is further moved toward the inside deep portion of the receiving chamber 30 in the state shown in FIG. 10, the rear wall 49 (specifically, the end surface of the sealing portion 91) of the waste ink tank 27 comes in contact with the brim portion 74 (specifically, the circular mounted portion 96) of the support member 72. In addition, the front end cylindrical portion 76 of the cylindrical body 73 of the support member 72 reaches the location of the through-hole 61 formed in the third ink absorbing member 45*c*. In this case, when the sealing portion 91 of the rear wall 49 of the waste ink tank 27 comes in contact with the circular mounted portion 96 of the brim portion 74 of the support member 72, the connection portion 57 is closed and sealed by the circular mounted portion 96. Accordingly, the circular mounted portion 96 serves as a closing unit which closes the connection port 57 as the opening, when the sealing portion 91 comes in contact with the circular mounted portion 96. In addition, since the sealing portion 91 has the ring shape surrounding the connection port 57, a sealing function thereof is easily ensured by bringing the end surface formed as the flat and smooth surface into contact with the facing surface of the flat and smooth surface as in the circular mounted portion 96.

Likewise, when the sealing portion 91 of the rear wall 49 of the waste ink tank 27 comes in contact with the circular mounted portion 96 of the brim portion 74 of the support member 72, the pin 85 protruding from the brim portion 74 of the support member 72 is inserted into the hole 58*a* of the cylinder portion 58 formed on the sub rear wall 49*b* of the waste ink tank 27, and thus the waste ink tank 27 mounted on the mount location 31 is positioned in the upper and lower directions, the right and left directions, and a rotation direction. In this case, the pin 85 and the long hole (positioning unit) 58*a* serve as a maintaining unit which maintains the positioning state so that the movement of the waste ink tank 27 is regulated in the upper and lower directions, the right and left directions, and the rotation direction in the mount location 31.

In particular, When the waste ink tank 27 is mounted on the printer 11, the waste ink tank 27 may be moved toward the mount location 31 of the printer 11 with rotation about the axis of the discharge unit 97 of the cylindrical body 73 inserted into the connection port 57 to be mounted in some cases. Therefore, the connection terminal 59 of the waste ink tank 27 may be locationally deviated from the connection terminal 87 of the printer 11 in the rotation direction in the connection state. In addition, as in a comparative example in FIG. 6B, when the contact surface 59*a* of the connection terminal 59 of the waste ink tank 27 is formed perpendicularly to a straight line L extending in a radial direction from the center 57*a* of the connection port 57, the contact surfaces of the connection terminals 59 and 87 may be deviated from each other in the rotation direction at the time of rotating the waste ink tank 27, thereby impairing the contact surfaces and causing connection failure.

In order to solve this problem, as shown in FIG. 6A, the contact surface 59*a* of the connection terminal 59 of the waste ink tank 27 according to this embodiment is formed perpendicularly to the straight line L extending toward the radial direction from the center 57*a* of the connection port 57. Therefore, the contact surfaces of both the connection terminals 59 and 87 are not deviated from each other in the rotation direction in the connection, when the waste ink tank 27 is rotated. That is, in FIG. 6A, when the waste ink tank 27 is rotated clockwise, the connection terminal 59 of the waste ink tank 27 is moved so that the contact surface 59*a* becomes away from the connection terminal 87 of the printer 11. On the contrary, in FIG. 6A, when the waste ink tank 27 is rotated counterclockwise, the connection terminal 59 of the waste ink tank 27 is moved in a direction in which the contact surface 59*a* is pressed against the connection terminal 87 of the printer 11.

In this case, the long hole 58*a* as the positioning unit serves as a contact portion for regulating the rotation of the waste ink tank 27 by bringing an inner circumferential surface 99 into contact with the pin 85. That is, the long hole 58*a* regulates the counterclockwise rotation by which the connection terminal 59 of the waste ink tank 27 is spaced from the connection terminal 87 of the printer 11, by bringing the upper inner surface of the inner circumferential surface 99 into contact with the pin 85. On the other hand, the long hole 58*a* regulates the clockwise rotation of the waste ink tank 27, by bringing the lower inner surface of the inner circumferential surface 99 into contact with the pin 85.

With such a configuration, even when the waste ink tank 27 is moved and mounted on the mount location 31 of the printer 11 with the rotation about the axis of the discharge unit 97 of the cylindrical body 73 inserted into the connection port 57, the contact surface 59*a* of the connection terminal 59 is not deviated from the connection terminal 87 of the printer 11 in the rotation direction in the connection. When the pin 85 is inserted into the long hole 58*a*, the upper and lower inner surfaces of the inner circumferential surface 99 of the long hole 58*a* come into contact with the pin 85, and thus the rotation stops. Therefore, the location is determined at the rotation location at which the contact surfaces of both the connection terminals 59 and 87 appropriately come in contact with each other.

When the waste ink tank 27 is further pushed toward the rear side to press the brim portion 74 of the support member 72 in this state, the support member 72 is retreated while further contracting the coil springs 80. When the support member 72 is retreated up to a location where the brim portion 74 is closest to the front wall of the base body 63, as shown in FIG. 11, the waste ink tank 27 is horizontally maintained in its posture and the bottom surface of the container member 44 of the waste ink tank 27 is brought into contact with the intermediate step surface 38 forming a part of the mount location 31 in the receiving chamber 30. At this time, the locked step

60 formed on the bottom surface of the container member 44 of the waste ink tank 27 is located in an inside deeper portion of the receiving chamber 30 than the locking step 40 formed in the mount location 31 inside the receiving chamber 30. In other words, the waste ink tank 27 is outside the mount location 31 inside the receiving chamber 30 in the mount direction at this time. That is, the locked step 60 of the waste ink tank 27 does not engage with the locking step 40 of the printer 11 at the time of moving the waste ink tank 27 the mount direction.

When a force (for example, a force of the fingers of a user) applied to move the waste ink tank 27 in the mount direction is released in the state shown in FIG. 11, the waste ink tank 27 is pressed in the front direction (that is, the detachment direction of the waste ink tank 27) by the brim portion 74. That is because the brim portion 74 of the support member 72 is advanced by the urging force of the contracted coil springs 80. That is, the brim portion 74 of the support member 72 serves as a pressing unit using the urging force of the coil springs 80 as a pressing force and the rear wall 49 of the container member 44 serves as a pressed unit. The brim portion 74 presses the waste ink tank 27. In addition, the waste ink tank 27 receiving this pressing force is slidably moved on the intermediate step 38 of the mount location 31 toward the front side. As shown in FIG. 2, the locked step 60 of the container member 44 locks with the locking step 40 of the mount location 31. That is, The locking step 40 which cannot lock with the locked step 60 at the time of moving the waste ink tank 27 to the locked step 60 of the container member 44 in the mount direction reverse to the detachment direction serves as a locking unit which performs the locking to regulate the movement of the waste ink tank 27 in the detachment direction from the detachment direction at the time of slidably moving the waste ink tank 27 in the detachment direction.

Accordingly, the waste ink tank 27 receives the urging force of the coil springs 80 from the rear side through the brim portion 74 of the support member 72 and the locking step 40 of the mount location 31 locks with the locked step 60 of the bottom surface of the container member 44 from the front side. Accordingly, as shown in FIG. 2, the waste ink tank 27 is positioned at the mount location 31 inside the receiving chamber 30 so as not to be moved in the front and rear direction. With such a configuration, the coil springs 80 as the urging unit and the locking step 40 as the locking unit serve as a maintaining unit which maintains the waste ink tank 27 so as to be positioned at the mount location 31. When the opening door 36 of the mounting/detaching port 34 is returned to the closing location, the mounting of the waste ink tank 27 on the mount location 31 ends.

Since the opening door 36 of the mounting/detaching port 34 is positioned at the closing location in the mount state shown in FIG. 2, the protrusion 93 on the rear surface of the opening door 36 is in a location regulation state close to the convex portion 92 of the front end of the waste ink tank 27. Accordingly, even though the waste ink tank 27 is displaced upward with application of an impact from the outside in a case of carrying the printer 11, the protrusion 93 of the opening door 36 comes in contact with the convex portion 92 of the waste ink tank 27 and thus regulates the upward displacement. Accordingly, the locked step 60 of the waste ink tank 27 does not disengage from the locking step 40 formed at the mount location 31 of the printer 11.

When the cap 25 moves up by drive of the elevation mechanism (not shown) and comes in contact with the nozzle formation surface 21*a* of the print head 21 in the state shown in FIG. 2 and then the sucking pump 42 is driven, the thickened ink in the print head 21 due to negative pressure generated in the cap 25 is forcedly discharged (ejected) as the waste ink into the cap 25 through nozzle openings (not shown). When the inside of the cap 25 becomes an air sucking state where air is sucked by air opening in a state where the sucking pump 42 continues to be driven, the waste ink is guided from the inside of the cap 25 to the downstream end which is the front end of the flexible tube 43 to be discharged into the waste ink tank 27.

In this case, the front end opening 76*a* of the discharge unit 97 extends from the connection port 57 of the waste ink tank 27 to the through-hole 61 of the third ink absorbing member 45*c*. The through-hole 61 of the second ink absorbing member 45*b* is disposed below the through-hole 61 of the third ink absorbing member 45*c*. The fourth ink absorbing member 45*d* and the first ink absorbing member 45*a* are disposed so as to block the upper and lower portions of the two through-holes 61, respectively. In addition, much waste ink discharged into the through-holes 61 is absorbed gradually into the inside from the upper surface of the first ink absorbing member 45*a* located below the through-hole 61 and soaks into the entire first ink absorbing member 45*a*. The waste ink further soaks into the other ink absorbing members 45*b* to 45*d* and spreads inside the ink absorbing members 45*a* to 45*d* to be satisfactorily absorbed and maintained. Some of waste ink is absorbed into the inside of the ink absorbing members 45*a* to 45*d* from the side surface or the upper surface of the through-holes 61.

Accordingly, in the ink absorbing members 45*a* to 45*d*, a location near the through-holes 61 to which the waste ink is discharged from the front end opening 76*a* of the discharge unit 97 is a location where the waste ink is absorbed most. On the other hand, in the ink absorbing members 45*a* to 45*d*, the fourth ink absorbing member 45*d* into which the waste ink is discharged from the front end opening 76*a* of the discharge unit 97 soaks least is a location where an amount of absorbed ink is the least. In general, the waste ink absorbed by the ink absorbing members 45*a* to 45*d* has a property in which the waste ink is easy to be soaked and spread from the location where the amount of absorbed amount is much to the location where the amount of absorbed amount is less.

The air communication hole 90 formed in the film member 46 sealing the upper opening 48 of the container member 44 in the waste ink tank 27 according to this embodiment is configured to be located on the front end side than the center portion of the container member 44. That is, as shown in FIG. 4, the distance Y between the front end opening 76*a* and the air communication hole 90 is configured to be longer than the distance X between the front end opening (discharge port) 76*a* of the discharge unit 97 discharging the waste ink and the connection port 57. The air communication hole 90 is located above the upper surface of the fourth ink absorbing member 45*d* located uppermost among the ink absorbing members 45*a* to 45*d*. Accordingly, after the waste ink soaks up to a location which gets away from the front end opening 76*a* in the front and rear direction and soaks up to the uppermost absorbing member 45*d* in the upper and lower directions, that is, the waste ink spreads to the whole of the ink absorbing members 45*a* to 45*d*, the waste ink evaporates from the upper surface of the uppermost ink absorbing member 45*d*.

Accordingly, since the waste ink evaporates from the ink absorbing members 45*a* to 45*d* during the soaking, the waste ink can soak into the broad range without clogging the ink absorbing members 45*a* to 45*d*. Therefore, it is possible to discharge more amount of waste ink. Gasification of the ink solvent of the waste ink is accelerated from the spread area extending the broad range, thereby accelerating dryness of the ink absorbing members 45*a* to 45*d*. In addition, since the location of the front end opening 76*a* is a location where the waste ink is discharged, the distance X may be set as a distance between the through-hole 61 as a waste liquid receiver for receiving the waste ink and the connection port 57 or the distance Y may be set as a distance between the through-hole 61 and the air communication hole 90.

On the other hand, as shown in FIG. 2, the waste ink tank 27 mounted on the mount location 31 inside the receiving chamber 30 is detached from the printer 11, the opening door 36 of the mounting/detaching port 34 is opened again. Then, the protrusion 93 on the rear surface of the opening door 36 becomes a location non-regulation state where the protrusion 93 gets away from the regulation location where the waste ink tank 27 is close to the convex portion 92 and permits the upward displacement of the waste ink tank 27. When the user of the printer 11 puts hands inside the mounting/detaching port 34, grips the gripping portion 94 on the front end of the waste ink tank 27, raises the front end of the waste ink tank 27 upward to slant the waste ink tank 27 in its posture, the locking state of the locking step 40 and the locked step 60 is released. In this state, since the urging force of the coil springs 80 becomes the pressing force through the brim portion 74 of the support member 72 in the waste ink tank 27 and is applied in the detachment direction (front side), the urging force (pressing force) helps movement in the detachment direction. Accordingly, the waste ink tank 27 is easily detached from the mounting/detaching port 34.

In this case, when the discharge unit 97 of the cylindrical body 73 in the support member 72 is extracted from the connection port 57 of the waste ink tank 27, the right and left inner groove surfaces of the cut-in groove 62 of the third ink absorbing member 45*c* and the lower surface of the fourth ink absorbing member 45*d* and the upper surface of the second ink absorbing member 45*b* blocking the cut-in groove 62 from both the upper and lower sides function as a contact unit, and contact with the cylindrical portion located on the front end side than the fitting cylindrical portion 98 in the discharge unit 97 to remove the waste ink. In particular, when the waste ink tank 27 in a state where the absorption capability of the ink absorbing members 45*a* to 45*d* reaches the limit is detached, the ink absorbing members 45*a* to 45*d* are swollen by the absorbed waste ink. Accordingly, in the swollen third ink absorbing member 45*c*, the right and left groove widths of the cut-in groove 62 are narrowed. In the swollen fourth ink absorbing member 45*d* and second ink absorbing member 45*b*, a distance (that is, a groove height) of the lower surface and the upper surface facing each other to block the cut-in groove 62 of the third ink absorbing member 45*c* from both the upper and lower sides is narrowed. Accordingly, since a contact pressure of the right and left inner groove surfaces of the cut-in groove 62 of the third ink absorbing member 45*c*, the lower surface of the fourth ink absorbing member 45*d*, and the upper surface of the second ink absorbing member 45*b* against the discharge unit 97 becomes more strong, the waste ink attached to the discharge unit 97 is surely removed.

On the other hand, when the waste ink tank 27 in which the amount of absorbed waste ink of the ink absorbing members 45*a* to 45*d* is small is detached, the above absorbing members are not swollen. Therefore, the contact pressure of the right and left inner groove surfaces of the cut-in groove 62, the lower surface of the fourth ink absorbing member 45*d*, and the upper surface of the second ink absorbing member 45*b* against the discharge unit 97 is weak. In this case, since the absorption capability of the ink absorbing members 45*a* to 45*d* is still high, the waste ink attached to the discharge unit 97 is easily absorbed into the ink absorbing members 45*a* to 45*d* even with weak contact pressure through the right and left inner groove surfaces of the cut-in groove 62, the lower surface of the fourth ink absorbing member 45*d*, and the upper surface of the second ink absorbing member 45*b*. Accordingly, in the cylindrical portion of the front end than in the fitting cylindrical portion 98 of the discharge unit 97, the attached waste ink is removed by the right and left inner groove surfaces of the cut-in groove 62 of the third ink absorbing member 45*c*, the lower surface of the fourth ink absorbing member 45*d*, and the upper surface of the second ink absorbing member 45*b*, when the discharge unit 97 is extracted from the connection port 57 of the waste ink tank 27. Therefore, the third ink absorbing member 45*c* provided with the cut-in groove 62 functions as a removing unit and the fourth ink absorbing member 45*d* and the second ink absorbing member 45*b* blocking the cut-in groove 62 of the third ink absorbing member 45*c* from the upper and lower sides also function as the removing unit.

After the old waste ink tank 27 is detached, a new waste ink tank 27 is mounted on the mount location 31 inside the receiving chamber 30 in the same manner described above. In this way, since the waste ink tank 27 can be mounted on and detached from the predetermined mount location 31, the old waste ink tank 27 is easily exchanged with the new waste ink tank 27. A main constituent element of the liquid passage guiding the waste ink up to the waste ink tank 27 is the flexible tube 43 having an excellent non-permeable property of a gasified liquid but no rigidity property. However, since the flexible tube 43 is supported in the straight line by the cylindrical body 73 of the support member 72 having a rigidity property and inserted into the connection port 57 of the waste ink tank 27 together with the discharge unit 97 of the cylindrical body 73, the flexible tube 43 can be surely inserted up to the location (the location of the through-holes 61) close to the center of the waste ink tank 27 in which the ink absorbing members 45*a* to 45*d* are received in the laminated manner.

According to this embodiment, advantages described below can be obtained.

(1) In the waste ink tank 27, the discharge unit 97 of the cylindrical body 73 of the support member 72 supporting the portion having the predetermined length on the downstream end side of the flexible tube 43 is inserted into and extracted from the connection port 57 and the connection port 57 is connected to or disconnected from the downstream end of the flexible tube 43 supported by the support member 72, by moving the container member 44 toward the rear side which is the mount direction in which the waste ink tank 27 is mounted on the mount location 31 inside the receiving chamber 30 or the front side which is the detachment direction. With such a configuration, the old waste ink tank 27 can easily be exchanged with the new waste ink tank 27.

(2) When the waste ink tank 27 is mounted on the mount location 31 of the printer 11 and rotated about the axis of the discharge unit 97 while the discharge unit 97 is inserted into the connection port 57 of the waste ink tank 27, the contact surface 59*a* of the connection terminal 59 of the waste ink tank 27 is moved to be close to or away from the connection terminal 87 of the printer 11 in the rotation direction. That is, the contact surfaces of both the connection terminals 59 and 87 are deviated from each other, when the waste ink tank 27 is rotated in the rotation direction in the connection. In addition, when the contact surface 59*a* of the connection terminal 59 is brought into pressing contact with the connection terminal 87 of the printer 11 during the rotation of the waste ink tank 27, it is possible to ensure the connection state where both the connection terminals 59 and 87 are appropriately brought into contact with each other.

(3) The connection terminal 59 of the waste ink tank 27 is provided in the lower portion in which the rigidity is relatively high in the container member 44 which the box-like shape having the bottom portion. Therefore, even when a stress is applied to the container member 44, a problem with the displacement of the connection terminal 59 can be reduced. As a result, it is possible to satisfactorily maintain the appropriate connection state where the connection terminal 59 is connected to the connection terminal 87 of the printer 11.

(4) Since the connection port 57 into which the discharge unit 97 is inserted is located above the connection terminal 59 in the container member 44, the waste ink can be stored up to the height location of the connection port 57. Accordingly, it is possible to improve a storage efficiency of the waste ink in the container member 44.

(5) The connection terminal 59 of the waste ink tank 27 is not located immediately below the connection port 57. Therefore, even when the stored waste ink leaks from the connection port 57 to the inside in the mount state of the printer 11 on the mount location 31, it is possible to prevent the connection terminal 59 from being smeared due to the leaked waste ink.

(6) When the waste ink tank 27 is rotated in the state where the discharge unit 97 is inserted into the connection port 57 at the time of mounting the waste ink tank 27 on the printer 11 and the contact surface 59*a* of the connection terminal 59 comes in contact with the connection terminal 87 of the printer 11, the further rotation of the waste ink tank 27 is regulated by the connection terminal 87 of the printer 11 which serves as a stopper. In addition, when the waste ink tank 27 is moved toward the inside in the mount direction while maintaining the contact state of both the connection terminals 59 and 87, the discharge unit 97 is inserted into the connection port of the waste ink tank 27. In addition, the contact surfaces 57 of both the connection terminals 59 and 87 appropriately come in contact with each other. Accordingly, it is possible to simply and appropriately mount the waste ink tank 27 on the printer 11.

(7) When the waste ink tank 27 is mounted on the mount location 31 of the printer 11 and the waste ink tank 27 is rotated about the axis of the discharge unit 97 while the discharge unit 97 is inserted into the connection port 57, the rotation can be regulated by a simple operation of inserting the pin 85 as the counter member into the long hole 58*a* as the positioning unit. That is, by adjusting the posture of the waste ink tank 27 to insert the pin 85 as the counter member into the long hole 58*a*, it is possible to position and mount the waste ink tank 27 on the mount location 31 in the connection state where the contact surface 59*a* of the connection terminal 59 appropriately comes in contact with the connection terminal 87 of the printer 11.

(8) In this case, since the connection terminal 59 of the waste ink tank 27 regulates the rotation in the direction getting away from the connection terminal 87 of the printer 11 by bringing the upper inner surface of the inner circumferential surface 99 of the long hole 58*a* into contact with the pin 85. Accordingly, it is possible to prevent the waste ink tank 27 from being rotated in a direction in which a failure in contact between both the connection terminals 59 and 87 is caused.

(9) In this case, the inner circumferential surface 99 of the long hole 58*a* into which the pin 85 is inserted is provided in the insertion and extraction directions of the discharge unit 97 into and from the connection port 57 of the waste ink tank 27. With such a configuration, when the waste ink tank 27 is moved toward the inside in the mount direction while inserting the discharge unit 97 into the connection port 57, the contact state where the inner circumferential surface 99 of the long hole 58*a* comes in contact with the pin 85 is maintained. Moreover, the contact state where the connection terminal 59 of the waste ink tank 27 comes in contact with the connection terminal 87 of the printer 11 is maintained. The contact state of both the connection terminals 59 and 87 at the time of mounting the waste ink tank 27 can be appropriately ensured.

(10) In the waste ink tank 27, the contactable state where the connection terminal 59 of the waste ink tank 27 can come in contact with the connection terminal 87 of the printer 11 is maintained, while regulating the movement from the center 57*a* of the connection port 57 in the radial direction, by first bringing the discharge unit 97 into the connection port 57 at the time of mounting the waste ink tank 27 on the printer 11. In this state, next, on the basis of the positioning function of the long hole 58*a* as the positioning unit, the waste ink tank 27 is positioned so that the contact surfaces of both the connection terminals 59 and 87 are in the appropriate contact state. Accordingly, when the waste ink tank 27 is mounted on the mount location 31 of the printer 11, it is possible to ensure the appropriate connection state where both the connection terminals 59 and 87 come in contact with each other.

(11) Since the urging force (pressing force) of the coil springs 80 is applied to the rear wall (pressed portion) 49 of the waste ink tank 27 in the detachment direction at the mount location 31 inside the receiving chamber 30, the waste ink tank 27 is intended to be moved in the detachment direction by the urging force. In this case, however, since the movement in the detachment direction is regulated thanks to the engagement of the locking step 40, which is provided at the mount location 31, with the locked step 60, which is provided on the bottom surface of the waste ink tank 27, the positioning state of the waste ink tank 27 at the mount location 31 is maintained. Accordingly, it is possible to ensure the stable mount state at the mount location 31.

(12) When the waste ink tank 27 is moved in the mount direction which is a direction reverse to the detachment direction, the locked step 60 on the bottom surface does not engage with the locking step 40 provided at the mount location 31. Accordingly, when the waste ink tank 27 is mounted on the printer 11, the waste ink tank 27 can be easily mounted without association with the presence of the locking step 40.

(13) When the waste ink tank 27 is displaced in its posture in the direction in which the locked step 60 disengages from the locking step 40 in order to detach the waste ink tank 27 from the mount location 31, it is possible to easily detach the waste ink tank 27 by use of the urging force of the coil springs 80 applied to the rear wall 49.

(14) When the gripping portion 94 is gripped by the user and raised in the upper direction intersecting the detachment direction in order to detach the waste ink tank 27 from the mount location 31, the position of the waste ink tank 27 is displaced. At this time, since the engagement of the locked step 60 with the locking step 40 at the mount location 31 is simply released, it is possible to easily detach the waste ink tank 27 from the printer 11.

(15) On the other hand, when the waste ink tank 27 is displaced in its posture in the direction in which the locked step 60 disengages from the locking step 40 due to inclination of the printer 11 in the state where the waste ink tank 27 is mounted, for example, the convex portion 92 protruding toward the front side intersecting the engagement releasing direction comes in contact with the protrusion 93 of the opening door 36. Accordingly, the displacement of the waste ink tank 27 is regulated in the engagement releasing direction in which the locked step 60 disengages from the locking step 40 is released and the stable mount state can be ensured.

(16) In the waste ink tank 27, when the convex portion 92 comes in contact with the protrusion 93 of the opening door 36 with the displacement in the engagement releasing direction in which the locked step 60 disengages from the locking step 40, the container member 44 may be deformed due to the stress applied with the contact. In this case, when the convex portion 92 is located on the side reverse to the connection terminal 59 in view from the connection port 57 in the width direction perpendicular to the insertion and extraction directions of the discharge unit 97 into and from the connection port 57, the deformation degree of the portion in which the connection terminal 59 is provided may increase. Therefore, the failure in the contact with the connection terminal 87 of the printer 11 may be caused. In order to solve this problem, in this embodiment, the connection terminal 59 is located on the same side on which the convex portion 92 is located, when viewed from the connection port 57 through which the discharge unit 97 is inserted and extracted. Therefore, even when the convex portion 92 comes in contact with the protrusion 93 of the opening door 36, the deformation degree of the portion in which the connection terminal 59 of the container member 44 is provided can decrease. Accordingly, it is possible to reduce the failure in the contact with the connection terminal 87 of the printer 11.

(17) When the waste ink tank 27 is mounted on the mount location 31, it is possible to prevent the waste ink tank 27 from being moved carelessly from the mount location 31, by locating the opening door 36 at the closing location so that the protrusion 93 as the displacement regulating unit is located at the regulation location. On the other hand, when the waste ink tank 27 is detached from the mount location 31 of the printer 11, it is possible to easily detach the waste ink tank 27, by locating the opening door 36 at the opening location so that the protrusion 93 as the displacement regulating unit is located at the non-regulation location.

(18) The waste ink tank 27 has the configuration in which the upper opening 48 of the container member 44 is sealed by the film member 46 as the sealing member and the ink solvent of the waste ink absorbed by the ink absorbing members 45*a* to 45*d* through the air communication hole 90 formed at one location of the film member 46 is evaporated to the outside. With such a configuration, this configuration is different from a case where the upper opening 48 of the container member 44 is not sealed and open. The solvent component of the waste ink received inside the waste ink tank 27 is suppressed from being excessively evaporated and volatilized. In addition, the residue of the waste ink is not accumulated on the surfaces of the ink absorbing members 45*a* to 45*d* received in the laminated manner. Accordingly, by suppressing the deterioration in the absorption capability of the ink absorbing members 45*a* to 45*d*, it is possible to prevent deterioration in a storage efficiency of the waste ink by the waste ink tank 27.

(19) In the waste ink tank 27, when the waste ink is discharged from the front end opening 76*a* as the discharge port of the discharge unit 97 in the state where the discharge unit 97 of the printer 11 is inserted into the connection port 57 and the sealing portion 91 comes in contact with the circular mounted portion 96 of the brim portion 74 in the support member 72 of the printer 11, the waste ink is absorbed into the ink absorbing members 45*a* to 45*d*. The waste ink absorbed into the ink absorbing members 45*a* to 45*d* permeates a broad area in the ink absorbing members 45*a* to 45*d* including the portion near the air communication hole 90 which is more away from the portion near the front end opening 76*a* as the discharge port than the connection port 57. In consequence, since the permeating area of the waste ink in the ink absorbing members 45*a* to 45*d* is broad, the gasification of the ink solvent of the waste ink from the broad permeating area is accelerated. Accordingly, since the solvent component gasified from the broad permeating area is evaporated outside the waste ink tank 27 through the air communication hole 90, the waste ink tank 27 can maintain the satisfactory absorption capability of the ink absorbing members 45*a* to 45*d* included therein.

(20) In this case, the air communication hole 90 is configured to allow the reception space 47 as the inner space of the waste ink tank 27 receiving the ink absorbing members 45*a* to 45*d* to communicate with the air at the location above the upper surface of the uppermost ink absorbing member 45*d*. With such a configuration, even when the waste ink is absorbed to the extent that the absorption capability of the ink absorbing members 45*a* to 45*d* reaches the limit, the problem with leakage of the waste ink from the air communication hole 90 to the outside can be reduced.

(21) The waste ink tank 27 can be manufactured by a simple work for attaching the film member 46 to the upper opening 48 of the container member 44 having the ink absorbing members 45*a* to 45*d* therein after forming the air communication hole 90 in the film member 46.

(22) Even when a downstream passage portion (the discharge unit 97 of the cylindrical body 73 in the support member 72) of the liquid passage extracted from the connection port 57 of the container member 44 with the detachment of the waste ink tank 27 from the mount location 31 is smeared due to the attachment of the waste ink in the container member 44, the waste ink is removed by the contact of the right and left inner groove surfaces of the cut-in groove 62 of the third ink absorbing member 45*c*. In this case, as for the discharge unit 97, the lower surface of the uppermost fourth ink absorbing member 45*d* comes in contact with the discharge unit 97 from the upper side and the right and left inner groove surfaces of the cut-in groove 62 of the third ink absorbing member 45*c* on the second layer from the upper side comes in contact with the discharge unit 97 from both the right and left sides. Additionally, the upper surface of the second ink absorbing member 45*b* on the third layer from the upper side comes in contact with the discharge unit 97 from the lower side. That is, the three ink absorbing members 45*b*, 45*c*, and 45*d* come in contact with the discharge unit 97 in an insertion manner from the upper, lower, right, and left directions. Accordingly, it is possible to prevent the vicinity of the connection port 57 of the waste ink tank 27 or the mount location 31 from being smeared due to the leakage of the waste ink from the front end cylindrical portion 76 and the non-cylindrical portion 77 of the cylindrical body 73 and the portion (that is, the discharge unit 97) of the flexible tube 43 exposed in the non-cylindrical portion 77 in the support member 72, when the waste ink tank 27 is detached from the printer 11.

(23) In particular, when the waste ink tank 27 in which the absorption capability of the ink absorbing members 45*a* to 45*d* reaches the limit is detached, the ink absorbing members 45*a* to 45*d* are swollen due to the absorbed waste ink. Therefore, the lower surface of the fourth ink absorbing member 45*d* and the upper surface of the second ink absorbing member 45*b* blocking the cut-in groove 62 and the groove width of the cut-in groove 62 from the upper and lower sides becomes narrow. Accordingly, since the contact pressure of the right and left inner groove surfaces of the cut-in groove 62 of the third ink absorbing member 45*c*, the lower surface of the fourth ink absorbing member 45*d*, and the upper surface of the second ink absorbing member 45*b* against the discharge unit 97 becomes strong, the waste ink attached on the discharge unit 97 can be surely removed.

(24) On the other hand, when the waste ink tank 27 in which an absorption amount of waste ink is small in the ink absorbing members 45*a* to 45*d* is detached, the ink absorbing members 45*a* to 45*d* are not swollen. In addition, the contact pressure of the right and left inner groove surfaces of the cut-in groove 62 of the third ink absorbing member 45*c*, the lower surface of the fourth absorbing member 45*d*, and the upper surface of the second absorbing member 45*b* against the discharge unit 97 is weak. However, in this case, the absorption capability of the ink absorbing members 45*a* to 45*d* is high. Accordingly, even when the contact pressure against the discharge unit 97 is weak, the waste ink attached to the discharge unit 97 can easily be removed by absorption of the ink absorbing members 45*a* to 45*d* through the right and left inner groove surfaces of the cut-in groove 62, the lower surface of the fourth absorbing member 45*d*, and the upper surface of the second absorbing member 45*b*.

(25) In particular, the upper surface of the second absorbing member 45*b* comes in contact with the discharge unit 97 from the lower side in the gravity direction. Accordingly, in the discharge unit 97, the waste ink attached to the circumferential surface is surely removed. In particular, it is possible to efficiently remove the waste ink attached to the discharge unit 97 extracted from the connection port 57, since the upper surface of the second absorbing member 45*b* surely comes in contact with the lower surface of the discharge unit 97 considered that an attachment degree of the waste ink is the highest because the attached waste ink is curved along the outer circumferential surface of the discharge unit 97 in the gravity.

(26) In order to remove the waste ink attached to the discharge unit 97, the cut-in groove 62 may extend in the insertion and extraction directions of the discharge unit 97 in the ink absorbing member 45*c*. Accordingly, it is possible to improve a manufacture efficiency of the waste ink tank 27.

(27) When the discharge unit 97 is inserted into the connection port 57 at the time of mounting the waste ink tank 27, the right and left inner groove surfaces of the cut-in groove 62 of the third ink absorbing member 45*c*, the lower surface of the fourth absorbing member 45*d*, and the upper surface of the second absorbing member 45*b* serving as a guide unit guide the discharge unit 97 in the predetermined direction (that is, the direction in which the through-holes 61 are present). Therefore, the discharge unit 97 is inserted into the connection port 57 in an appropriate direction. As a result, the waste ink tank 27 can be mounted easily and precisely at the time of mounting the waste ink tank 27.

(28) Even when the center of the discharge unit 97 is locationally deviated in the direction perpendicular to the insertion and extraction directions at the time of inserting the discharge unit 97 into the connection port 57, the deviation of the discharge unit 97 is corrected by the tapered portion 95 located on the side of the connection port 57 in the cut-in groove 62 serving as the guide unit. Accordingly, it is possible to easily guide the discharge unit 97 in the appropriate direction after the deviation.

(29) Since the cut-in groove 62 serving as the guide unit extends along the insertion and extraction directions of the discharge unit 97 at the location corresponding to the connection port 57, a long guide distance can be secured for the discharge unit 97 inserted into the connection port 57 at the time of mounting the waste ink tank 27. Accordingly, it is possible to guide the insertion direction more exactly.

(30) The movement of the waste ink tank 27 toward the inner wall surface is regulated by the engagement of the post 54 serving as the movement regulating unit with the ink absorbing members 45*b*, 45*c*, and 45*d* received inside the container member 44, even when the waste ink tank 27 is dropped after the detachment from the printer 11. With such a configuration, the ink absorbing members 45*b*, 45*c*, and 45*d* do not strongly come in pressing contact with the inner wall surface of the container member 44 when the waste ink tank 27 is dropped, and the waste ink absorbed therein is not squeezed. Accordingly, even when the waste ink tank 27 is dropped after the detachment from the printer 11, the waste ink absorbed and maintained by the ink absorbing members 45*b*, 45*c*, and 45*d* can be prevented from being leaked from the inside.

(31) In this case, since the post 54 serving as the movement regulating unit can ensure a locking function of regulating the movement of the ink absorbing members 45*b*, 45*c*, and 45*d* by a fitting depth of the post 54 with the holes 55 as fitting holes of the ink absorbing members 45*b*, 45*c*, and 45*d*, it is possible to reduce a problem with pivot when the ink absorbing members 45*b*, 45*c*, and 45*d* is dropped.

(32) The post 54 is erected at the substantially center on the inner bottom surface of the container member 44. Therefore, even when a direction of the container member 44 is oriented in any direction in which the waste ink tank 27 is accidentally dropped, a distance between the post 54 formed in the substantially center of the inner bottom surface and the inner wall surface which is a lower side of a drop direction of the container member 44 is almost uniform. Accordingly, even though the ink absorbing members 45*b*, 45*c*, and 45*d* may be swollen in the drop direction due to an impact when the waste ink tank 27 is dropped, the swollen portions of the ink absorbing members 45*b*, 45*c*, and 45*d* can be prevented from strongly coming in pressing contact with the inner wall surface of the container member 44 depending on the direction of the ink absorbing members.

(33) Even when the liquid passage for discharging the waste ink is formed by the flexible tube 43 which is the main constituent element, the flexible tube 43 is inserted into and extracted from the connection port 57 of the container member 44 in the waste ink tank 27 in the state where the flexible tube 43 is supported in the straight line by the support member 72 having rigidity. Accordingly, it is possible to satisfactorily mount and detach the waste ink tank 27.

(34) The liquid passage for discharging the waste ink into the waste ink tank 27 is formed by supporting the flexible tube 43 by use of the front end cylindrical portion 76 as a first support unit, the base end cylindrical portion 75 as a second support unit, and the cylindrical body 73 of the support member 72 including the non-cylindrical portion 77. The downstream end of the flexible tube 43 which is the downstream end of the liquid passage formed in the above-described manner is supported by the discharge unit 97 including the front end cylindrical portion 76 of the cylindrical body 73 in the support member 72 in the state oriented in the direction in which the mount location 31 is present. Accordingly, it is possible to stably form the liquid passage in which the flexible tube 43 of which the movement is unstable is the main constituent element.

(35) When the liquid passage for discharging the waste ink is formed, the downstream end of the flexible tube 43 is inserted into the front end cylindrical portion (the first support unit) 76 having the cylindrical shape in the support member 72, the downstream end of the flexible tube 43 is supported in the fitting state. Since the front end cylindrical portion 76 supporting the downstream end of the flexible tube 43 in this manner is formed in the front end of the cylindrical body 73 having the predetermined length in the support member 72, the downstream end of the flexible tube 43 which is a substantial discharge port of the waste ink is also disposed in the front end of the cylindrical body 73 in the support member 72. Accordingly, it is possible to satisfactorily discharge the waste ink.

(36) In the flexible tube 43, the portion having the predetermined length on the downstream end side is supported in the substantially straight shape by the cylindrical body 73 of the support member 72 in the direction in which the downstream end is oriented. For example, when the waste ink is discharged into the waste ink tank 27, the downstream end of the flexible tube 43 can be easily guided up to the center of the waste ink tank 27.

(37) In the flexible tube 43, the downstream end is supported in the fitting state by the front end cylindrical portion 76 of the support member 72. In addition, the portion having the predetermined length on the base end side from the downstream end is supported by the base end cylindrical portion 75 of the support member 72 and interposed by the fixing claws 78 of the non-cylindrical portion 77. Accordingly, the portion having the predetermined length on the downstream side of the flexible tube 43 can be supported in the stable state by the cylindrical body 73 (the front end cylindrical portion 76, the non-cylindrical portion 77, and the base end cylindrical portion 75) of the support member 72.

(38) Even when the container member 44 is slanted in its posture at the time of mounting or detaching the waste ink tank 27, the cylindrical body 73 of the support member 72 inserted into or extracted from the connection port 57 of the container member 44 at the slant in the support state of the flexible tube 43 is shaken. Accordingly, it is possible to easily mount and detach the waste ink tank 27 without any problem.

Fourth Embodiment

Next, a second embodiment of the invention will be described with reference to FIG. 12. In the second embodiment, since only a formation location of the air communication hole 90 is different from that in the first embodiment and the other configuration is the same, the air communication hole 90 will be mainly described below. In addition, the same reference numerals are given to the same constituent elements and repeated description is omitted.

In the waste ink tank 27 according to this embodiment, as shown in FIG. 12, the air communication hole 90 is formed at the substantially center in the longitudinal direction of the film member 46. In addition, when the discharge unit 97 of the cylindrical body 73 is inserted into the container member 44 from the connection port 57 of the waste ink tank 27, a distance Y between the front end opening 76*a* and the air communication hole 90 is configured to be shorter than a distance X between the connection port 57 and the front end opening 76*a* as the discharge port of the discharge unit 97.

With such a configuration, in this embodiment, the waste ink is actively evaporated in portions near the through-holes 61, which are locations where the waste ink discharged from the front end opening 76*a* as the discharge port of the discharge unit 97 and absorbed by the ink absorbing members 45*a* to 45*d* is stored most. Therefore, an amount of absorbed waste ink can be reduced before the waste ink soaks into the entire ink absorbing members 45*a* to 45*d*. As a result, it is possible to increase the amount of waste ink to be discharged into the ink absorbing members 45*a* to 45*d*.

In the second embodiment, the following advantage can be obtained instead of the advantage of (19) described in the first embodiment.

(39) In the waste ink tank 27, the air communication hole 90 is located in the vicinity of the front end opening 76*a* as the discharge port of the discharge unit 97 discharging the waste ink. With such a configuration, gasification of the solvent component of the waste ink can be accelerated from the portions near the through-holes 61 which are the portions absorbing the most amount of waste ink absorbed in the ink absorbing members 45*a* to 45*d*. Moreover, it is possible to satisfactorily maintain the absorption capability of the ink absorbing members 45*a* to 45*d* included in the waste ink tank 27.

The embodiments described above can be modified as follows.

As shown in FIGS. 13A to 13D, the connection port 57 of the waste ink tank 27 may have a non-circular shape. For example, a gap 100 is formed between the connection port 57 and the discharge unit 97 in the mount state where the discharge unit 97 is inserted into the connection port 57. In this case, a communication passage (not shown) communicating the gap 100 to the air is formed in at least one of the circular mounted portion 96 of the brim portion 74 of the support member 72 and the sealing portion 91 of the waste ink tank 27.

In this case, in the mount state where the discharge unit 97 is inserted into the connection port 57, the gap 100 is formed between the discharge unit 97 and the opening edge of the connection port 57 serves as the air communication hole 90. Therefore, it is necessary to form the air communication hole 90 as a part (the film member 46 or the like) of the waste ink tank 27. In addition, the solvent of the waste ink discharged into the waste ink tank 27 through the gap 100 serving as the air communication hole 90 can be evaporated.

In this case, in the connection port 57, the opening edge of the connection port 57 contacts with the outer circumference of the fitting cylindrical portion 98 of the discharge unit 97 at least three points P1, P2, and P3, when the discharge unit 97 is inserted into the connection port 57. When the opening edge is halves by a straight line L1 formed by one point (for example, P1) amount at least the three points P1, P2, and P3 and the center (the center 57*a* of the connection port 57) of the discharge unit 97, the other points (P2 and P3) other than the one point (for example, P1) are located on one edge and the other edge of the opening edge halved by the straight line L1. Accordingly, when the discharge unit 97 is inserted into the connection port 57, the movement of the discharge unit 97 in the connection port 57 in a direction perpendicular to the insertion and extraction directions of the discharge unit 97 into the connection port 57 is regulated by bringing the three points (P1, P2, and P3) on the opening edge into contact with the outer circumference of the fitting cylindrical portion 98 of the discharge unit 97.

Accordingly, in the case of the waste ink tank 27 shown in FIGS. 13A to 13D, the gap 100 formed between the connection port 57 and the discharge unit 97 serves as the air communication hole 90, even though the air communication hole 90 is not formed. As a result, it is possible to satisfactorily maintain a collection efficiency of ink.

The opening edge of the connection port 57 contacts with the outer circumference of the fitting cylindrical portion 98 of the discharge unit 97 at least at three points (P1, P2, and P3) and the movement of the discharge unit 97 is regulated in the direction perpendicular to the insertion and extraction directions. Accordingly, even though the positioning unit is not provided, the discharge unit 97 can be positioned by the connection port 57.

In the modified examples shown in FIGS. 13A to 13D, the fitting cylindrical portion 98 of the discharge unit 97 is formed to have a cylindrical shape of a cross-sectional non-circle (for example, a polygon such as a triangle or a quadrangle). In addition, the opening edge of the connection port 57 as opening of the waste ink tank 27 into which the discharge unit 97 is inserted may be formed to have a circular shape. Even with such a configuration, the advantages described above in the modified examples shown in FIGS. 13A to 13D can be obtained likewise.

As shown in FIG. 14, the connection terminal 59 of the waste ink tank 27 may be formed below the right wall 51 of the container member 44. With such a configuration, in the connection terminal 59, the contact surface 59*a* of the connection port 57 is also not perpendicular to a straight line L passing through the center 57*a* of the connection port 57. Accordingly, the same advantages as those in the embodiments can be obtained.

As shown in FIG. 15, the connection terminal 59 of the waste ink tank 27 may be formed in the same height as that of the center 57*a* of the connection port 57 in the sub left wall 50*b* of the container member 44. With such a configuration, when a swollen portion 101 having a slant surface on the sub left wall 50*b* of the container member 44 and the connection terminal 59 is formed on the slant surface, the contact surface 59*a* of the connection port 57 is also not perpendicular to a straight line L passing through the center 57*a* of the connection port 57. Accordingly, the same advantages as those in the embodiments can be obtained.

As shown in FIG. 16, in the positioning unit, the cylinder portion 58 may be omitted and a contact portion may be formed by the reinforcing rib 56*a*. In addition, the positioning unit serving as the contact portion may be configured by a member having a plate shape different from that of the reinforcing rib 56*a* of the concave portion 56.

As shown in FIG. 17, without dividing the rear wall 49 of the container member 44 of the waste ink tank 27 into the main rear wall 49*a* and the sub rear wall 49*b*, the connection port 57 is perforated through the rear wall 49. In addition, a rectangular hole 102 as a positioning unit into which the pin 85 can be inserted and a rectangular hole 103 as a fixing location of the connection terminal 59 may be punched.

As shown in FIG. 18, the waste ink tank 27 may be formed so that the main rear wall 49*a* on which the connection port 57 of the container member 44 is formed is retreated toward an inward side of the container member 44. As shown in FIG. 19, in the waste ink tank 27, the main rear wall 49*a* on which the connection port 57 of the container member 44 is formed may not be formed in a plane shape, but may be formed in a circular arc plane shape.

As shown in FIG. 20, in the waste ink tank 27, the sealing portion 91 may not be formed on the main rear wall 49*a* on which the connection port 57 of the container member 44 is formed.

As shown in FIG. 21, in the waste ink tank 27, the locked step 60 formed on the bottom surface of the container member 44 may be configured by the protrusion 104 protruding from the bottom surface.

As shown in FIGS. 22A and 22B, in the waste ink tank 27, the gripping portion 94 formed on the front end of the container member 44 may be configured by a slant shaft 94A or a horizontal shaft 94B. In this case, when the opening door 36 is at the closing location for the slant shaft 94A or the horizontal shaft 94B, the protrusion 93 may come close to regulate displacement. In this case, the convex portion 92 is not necessary.

As shown in FIG. 23A, the air communication hole 90 may be formed by cutting the front end side of the film member 46. As shown in FIG. 23B, a portion (a part having an elliptic shape indicated by a dashed line) of the upper opening 48 of the container member 44 may not be adhered to the film member 46. As shown in FIG. 23C, a notched portion 105 may be formed in a part of the upper opening 48 of the container member 44 to which the film member 46 is adhered.

As shown in FIGS. 24A to 24D, as the contact portions for removing the ink attached to the discharge unit 97 and the guide unit guiding the insertion direction, a slit 106 having a cross shape or the like may be formed from the cress-section of the ink absorbing member 45*c* to the through-holes 61, instead of the cut-in groove 62. Alternatively, a hole extending in the insertion and extraction directions of the discharge unit 97 may be formed instead of the slit 106.

As shown in FIG. 25, in the post 54 fitting and engaging with the holes 55 of the ink absorbing members 45*a* to 45*d*, the air communication hole 90 is formed from the upper end surface located above the upper surface of the uppermost ink absorbing member 45*d* in an axial direction and the lower portion of the air communication hole 90 may communicate with the air communication hole 90 by an omission groove 107 on the outside of the right and left walls in the lower portion of the post 54.

In the waste ink tank 27, the ink absorbing members 45*a* to 45*d* are not received in the reception space 47 which is the inner space, but the reception space 47 may store the waste ink as a waste ink container.

The thicknesses of the ink absorbing members 45*a* to 45*d* may be the same as each other or may be different from each other. The thickness can be arbitrarily determined and the number of the ink absorbing members 45*a* to 45*d* can be changed.

The printer 11 may be realized as a so-called full line type printer in which the shape of a print head corresponds to the entire width of a print sheet P in a direction intersecting a transport direction of the print sheet P.

The printer 11 may be realized as a so-called off-carriage type printer 11 in which the ink cartridges 23 are not mounted on the carriage 16 but on a predetermined location inside the printer 11, and ink is pressurized and supplied from the ink cartridges 23 to the print head 21 through an ink supply tube.

The sealing member may be a lid member such as a resin plate other than the film member 46.

In the container member 44 of the waste ink tank 27, the upper opening 48 may be sealed by a sealing member, when mounted on the mount location 31. That is, the container member may be displaced in the state where the upper opening 48 is sealed, by bringing a lid member, which is opened and closed on the rear end edge of the upper opening 48 of the container member 44, into contact with a contact member formed inside the reception 30 at the time of moving the container member 44 in the mount direction.

In the tube support mechanism 28, the coil springs 80 may be disposed between the brim portion 74 of the support member 72 and the front wall of the base body 63. In this case, the cylinders 79 may not be provided on the rear surface of the brim portion 74.

The non-cylindrical portion 77 of the cylindrical body 73 of the support member 72 may not be formed by cutting the circumferential wall of the cylindrical body 73, but may be formed by a connection member which connects a space between two cylindrical bodies individually forming the front end cylindrical portion 76 and the base end cylindrical portion 75 which each a cylindrical shape.

A removing member having a circularly ring shape may be mounted on the inner circumferential surface of the connection port 57 of the container member 44 in the waste ink tank 27.

In the tube support mechanism 28, the portion having the predetermined length on the downstream end side of the flexible tube 43 may be supported by a support member having a straight line shape and the plural tube fixing portions 71 provided on the upper surface of the base body 63 in the front and rear directions at an interval. In this case, the support member 72 may be formed only by a simple cylindrical member or a non-cylindrical member.

In the cylindrical body 73 of the support member 72, the entire front end may be formed as a non-cylindrical portion than the brim portion 74. In this case, it is preferable that the front end of the non-cylindrical portion is provided with the insertion claws 78 as the fixing portion.

In the cylindrical body 73 of the support member 72, the base end cylindrical portion may be formed as a non-cylindrical portion. In this case, it is preferable that the base end of the non-cylindrical portion is provided with the insertion claws 78 as the fixing portion.

As for the pin 85 and the long hole 58*a*, the pin 85 may be provided in the container member 44 of the waste ink tank 27 and the long hole 58*a* may be provided at the mount location 31 inside the receiving chamber 30.

The support member 72 of the tube support mechanism 28 may be fixed in a horizontal state so as not to be shaken with respect to the base body 63.

The locking unit locking with the waste ink tank 27 at the mount location 31 from the detachment direction may be formed as a locking protrusion protruding from the bottom wall 32 of the receiving chamber 30, as well as the locking step 40. Alternatively, the locking unit may lock with the side walls 50 and 51 of the container member 44 of the waste ink tank 27 by friction.

The locking step 40 may lock with the rear wall 49 of the waste ink tank 27.

In the embodiments described above, the liquid ejecting device has been realized as the ink jet printer, but the invention is not limited thereto. The liquid ejecting device can be realized as a device capable of ejecting or discharging another liquid other than ink, a liquid-formed substance in which particles of a functional material are dispersed or mixed, or a fluid-formed substance such as gel. Examples of the liquid ejecting device include a liquid-formed substance ejecting device ejecting a liquid-formed substance in which a material such as an electrode material or a coloring material (pixel material) used to manufacture a liquid display device, an EL (electroluminescence) display device, and a plane emission display is dispersed or solved; a liquid ejecting device ejecting a bio organic material used to manufacture a bio chip; and a liquid ejecting device ejecting a liquid as a sample used by a precise pipette. In addition, examples of the liquid ejecting device include a liquid ejecting device ejecting a lubricant to a precision instrument such as a clock or a camera by a pin point; a liquid ejecting device ejecting a transparent resin liquid such as ultraviolet cured resin on a board to form a minute hemispheric lens (optical lens) used in an optical communication element or the like; a liquid ejecting device ejecting an acid etching liquid or an alkali etching liquid to etch a substrate; and a liquid-formed substance ejecting device ejecting gel (for example, physical gel). The invention is applicable to one device thereof. In addition, in the specification of the invention, "the liquid" includes an inorganic solvent, an organic solvent, a solution, a liquid resin, a liquid metal (metallic melt), a liquid-formed substance, and a fluid-formed substance.

What is claimed is:

1. A waste liquid collector which is detachably mounted on a device including a discharge unit discharging a waste liquid and which stores the waste liquid discharged from the discharge unit when the waste liquid collector is mounted on the device, the waste liquid collector comprising:

an opening through which the discharge unit is inserted at the time of mounting the waste liquid collector on the device and through which the discharge unit is extracted at the time of detaching the waste liquid collector from the device;

a collector-side connection terminal which comes in contact with a device-side connection terminal included in the device when the discharge unit of the device is inserted into the opening and which exchanges information of the waste liquid with the device; and a positioning unit which regulates a rotation of the waste liquid collector and which positions the collector-side connection terminal to come in contact with the device-side connection terminal after regulating the movement from a center of the opening in the radial direction of the waste liquid collector by first the discharge unit being inserted into the opening when the waste liquid collector is mounted on the device.

2. The waste liquid collector according to claim 1, wherein the collector-side connection terminal is located between the opening and the positioning unit in an insertion direction in which the discharge unit is inserted into the opening and in an extraction direction in which the discharge unit is extracted from the opening.

3. The waste liquid collector according to claim 1, wherein the positioning unit includes a contact portion which comes in contact with a counter member included in the device.

4. The waste liquid collector according to claim 3, wherein the contact portion is provided in an insertion direction in which the discharge unit is inserted into the opening and an extraction direction in which the discharge unit is extracted from the opening.

5. The waste liquid collector according to claim 3, wherein the contact portion comes in contact with the counter member of the device so that the collector-side connection terminal regulates movement at least in a direction away from the device-side connection terminal in a rotation direction about an axis of the discharge unit inserted into the opening.

6. The waste liquid collector according to claim 1, wherein the collector-side connection terminal is provided so that a contact surface coming in contact with the device-side connection terminal is not perpendicular to a straight line extending in a radial direction from a center of the opening.

7. The waste liquid collector according to claim 6, wherein the opening and the collector-side connection terminal are provided in a container member which has a box-like shape having a bottom portion and stores the waste liquid discharged from the discharge unit and the collector-side connection terminal is located below the opening in the container member.

8. The waste liquid collector according to claim 6, wherein the collector-side connection terminal is provided so that the contact surface coming in contact with the device-side connection terminal is not perpendicular to a straight line extending obliquely and downward in a radial direction of a lower side from the center of the opening.

9. The waste liquid collector according to claim 6, wherein the contact surface of the collector-side connection terminal coming in contact with the device-side connection terminal has a planar shape extending in an insertion direction in which the discharge unit is inserted into the opening and in an extraction direction in which the discharge unit is extracted from the opening.

* * * * *